US006254267B1

(12) United States Patent
Arnaud

(10) Patent No.: US 6,254,267 B1
(45) Date of Patent: Jul. 3, 2001

(54) METHOD AND APPARATUS FOR MIXING DRY POWDER INTO LIQUIDS

(75) Inventor: Johnny Arnaud, Houston, TX (US)

(73) Assignee: Hydrotreat, Inc., Houston, TX (US)

( * ) Notice: Subject to any disclaimer, the term of this patent is extended or adjusted under 35 U.S.C. 154(b) by 0 days.

(21) Appl. No.: 09/186,586

(22) Filed: Nov. 5, 1998

Related U.S. Application Data

(60) Provisional application No. 60/064,881, filed on Nov. 6, 1997.

(51) Int. Cl.[7] ..... B01F 15/02

(52) U.S. Cl. ..... 366/137.1; 366/157.6; 366/167.1; 366/165.1

(58) Field of Search ..... 366/165.3, 165.4, 366/165.5, 165.1, 167.1, 164.1, 168.1, 177.1, 181.1, 181.3, 182.1, 182.3, 182.4, 101; 222/344

(56) References Cited

U.S. PATENT DOCUMENTS

| | | | | |
|---|---|---|---|---|
| 152,403 | | 6/1874 | Neuboeker . | |
| 431,624 | | 7/1890 | Schafhaus . | |
| 2,126,911 | | 8/1938 | Mullen | 99/132 |
| 2,148,998 | * | 2/1939 | Sackett | 366/165.1 |
| 2,528,514 | * | 11/1950 | Harvey et al. | 366/165.1 |
| 3,542,342 | * | 11/1970 | Barron | 366/181.3 |
| 4,077,612 | * | 3/1978 | Ricciardi | 366/165.4 |
| 4,086,663 | | 4/1978 | Croft | 366/154 |
| 4,184,771 | * | 1/1980 | Day | 366/165.4 |
| 4,323,314 | | 4/1982 | Kaiser-Wirz | 366/167 |
| 4,426,156 | | 1/1984 | Adamo et al. | 366/156 |
| 4,632,568 | | 12/1986 | Emele et al. | 366/337 |
| 4,643,582 | * | 2/1987 | Ricciardi | 366/165.3 |
| 4,643,584 | | 2/1987 | Allocca | 366/337 |
| 4,647,212 | | 3/1987 | Hankison et al. | 366/165 |
| 4,688,945 | * | 8/1987 | Brazelton et al. | 366/165.1 |
| 4,729,663 | * | 3/1988 | Karg | 366/165.3 |
| 4,753,535 | | 6/1988 | King | 366/337 |
| 4,758,098 | | 7/1988 | Meyer | 366/337 |
| 4,765,204 | | 8/1988 | Buchholz et al. | 76/101 R |
| 4,859,072 | * | 8/1989 | Fey et al. | 366/165.5 |
| 5,190,374 | * | 3/1993 | Harms et al. | 366/165.2 |
| 5,344,619 | * | 9/1994 | Larwick et al. | 366/165.1 |
| 5,382,411 | * | 1/1995 | Allen | 366/165.4 |
| 5,393,502 | | 2/1995 | Miller et al. | 422/261 |
| 5,468,066 | * | 11/1995 | Hammonds | 366/181.3 |
| 5,484,203 | | 1/1996 | King et al. | 366/377 |
| 5,489,153 | | 2/1996 | Berner et al. | 366/337 |
| 5,489,154 | | 2/1996 | Algreen-Ussing | 366/338 |
| 5,520,460 | | 5/1996 | Lantz | 366/337 |

OTHER PUBLICATIONS

Austin White Lime Company Observes 105$^{th}$ Anniversary, *Texas Contractor*, Mar. 5, 1993.

* cited by examiner

*Primary Examiner*—Tony G. Soohoo
(74) *Attorney, Agent, or Firm*—Howrey Simon Arnold & White, LLP

(57) ABSTRACT

The invention is a method and apparatus for mixing a powder into a liquid. In a first aspect, the invention includes an apparatus into which a powder can be fed for mixing into a liquid. The apparatus comprises a wetting housing defining a wetting chamber having a top part, a bottom part, a top port in the wetting chamber's top part, and a bottom port in the wetting chamber's bottom part; means for preventing powder from clumping by fluid force imparted from the wetting chamber's top part to keep the powder from accumulating before mixing; and a spray at the wetting chamber's bottom part to swirl the liquid and mix the powder in the liquid. In a second aspect, the apparatus is a part of a system including a tank that, when filled, contains the liquid and includes a first port and a second port permitting fluid flow through the tank; a source of the liquid; and a controller controlling the operation of the wetting chamber and the tank. In a third aspect, the invention is a method comprising feeding the powder into a chamber having a bottom part and a top part; swirling the liquid into the bottom part of the chamber; injecting a fluid into the top part of the chamber to prevent the powder from clumping; and extracting the mixed powder and liquid from the chamber.

35 Claims, 47 Drawing Sheets

METHOD AND APPARATUS FOR MIXING DRY POWDER INTO LIQUIDS

This disclosure briefly claims the earlier effective filing date of Provisional Patent Application, Ser. No. 60/064,881, filed Nov. 6, 1997, and entitled "Method and Apparatus for Mixing Powder Into Liquids."

FIELD OF THE INVENTION

The present invention generally relates to a method and an apparatus for mixing dry powder into liquids, and more specifically to methods and an apparatus for metering, dissolving, wetting, feeding, and mixing solid chemicals in powder or granular form into either a batch or continuous stream of fluid.

BACKGROUND OF THE INVENTION

Many industries employ technologies requiring dry powders mixed into liquids. Some of these industries, such as wastewater treatment, are not intuitively apparent. Others, such as brine production, are more apparent. These technologies utilize a wide variety of dry powders such as salt and lime, for mixing into fluids, especially water.

Wastewater Treatment

Wastewater treatment frequently mixes dry powders into water. In the treating of water for removal of contaminants, various chemicals perform selected functions in the treating process. The chemicals can be liquids or solids in granular or powder form. Some solids are dissolved into and used as liquids in the treating process. Other chemicals may perform their treating functions as solids.

Many separation processes used in wastewater treatment employ coagulation and/or flocculation. Laymen have long used the terms "coagulation" and "flocculation" interchangeably in discussing solid-liquids separation processes. Colloid scientists, however, have adopted a more specific usage. "Coagulation" implies aggregation caused by compression of the electrical double layers surrounding colloidal particles. "Flocculation" is restricted to cases where polymer bridging or some similar mechanism operates. Coagulation and flocculation are essential in many solid-liquid separation processes, since many suspended particles are too small for gravitational settling alone to effectively remove the particles. Coagulants can be purchased in both the liquid and the solid phases. Polymers used as flocculating agents can also be obtained in the liquid and solids phases. In the liquid phase, those chemicals must be mixed and dispersed to react with the contaminants throughout the water. In powdered or granulated solid form, those chemicals must be dissolved first and then mixed with water in order to react with the contaminants.

Chemicals that remain powdered during the treating process may also be used in addition to coagulants and flocculants to remove contaminants from water. Bentonite clays and activated carbon powders exemplify such solid chemicals used to remove organic and dissolved metal contaminants from water. The powders must be wetted, fed into the water, and dispersed in order to reach the contaminants throughout the body of water to be treated. Once injected into the water, the powders may also have to be coagulated and flocculated so they can also be settled and filtered to remove them from the water.

Brine Production

Brine production frequently mixes dry powder into water. Dissolving salt (NaCl) in water creates brine. Brine solutions are used in various concentrations in the regeneration of ion exchange resins for water softening and other applications. Saturated brines are normally diluted to make other concentrations when needed for specific applications. Brine used in the regeneration of water softeners is generally produced on site by dissolving salt in water. There are several types of salt used for this purpose, including rock salt, evaporated salt, and solar salt. Rock salt is mined from underground salt deposits by mechanically excavating it and elevating it to the surface Evaporated Salt is produced from brine mined by injecting hot water into an underground salt formation underground. The dissolved salt, brine, is brought up to the surface where the water is evaporated leaving the salt in solid state. A third type of salt is retrieved from the bed of lakes into which water flowed in geological times where it was captured and water evaporated by solar action to produce Solar Salt.

Lime Mixing

Lime is yet another material commonly used as a dry powder for mixing into powders. Lime is used in the production of other chemicals, steel, non-ferrous metals, pulp and paper, sugar, cement and plaster, leather, rubber, glass, glue, paint, and other products. Commercial lime is produced in two basic forms including quicklime and hydrated lime, both in powder form. Large quantities of lime typically have to be prepared, in both large and small batches, for use in metering, dissolving, wetting, and mixing in fluids.

Drilling Fluids

One common end product of mixing dry powders into liquids is a drilling fluid. Sophisticated drilling fluids, often called "drilling mud," are used to perform a variety of functions in oil well drilling operations. Millions of tons of dry powders are delivered to the drilling sites each year to be converted to flowable fluids with both soluble and insoluble substances. Water is widely used as the principal fluidizing medium in drilling fluids. Some chemicals are delivered to drilling sites premixed as fluids for emergencies or as specialty chemicals.

Barite has traditionally been the largest quantity of dry powder used by the industry. Barite typically is the only dry chemical delivered to the site in bulk. A method commonly used to transfer the bulk Barite drops the powder through the open air into a hopper. Virtually all other chemicals used in drilling fluids are packaged, transported, and stored in bags or sacks. As the chemicals are used, the sacks are cut open and the powders are poured out into open hoppers. Whether the chemicals are mixed on the drilling sites or at the warehouses, some of the same problems of handling dry powders exist.

SUMMARY OF THE INVENTION

The invention is a method and apparatus for mixing a powder into a liquid. In a first aspect, the invention includes an apparatus into which a powder can be fed for mixing into a liquid. The apparatus comprises a wetting housing defining a wetting chamber having a top part, a bottom part, a top port in the wetting chamber's top part, and a bottom port in the wetting chamber's bottom part; means for preventing powder from clumping by fluid force imparted from the wetting chamber's top part to keep the powder from accumulating before mixing; and a spray at the wetting chamber's bottom part to swirl the liquid and mix the powder in the liquid.

In a second aspect, the apparatus is a part of a system including a tank that, when filled, contains the liquid and includes a first port and a second port permitting fluid flow through the tank; a source of the liquid; and a controller controlling the operation of the wetting chamber and the tank.

In a third aspect, the invention is a method comprising feeding the powder into a chamber having a bottom part and a top part; swirling the liquid into the bottom part of the chamber; injecting a fluid into the top part of the chamber to prevent the powder from clumping; and extracting the mixed powder and liquid from the chamber.

BRIEF DESCRIPTION OF THE DRAWINGS

Other objects and advantages of the invention will become apparent upon reading the following detailed description and upon reference to the drawings in which:

FIG. 1 depicts the manual dry chemical powder feeding system and identifies basic system components;

FIG. 2 depicts the system of FIG. 1 wherein fluid is being drained from the manual powder feeder and transferred to a fluid treating tank;

FIG. 3 depicts the system of FIG. 1 wherein dry chemical powder is placed in an opened manual powder feeder;

FIG. 4 depicts the system of FIG. 1 with dry chemical powder in a closed manual powder feeder;

FIG. 5 depicts the system of FIG. 1 wherein water from the treating tank is added to the manual powder feeder;

FIG. 6 depicts the system of FIG. 1 as fluid is flowing upward through the manual powder feeder for wetting and dissolving the dry chemical powders;

FIG. 7 depicts the system of FIG. 1 as fluid is flowing downward through the manual powder feeder and transferring wetted solid and dissolved chemical powders to the top of the treating tank; and FIG. 8 depicts the system of FIG. 1 as fluid is flowing downward through the manual powder feeder assisted by applying air pressure in the top of the feeder to accelerate the flow of fluid for transferring wetted solid and dissolved chemical powders to the top of the treating tank.

FIG. 9 depicts the manual dry powder feeding system and identifies basic components of a brine production system;

FIG. 10 depicts the system of FIG. 9 with dry powdered salt placed in the manual powder feeder;

FIG. 11 depicts the system of FIG. 9 as water is being used to dissolve the salt as it fills the system;

FIG. 12 depicts the system of FIG. 9 as system water is re-circulated to complete the dissolving of the salt in production of saturated brine; and FIG. 13 depicts the system of FIG. 9 wherein fluid is being drained from the manual powder feeder and transferred to the treating tank.

FIG. 14 depicts the automatic dry powder feeding system and identifies basic components of a system for treating continuous flowing streams of contaminated fluid;

FIG. 15 s is an enlarged view of the automatic powder feeder of the system of FIG. 14;

FIG. 16 depicts the system of FIG. 14 as dry chemical powder is filling the three-way metering ball valve of the automatic powder feeder;

FIG. 17 is an enlarged view of the automatic powder feeder of the system of FIG. 14 while filling the three-way metering ball valve;

FIG. 18 depicts the system of FIG. 14 as dry chemical powder is being discharged from the three-way metering ball valve of the automatic powder feeder;

FIG. 19 is an enlarged view of the automatic powder feeder of the system of FIG. 14 while dry chemical powder is being discharged from the three-way metering ball valve;

FIG. 20 depicts the system of FIG. 14 as dry chemical powder is being injected into the wetting chamber located in the top of the treating tank; and FIG. 21 is an enlarged view of the wetting chamber of the system of FIG. 14 as dry chemical powder is being injected into it.

FIG. 23 depicts an automatic dry powder feeding system and identifies basic components of a system for treating continuous flowing streams of contaminated fluid;

FIG. 24 is an enlarged view of the automatic powder feeder of the system of FIG. 23 wherein dry chemical powder is placed in the feeder;

FIG. 25 depicts the system of FIG. 23 as the metering cavity of the automatic powder feeder is being filled with dry chemical powder;

FIG. 26 depicts the system of FIG. 23 as dry chemical powder is captured in a full metering cavity of the automatic powder feeder; and FIG. 27 schematically depicts the system of FIG. 23 as dry chemical powder is being discharged from the metering cavity of the automatic powder feeder.

FIG. 28 depicts the manual dry powder feeding system with an automatic bulk powder metering system and identifies basic components of a system for production of brine from salt;

FIG. 29 depicts the system of FIG. 28 as the metering cavity of the automatic bulk powder metering system is being filled with dry salt powder;

FIG. 30 depicts the system of FIG. 28 as the dry salt powder is being discharged from the metering cavity of the automatic dry bulk powder metering system and transferred to the manual powder feeder.

FIG. 31 depicts the automatic dry powder metering and feeding system for both bulk and sacked dry powder chemicals and identifies basic subsystems;

FIG. 32 is an enlarged view of the bulk holding tank and metering system of the system of FIG. 31 identifying basic components;

FIG. 33 is an enlarged view of the bulk holding tank and metering system of the system of FIG. 31 as the large metering cavity is filled with dry chemical powder;

FIG. 34 is an enlarged view of the bulk holding tank and metering system of the system of FIG. 31 as dry chemical powder is being discharged from the large metering cavity;

FIG. 35 is an enlarged view of the bulk holding tank and metering system of the system of FIG. 31 as the small metering cavity is filled with dry chemical powder;

FIG. 36 is an enlarged view of the bulk holding tank and metering system of the system of FIG. 31 as dry chemical powder is being discharged from the small metering cavity;

FIG. 37 is an enlarged view of the hopper feeding system of the system of FIG. 31 and identifies essential system components;

FIG. 38 s is an enlarged view of the hopper feeding system of the system of FIG. 31 with the cover retracted;

FIG. 39 depicts the system of FIG. 31 as dry chemical powder is being transferred from the bulk metering system to the hopper feeding system;

FIG. 40 is an enlarged view of the hopper feeding system of the system of FIG. 31 as dry chemical powder is being drawn out of the hopper by the eductor;

FIG. 41 is an enlarged view of the sacked chemical powder metering system of the system of FIG. 31 and identifies basic system components;

FIG. 42 is an enlarged view of the sacked chemical powder metering system of the system of FIG. 31 as one of the metering cavities is being filled with dry chemical powder, and as dry chemical powder is being discharged from the other metering cavity;

FIG. 43 is an enlarged view of the mixing system of the system of FIG. 31 and identifies basic system components;

FIG. 44 is an enlarged view of the venting system of the system of FIG. 31 and identifies basic system components;

FIG. 45 depicts the system of FIG. 31 as the venting system is operating; and FIG. 46 depicts the system of FIG. 31 as drilling fluid is being re-circulated and drawing dry chemical powder into the mixing system from one of the bulk powder metering and feeding systems.

Figure 1:
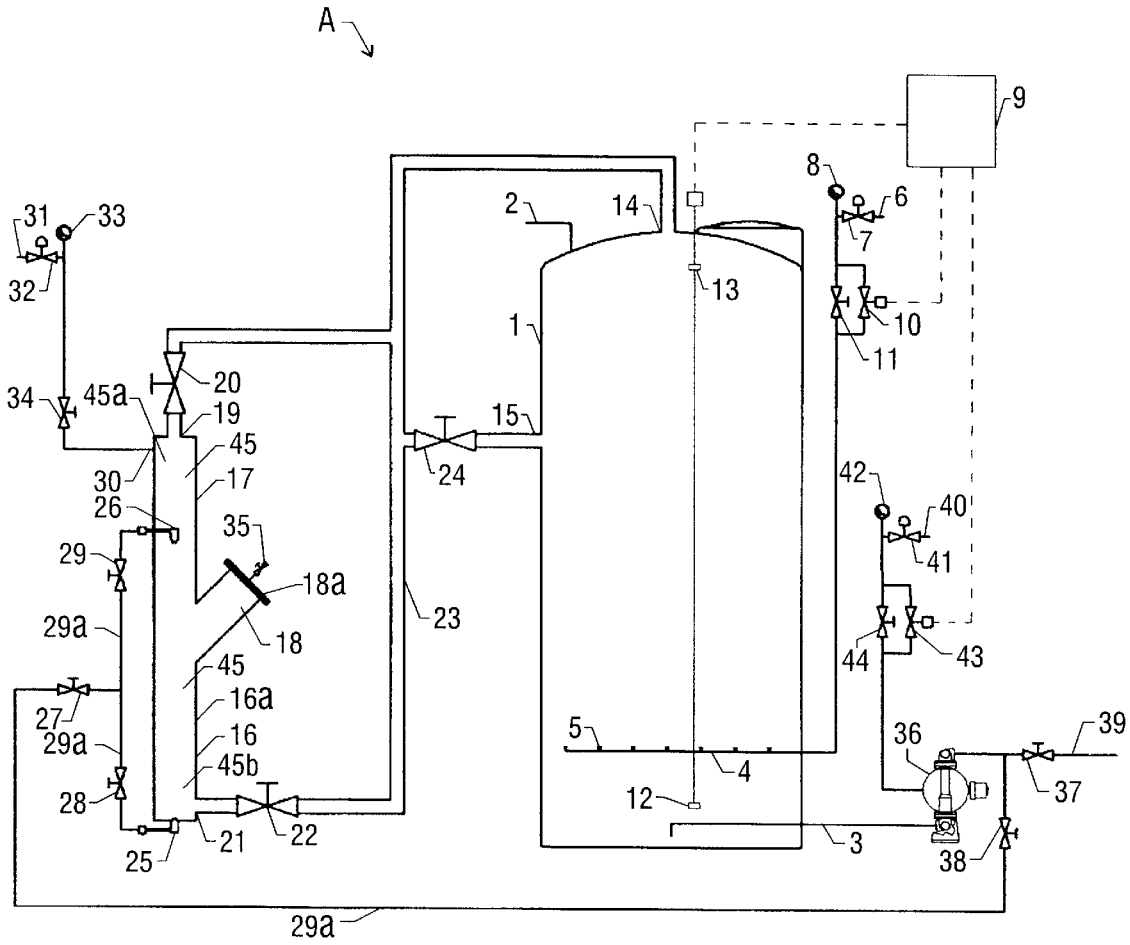
FIGS. 1–8 schematically illustrate a first embodiment of a manual dry chemical powder feeding system in accordance with the present invention for treating contaminated fluids in batches. More particularly.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF PREFERRED EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The invention, in a first aspect, is an apparatus into which a powder can be fed for mixing into a liquid. As used herein, the term "powder" shall refer to a dry powder or a granularized solid. The apparatus comprises a wetting housing defining a wetting chamber having a top part, a bottom part, a top port in the wetting chamber's top part, and a bottom port in the wetting chamber's bottom part; means for preventing powder from clumping by fluid force imparted from the wetting chamber's top part to keep the powder from accumulating before mixing; and a spray at the wetting chamber's bottom part to swirl the liquid and mix the powder in the liquid. The liquid may be any of a variety of fluids, including, but not limited to, water and drilling fluids. Similarly, the powder may be any one of many, including, but not limited to, coagulants, flocculants, salts, bentonite clays, activated carbon powders, lime, lignite, lignosulfanate, and barite. The particular liquid and powder will be implementation specific depending on the particular embodiment of the invention.

In a second aspect, the invention includes an apparatus into which a powder can be fed for mixing into a liquid. The apparatus comprises a wetting chamber, a tank, a source of the liquid, and a controller. The wetting chamber includes a wetting housing defining a chamber having a top part, a bottom part, a top port in the wetting chamber's top part, and a bottom port in the wetting chamber's bottom part; means for preventing powder from clumping by fluid force imparted from the wetting chamber's top part to keep the powder from accumulating before mixing; a spray at the wetting chamber's bottom part to swirl the liquid and mix the powder in the liquid. The tank, when filled, contains the liquid and includes a first port and a second port permitting fluid flow through the tank. The controller controls the operation of the wetting chamber and the tank. As in the first aspect of the invention, the liquid and powder will be implementation specific.

In a third aspect, the invention comprises a method for mixing a powder into a liquid. The method comprises feeding the powder into a chamber having a bottom part and a top part; swirling the liquid into the bottom part of the chamber; injecting a fluid into the top part of the chamber to prevent the powder from clumping; and extracting the mixed powder and liquid from the chamber. As with the first and second aspects, the liquid and powder will be implementation specific. Further, each of these aspects are subject to many variations as set forth below, each of which is within the scope and spirit of the invention as claimed below.

A FIRST EMBODIMENT

Referring now to the drawings in more detail, FIGS. 1–8 illustrate a first embodiment of a system including an apparatus for mixing a powder in to a liquid in accordance with the present invention. This particular embodiment feeds coagulating and flocculating agents into water to be treated in batches. FIG. 1 depicts the liquid and powder mixing system A and identifies basic system components for this particular embodiment of the present invention. FIGS. 2–8 depict the system A during various stages of operation.

Apparatus of the First Embodiment

More particularly, this embodiment of the invention is a manual powder feeding system A. An apparatus 16 including a wetting housing 16*a* defining a wetting chamber 45 having a top part 45*a*, a bottom part 45*b*, a top port 19 in the wetting chamber's top part 45*a*, and a bottom port 21 in the wetting chamber 45's bottom part 45*b*; means, as discussed below, for preventing powder 48 (shown in FIG. 3) from clumping by fluid force imparted from the wetting chamber 45's top part 45*a* to keep the powder 48 from accumulating before mixing; and a spray 25 at the wetting chamber 45's bottom part 45*b* to swirl the liquid 47 (shown in FIG. 2) and mix the powder 48 in the liquid 47. In this particular embodiment, the apparatus 16 functions as both a wetting chamber and a powder feeder. Furthermore, the system A includes a tank 1, a source (not shown) of the liquid 47, and a controller 9.

Referring now to FIG. 1, a treating tank 1 is sized to hold the amount of water to be treated as a batch. Water to be treated enters the treating tank 1 from a source (not shown) through a water inlet port 2. The treated water and sludge formed as the result of the treating process exits treating tank 1 through an outlet port 3. A piping manifold 4 containing perforations 5 is positioned to inject air into the lower part of the water so it will bubble up through the water and disperse the chemicals used for treatment. Air is supplied to the piping manifold 4 through air inlet 6. The regulator 7 adjusts incoming air pressure. Pressure gage 8 indicates the regulated air pressure. In this particular embodiment, an electrical controller 9 opens solenoid valve 10 when air is to be fed into the treating tank 1. A manual valve 11 can be used to bypass solenoid valve 10. Level sensors 12 and 13 monitor low and high water levels, respectively. An inlet port 14 in the top of the treating tank 1 is provided to receive water, chemicals, and air from the apparatus 16. A side outlet port 15 is located below the water's surface when water is in treating tank 1 and fills the feeder 16 with water.

The apparatus 16 wets the flocculating powder 48 (shown in FIG. 3) and then feeds it into the top of the treating tank 1 through the port 14. The apparatus 16, in this particular embodiment, comprises a vertical column 17 with a side access 18 through which the flocculating powder 48 may be placed into the column 17. A top port 19 and manual outlet valve 20 allow the water and chemical mixture to leave the column 17 from the top. A bottom port 21 and manual outlet valve 22 allow the water and chemical mixture to leave the column 17 from the bottom. The top port 19 and bottom port 21 connect both ends of column 17 to the top of the treating tank 1 through vertical piping 23 outside the feeder 16. Thus, wetted flocculating powder 48 can be pumped out of the feeder 16 in both directions.

The water 47 is introduced into the apparatus 16 from the tank 1. Another valve 24 and the piping 23 connect the apparatus 16 to the treating tank 1 below the water level to allow water (not shown in FIG. 1 from the tank 1 to flow into the apparatus 16. A spray nozzle 25 in the bottom of column 17 sprays and swirls water pumped upward into the column 17 to lift and stir the flocculating powder with the incoming water. A second spray 26 mounted in the column 17 above the powder is directed to spray and swirl incoming water downward and in the opposite direction to break up any cluster of dry powder as it is lifted by the water flowing upward from below the powder.

Valves 27, 28 and 29 on the incoming water feed lines 29*a* can be used to regulate the amount of water flowing into the apparatus 16 and direct the flow to the upper or lower nozzles 25 and 26. The water can be directed to flow upward out of the feeder by opening the outlet valve 20 at the top of the column 17 and closing the outlet valve 22 at the bottom of the column 17. Conversely, the water can also be directed to flow downward out of the feeder by opening the outlet valve 22 at the bottom of the column 17 and closing the outlet valve 20 at the top of the column 17.

The flow of water is directed upward for wetting and dissolving the flocculating powder and downward for carrying undissolved flocculating powder out of the apparatus 16 and into the top of the treating tank 1 through the piping 23. Air is injected into the top of the apparatus 16 through air inlet port 30 when the water is flowing downward to accelerate the water flow and increase velocity to assist the water in carrying the powder to the top of the treating tank 1 through the piping 23. Air enters through air supply inlet 31. The regulator 32 adjusts incoming air pressure. The pressure gage 33 indicates the regulated air pressure. The manual valve 34 shuts off the air supplied. An air pressure relief valve 35 is provided on the cover of side access 18 to release pressure before removing the cover 18*a* over the side outlet 18.

After the flocculating powder is place into the apparatus 16, the wetting, is dissolving, and feeding operation can be accomplished in less than one or two minutes in this particular embodiment. Following the flocculating powder feeding operation, water is drained out of the feeder by air pressure to be ready for the next batch of water to be treated.

A pump 36 provides water at the flow rate and pressure needed to dissolve any part of the powder to be used as liquid, wet the part of the powder to remain as solids, and feed the chemicals into the top of the treating tank 1. Shutoff valves 37 and 38 are used to direct the output of pump 36 to either the system outlet 39 or to the apparatus 16. Air is supplied through air inlet 40. The regulator 41 adjusts incoming air pressure. Pressure gage 42 indicates the regulated air pressure. The electrical controller 9 opens solenoid valve 43 when air is needed to operate pump 36. A manual valve 44 can be used to bypass solenoid valve 43.

Operation of the First Embodiment

Figure 2:
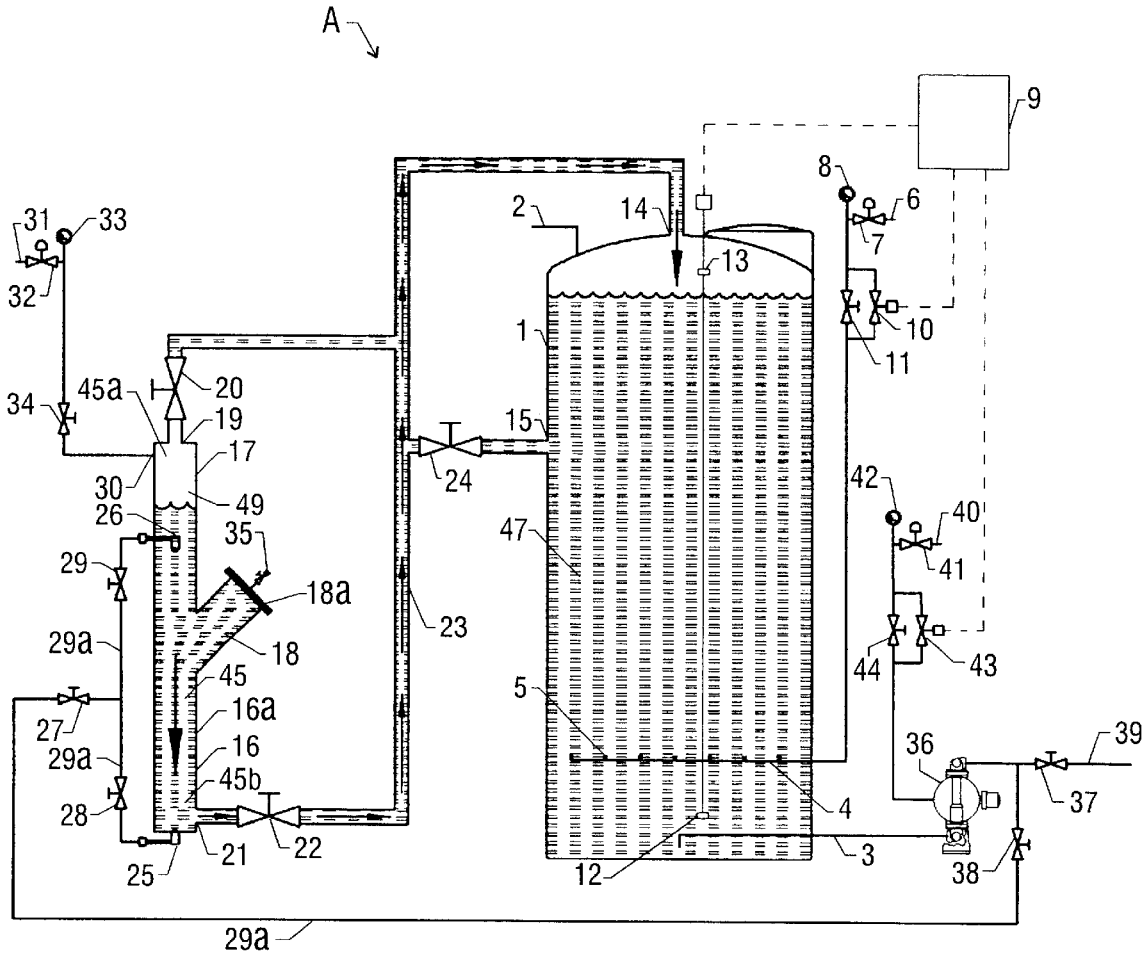

FIG. 2 depicts water being drained from the apparatus 16 and transferred to the treating tank 1 to fill treating tank 1 with a batch of water 47 to be treated. Manual outlet valve 20 at the top of feeder column 17 is closed, manual outlet valve 22 at the bottom of feeder column 17 is opened, and air inlet valve 34 is opened. Air 49 entering the apparatus 16 displaces water 47 in the feeder column 17 and forces it to flow out through outlet port 21, up through piping 23 and into the top of treating tank 1 through inlet port 14. When all water 47 is drained from the apparatus 16, manual valve 22 is closed, and then the apparatus 16 is ready for its intended operation.

Figure 3:
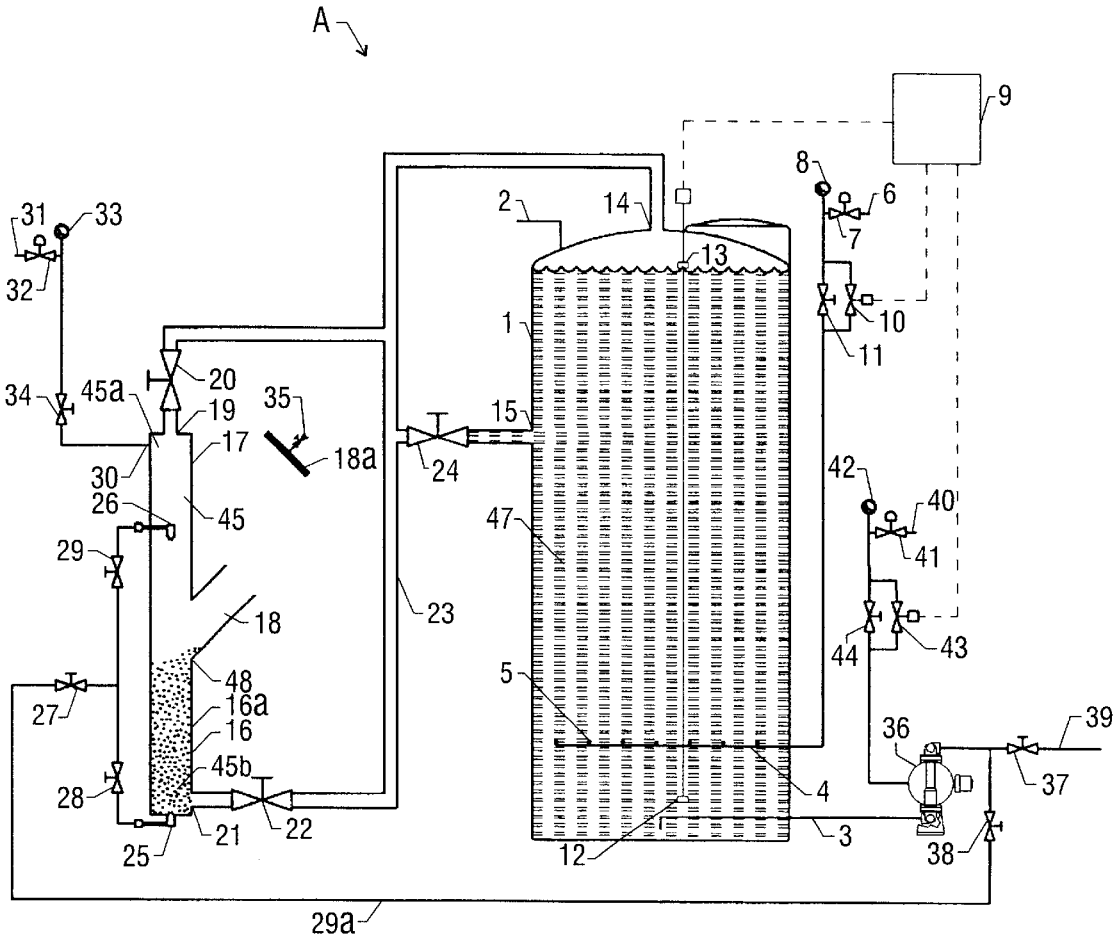
Figure 4:
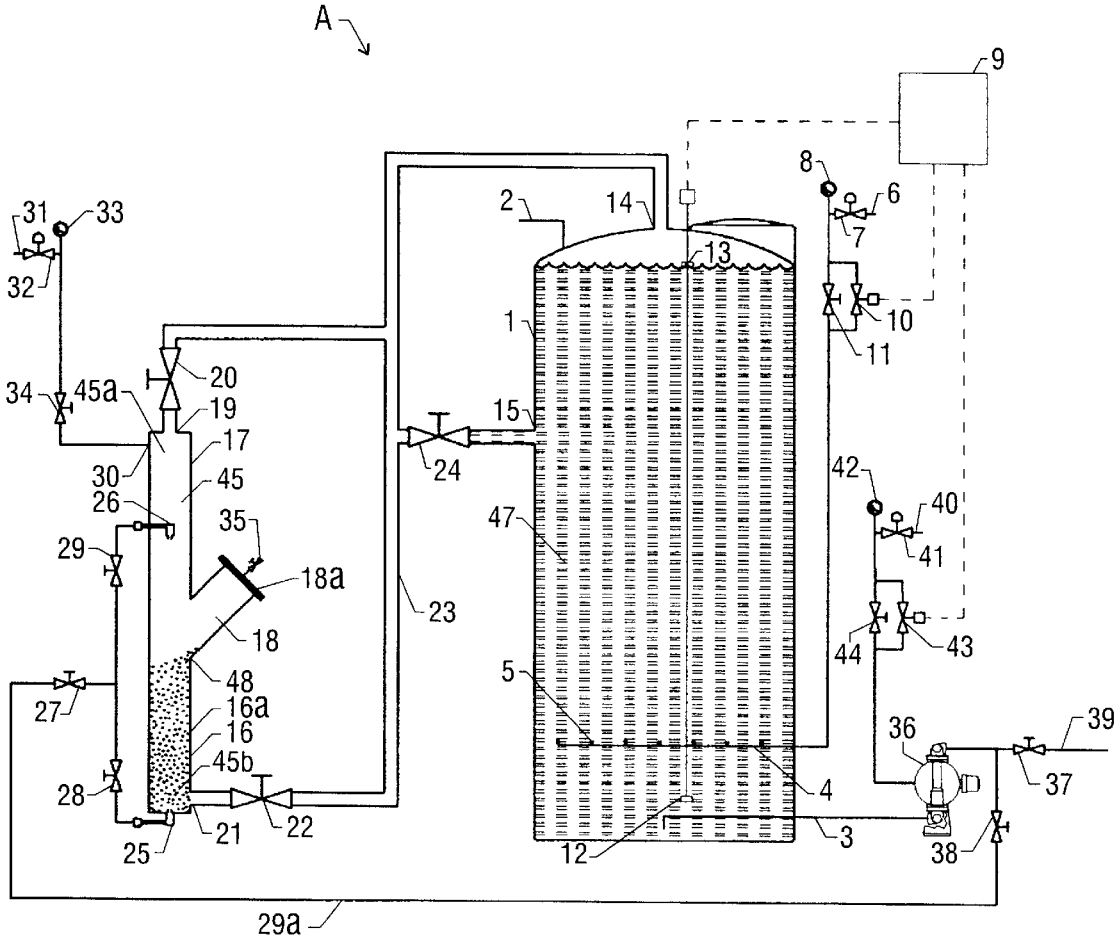

FIGS. 3–4 depict the placement of the flocculating chemical 48 in powder form into the apparatus 16. Referring to FIG. 3, the treating tank 1 holds a batch of water 47 to be treated as a batch. The cover 18*a* is removed from the side access 18 of the apparatus 16. The amount of flocculating powder 48 needed for treating the batch of water 47 contained in treating tank 1 is placed into feeder column 17. With the flocculating powder 48 in the apparatus 16, the cover 18*a* is replaced on the side access 18 as shown in FIG. 4.

Figure 5:
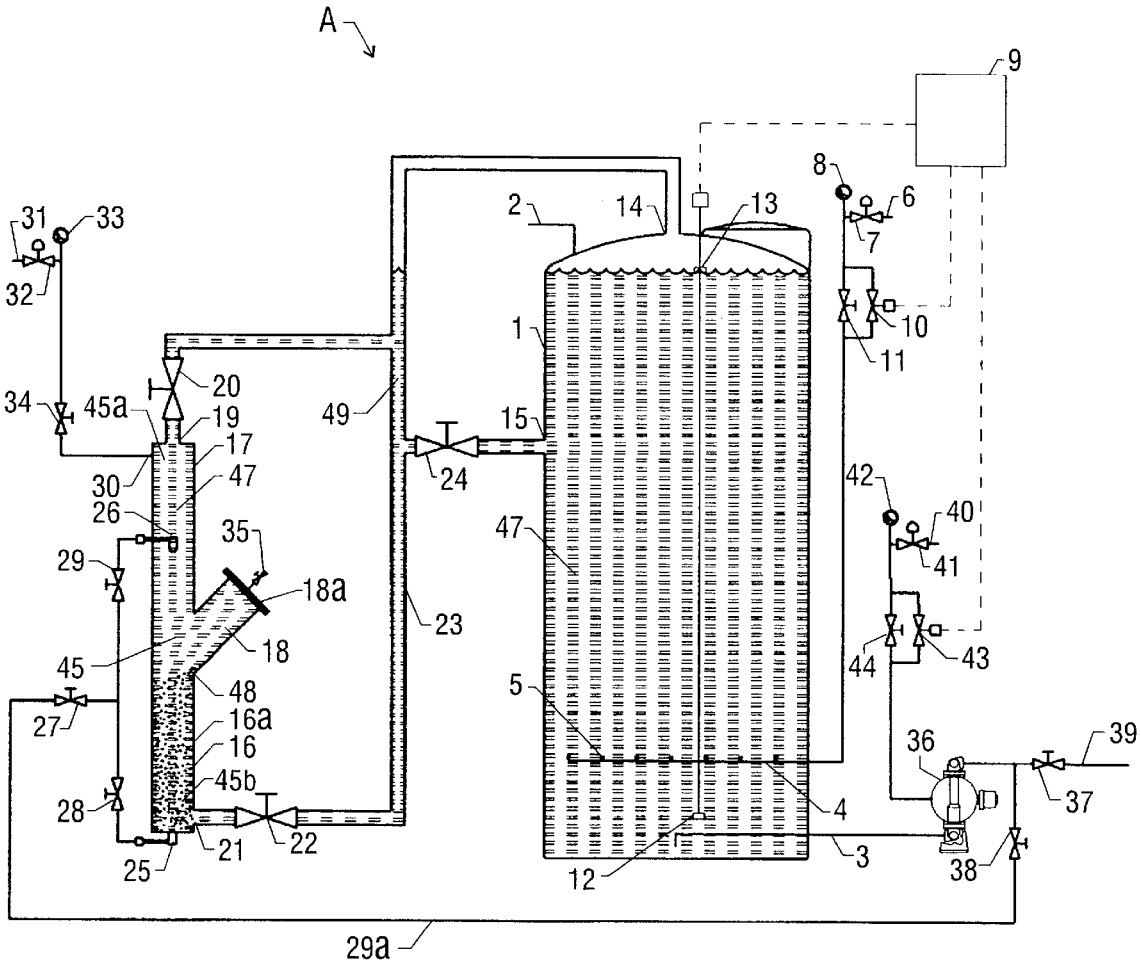

FIG. 5 depicts the removal of the batch of water 47 from treating tank 1 to fill the apparatus 16. Manual valves 20 and 22 at the top and bottom of the apparatus 16, respectively, and manual valve 24 on the side of treating tank 1 are opened, and a batch of water 47 is allowed to fill the apparatus 16 from the treating tank 1.

Figure 6:
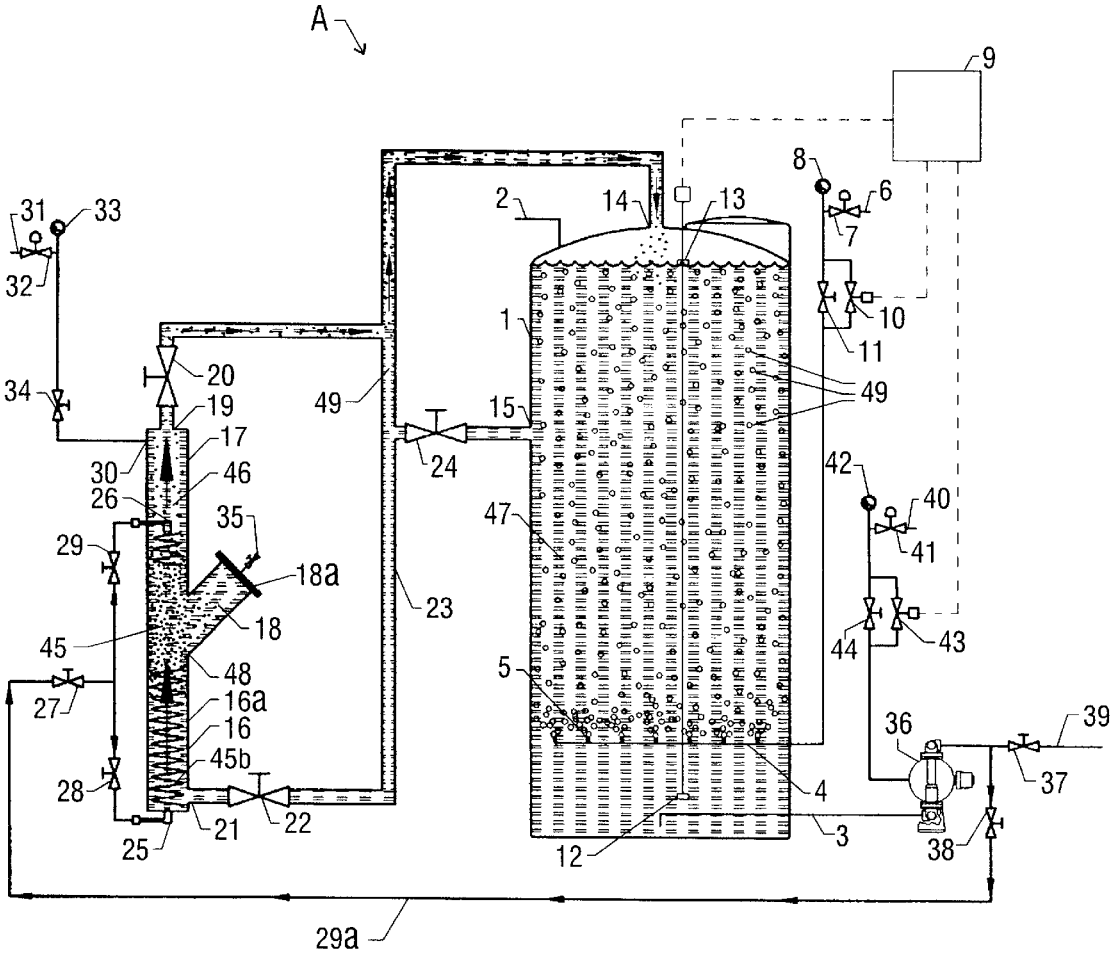

FIG. 6 depicts the powder dissolving and wetting function of the operating cycle. Air 49 is bubbled up through the batch of water 47 in the treating tank 1 to thoroughly mix the flocculating chemicals 48 from the apparatus 16, when it is injected into the tank 1, with the contaminants (not shown) in the dirty water of the batch 47. The air 49 is introduced into the batch of water 47 by opening the air supply valve 10. Air supply valve 10 is actuated when a momentary switch (not shown) is depressed on the panel (not shown) of the controller 9. The air 49 flows through manifold 4, is distributed in the lower part of the batch of water 47 by perforations 5, and bubbles up the water 47 in treating tank 1. Electrical controller 9 allows the bubbling to continue for a preset amount of time then closes valve 10 to shutoff the air.

With the apparatus 16 full of water 47 and air 49 bubbling up through the batch 47 in the treating tank 1, the system A is ready for injection of the chemicals 48 into the batch of water 47 to be treated. Manual valve 20 at the top of the feeder column 17 is left open while manual valve 22 at the bottom of feeder column 17 and manual valve 24 on the side of treating tank 1 are closed. Shutoff valve 37 is closed and shutoff valves 38 and 27 are opened.

Electrical controller 9, is then used to open supply valve 43 and allow air to flow and operate pump 36. Spray nozzle 25 in the bottom of column 17 directs and swirls the incoming water of the batch of water 47 upward into column 17 to lift and stir the powder 48 with the incoming water. At the same time, upper nozzle 26, mounted in the column 17 above the powder 48, directs and swirls the incoming water downward and in the opposite direction to break up any cluster of dry powder 48 as it is lifted by the water flowing upward from nozzle 25. Valves 28 and 29 in the incoming water feed lines can be used to regulate the amount of water directed to the upper or lower nozzles.

Water is pumped up through the apparatus 16, out top outlet port 19, and into the top of treating tank 1 through inlet port 14 for, in this embodiment, approximately one minute to dissolve or wet the powder in the feeder. At this point, the powdered chemical 48 is mixed with the water of the batch of water 47, although, in this embodiment, not evenly throughout the batch of water 47. Some of the dissolved chemical 48 will also be carried with the water to the top of the treating tank 1. The velocity of the water flowing upward in the apparatus 16, however, is not sufficient to carry all solid powder particles with it in this particular embodiment. The direction of flow is then reversed to flow downward as discussed below.

Figure 7:
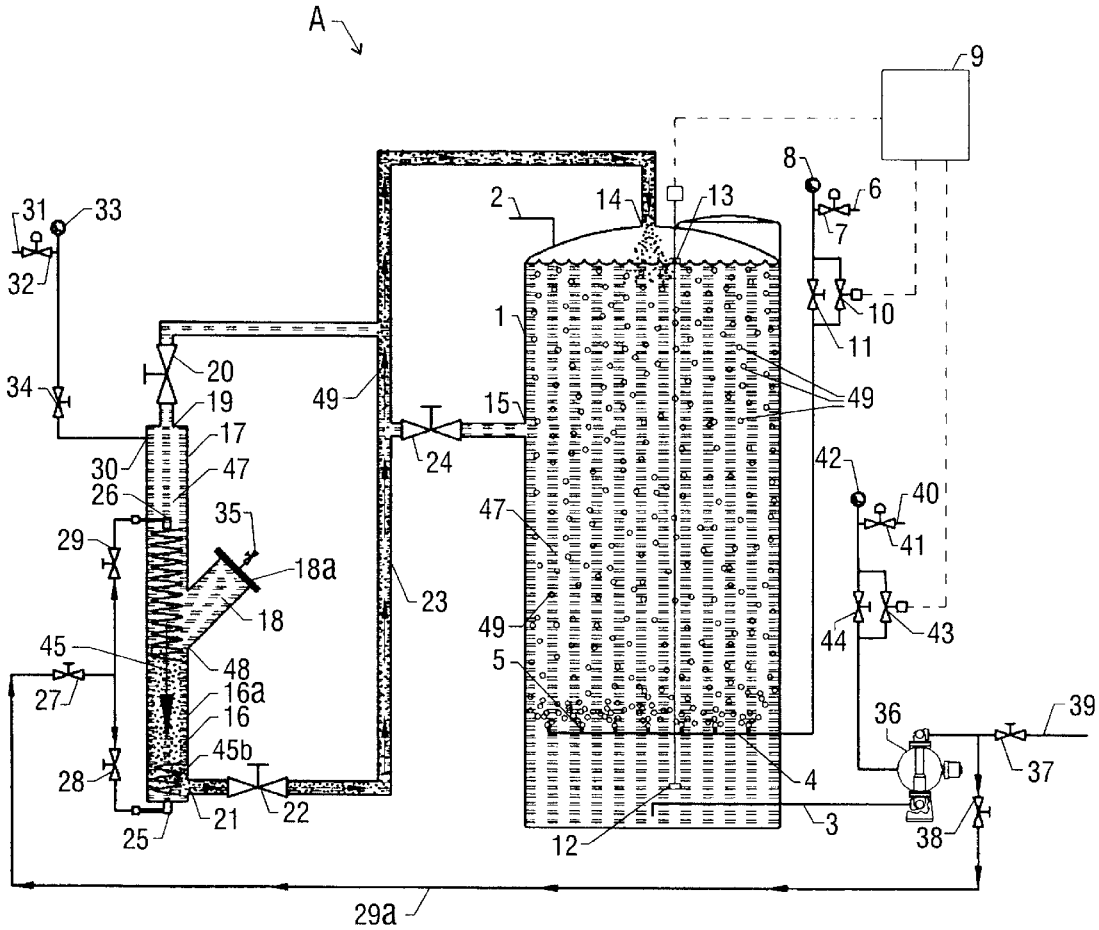
Figure 8:
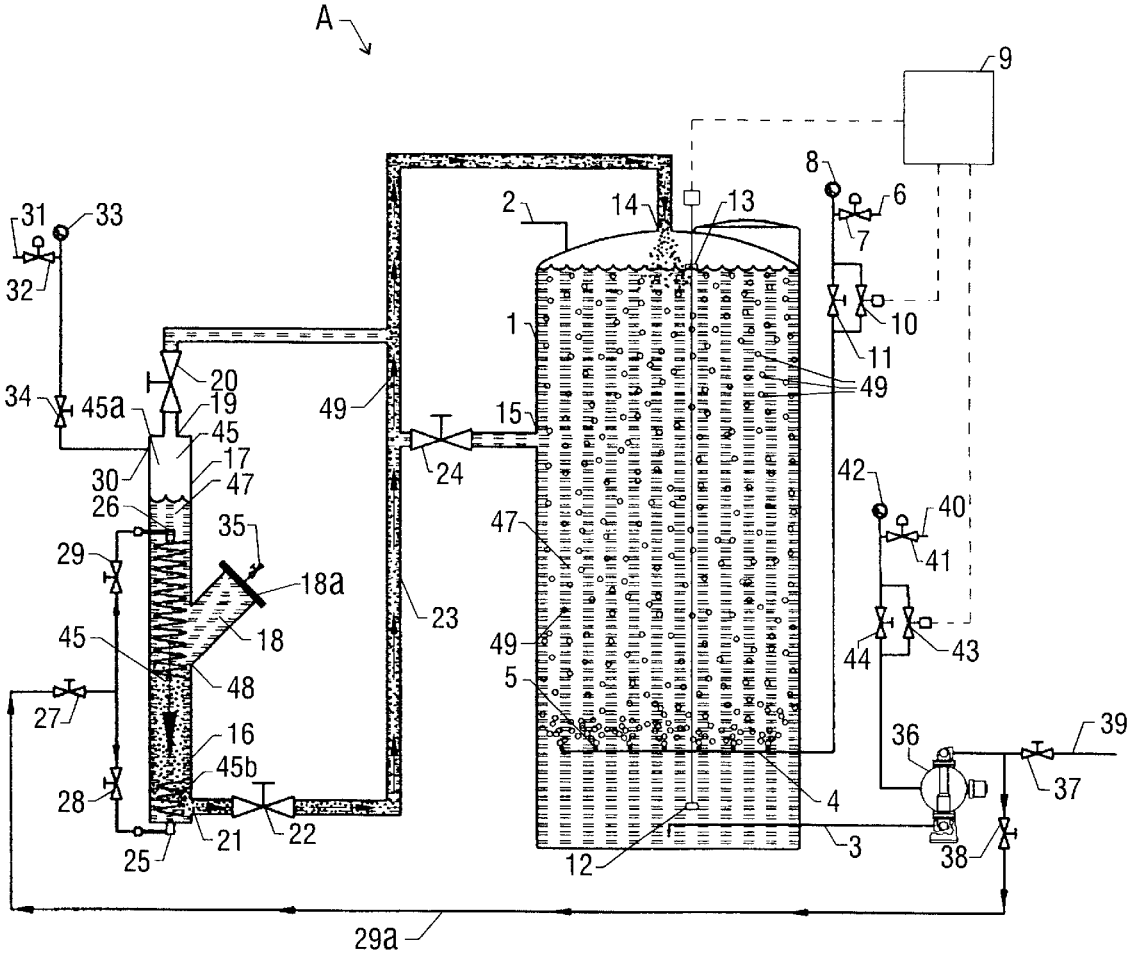

FIGS. 7 and 8 depict the wetted powder feeding function. Referring to FIG. 7, to reverse the direction of water flow, manual outlet valve 22 on the bottom of the apparatus 16 is opened and manual outlet valve 20 at the top of the apparatus 16 is closed. The water flowing downward, assisted by gravity, will carry the solid particles of the chemical 48 out of the apparatus 16 through outlet port 21. The water and solid particles will continue to flow up the vertical piping 23, into the top of the treating tank 1 through inlet port 14, and into the rest of the batch of water 47 to be dispersed by the bubbling air 49. Referring now to FIG. 8, air supply valve 34 is opened to increase pressure in the apparatus 16 and increase water velocity to ensure all solid particles of powder are discharged from the apparatus 16. When all the powder is driven out of the apparatus 16, pump 36 is shut down by closing air supply valve 43. When all water is drained from the apparatus 16, air supply valve 34 and outlet valve 22 are closed. After a preset period of time, the controller 9 will automatically close air supply valve 10 to stop air 49 bubbling.

A SECOND EMBODIMENT

Figure 9:
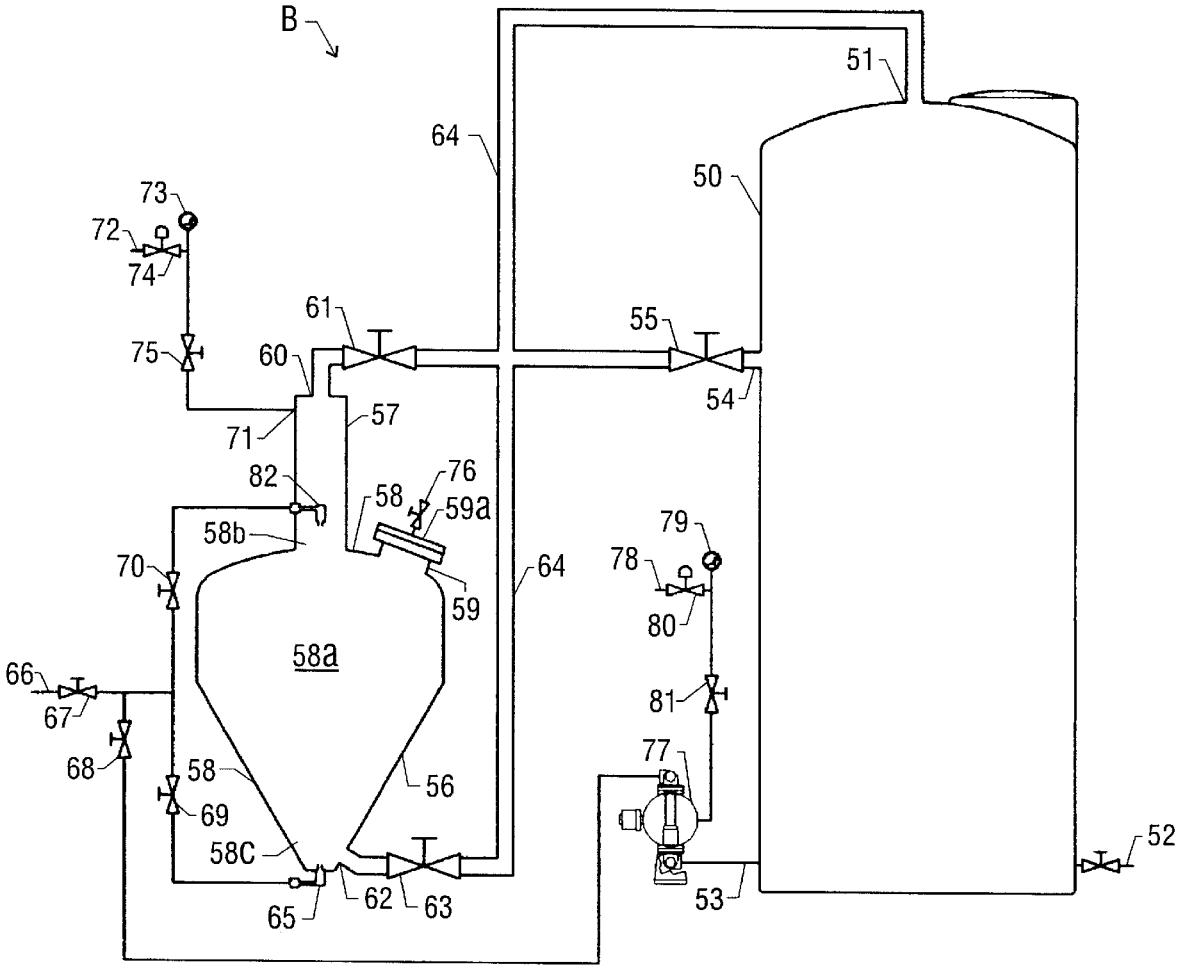
FIGS. 9–13 schematically illustrate an alternative, second embodiment of a manual dry chemical powder feeding system in accordance with the present invention in various stages of one exemplary state of operation of the system for production of brine from solid salt. More particularly.

FIGS. 9–13 illustrate a second embodiment of a system including an apparatus for mixing powders into liquids in accordance with the present invention. This second embodiment is alternative to that in FIGS. 1–8. A system B for mixing a powder into a liquid, e.g., producing brine from salt and water in batches, is shown. FIG. 9 depicts the system B for identification of system components. FIGS. 10–13 depict the system B during various stages of operation.

Apparatus of the Second Embodiment

More particularly, this embodiment of the invention is a manual powder mixing system. An apparatus 56 including a wetting housing 58, or container 58, defning a wetting chamber 58*a* having a top part 58*b*, a bottom part 58*c*, a top port 60 in the wetting chamber 58*a*'s top part 58*b*, and a bottom port 62 in the wetting chamber 58*a*'s bottom part 58*c*; means for preventing powder 83 (shown in FIG. 10) from clumping by fluid force imparted from the wetting chamber 58*a*'s top part 58*b* to keep the powder 83 from accumulating before mixing; and a spray 65 at the wetting chamber 58*a*'s bottom part 58*c* to swirl the liquid 84 (shown in FIG. 11) and mix the powder 83 in the liquid 84. In this particular embodiment, the apparatus 56 functions as both a wetting chamber and a powder feeder. Furthermore, this embodiment includes a tank 50, and a source 66 of the liquid 84.

Referring now to FIG. 9, the system B includes a treating tank 50 sized to hold an amount of saturated brine to be produced in one batch. The batch of brine is typically the amount to be used over a period of time, such as one day, or for one or more specific functions, such as softener regeneration. The water 84 (shown in FIG. 11) used for brine production enters the system B through the apparatus 56. In the apparatus 56, the brine is produced and enters the treating tank 50 through inlet port 51. The brine is transferred out of the treating tank 50 through outlet 52.

The apparatus 56 holds the amount of salt 83 (shown in FIG. 10), in dry powder or granular form, needed for the batch of brine to be produced. Saturated brine typically contains 26.395 pounds (11.973 kg) of salt (NaCl) per U.S. Gallon (3.784 L) of solution. The apparatus 56 comprises a container 58, a vertical column 57 on top of the container 58, and a side access port 59 through which the salt 83 in solid form is placed into container 58. A top port 60 and a manual outlet valve 61 allow the brine solution to leave the apparatus 56 from the top. A bottom port 62 and manual outlet valve 63 allow the brine solution to leave the apparatus 56 from the bottom. The top port 60 and bottom port 62 connect both ends of apparatus 56 to the top of the treating tank 50 through vertical piping 64 outside the apparatus 56 so the dissolved salt can be pumped out of the apparatus 56 in both directions. Another valve 55 and the piping 64 connect the apparatus 56 to the treating tank 50 below the water level to allow water to flow from the tank into the feeder.

Figure 11:
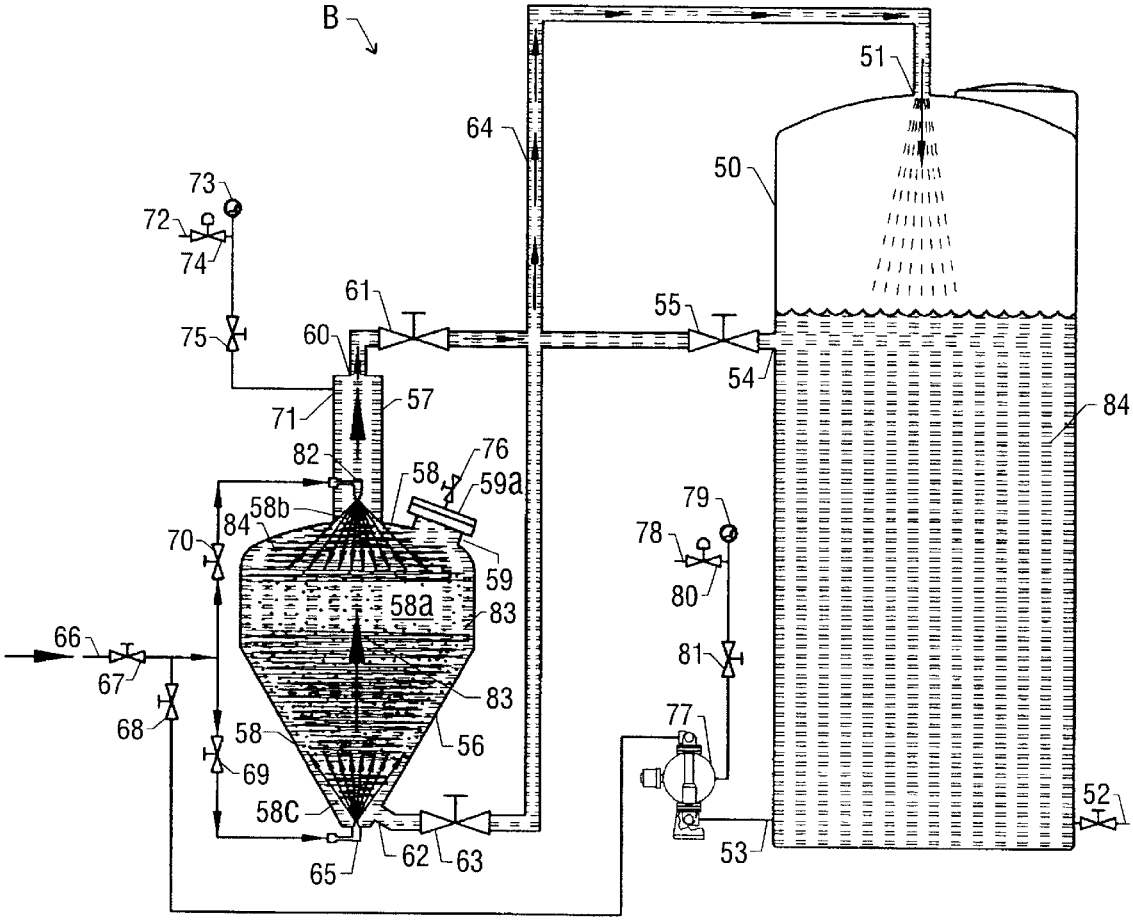

A spray 65, including a spray nozzle in this embodiment, in the bottom part 58*c* of the wetting container 58*a* sprays and swirls the water 84 pumped upward into the container 58 is to lift and stir the solid salt 83 with the incoming water 84 as best shown in FIG. 11. A second spray 82, including a spray nozzle, mounted in the column 57 above the container 58 is directed to spray and swirl the incoming water 84 downward and in the opposite direction to brake up any cluster of dry salt 83 as it is lifted by the water 84 flowing upward from below the salt 83. Thus, the second spray 82 form a means for preventing powder from clumping by fluid force imparted from the wetting chamber 58*a*'s top part 58*b* in this embodiment. Fresh makeup water, from a municipal water supply in this particular embodiment, enters the system through the inlet line 66. The valves 67 and 68 are used to select either fresh makeup water to fill the system or the water 84 from the treating tank 50 to re-circulate through the system B.

The valves 69 and 70 direct the fluid flow to the bottom and top sprays 65 and 82, respectively. The water 84 can be directed to flow upward out of the apparatus 56 by opening the outlet valve 61 at the top of the column 57 and closing the outlet valve 63 at the bottom of the container 58. Conversely, the water 84 can also be directed to flow downward out of the apparatus 56 by opening the outlet valve 63 at the bottom of container 58 and closing the outlet valve 61 at the top of column 57. The flow of the water 84 is directed upward for dissolving the salt 83 and downward for draining the apparatus 56.

Air is injected into the top part 58*b* of the wetting chamber 58*a* through air inlet port 71 when the water 84 is flowing downward to accelerate the water flow through the vertical piping 64 outside the apparatus 56. Air enters through air supply inlet 72. The regulator 74 adjusts incoming air pressure. The pressure gage 73 indicates the regulated air pressure. The manual valve 75 shuts off the air supplied. An air pressure relief valve 76 on the cover of side access port 59*a* releases pressure before removing the cover.

A pump 77 provides the water 84 at the flow rate and pressure needed to dissolve the salt 83, feed the brine into the top of the treating tank 50, and re-circulate the brine until it becomes saturated. Air is supplied through air inlet 78. The regulator 80 adjusts incoming air pressure. The pressure gage 79 indicates the regulated air pressure. The manual valve 81 turns the pump 77 on and off.

Operation of the Second Embodiment

Figure 10:
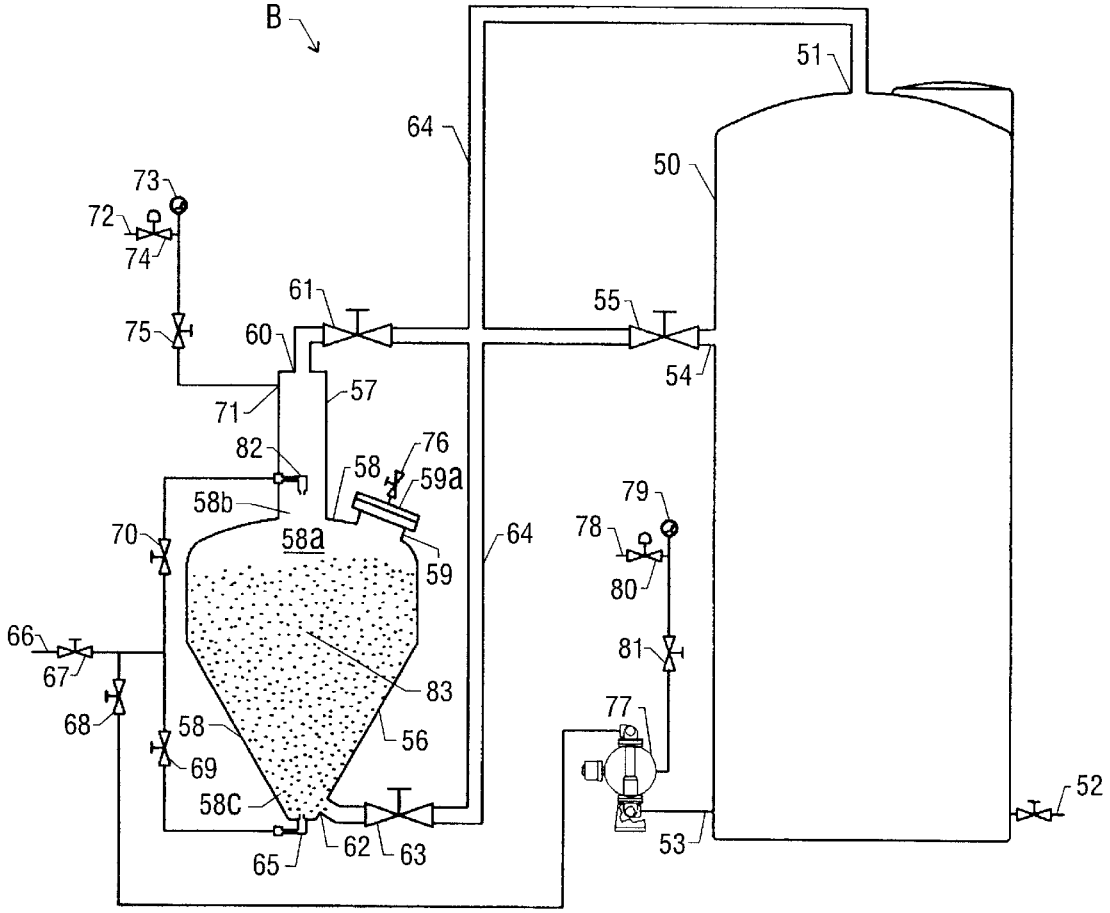

FIG. 10 depicts the system B with the salt 83 in powder or granular form placed in the apparatus 56. The treating tank 50 is shown empty because the makeup water (not shown) from an external supply (also not shown) dissolves some of the salt 83 as it enters the system B. Removal and replacement of the cover 59*a* on the side access port 59 are similar to that discussed for FIG. 3 and consequently are not repeated here. The amount of salt powder 83 needed for making saturated brine is placed into the apparatus 56 through the side access port 59. With the salt 83 in the apparatus 56, the cover 59*a* is replaced on the side access port 59.

FIG. 11 depicts the system B in the salt dissolving and feeding function of the operating cycle with makeup water provided from an external source (not shown). The spray 65 in the bottom of container 58 directs and swirls the incoming water 84 upward into the container 58 to lift and stir the salt 83 with the incoming water. At the same time, the top spray 82, mounted in the column 57 above the container 58, directs and swirls the incoming water 84 downward and in the opposite direction to break up any cluster of salt 83 as it is lifted by the water 84 flowing upward from nozzle 65. Valves 69 and 70 in the incoming water feed lines can be used to regulate the amount of water directed to the upper or lower sprays 82 and 65, respectively. When sufficient water is added for the amount of brine to be produced, the valve 67 is closed and the valve 68 is opened.

Figure 12:
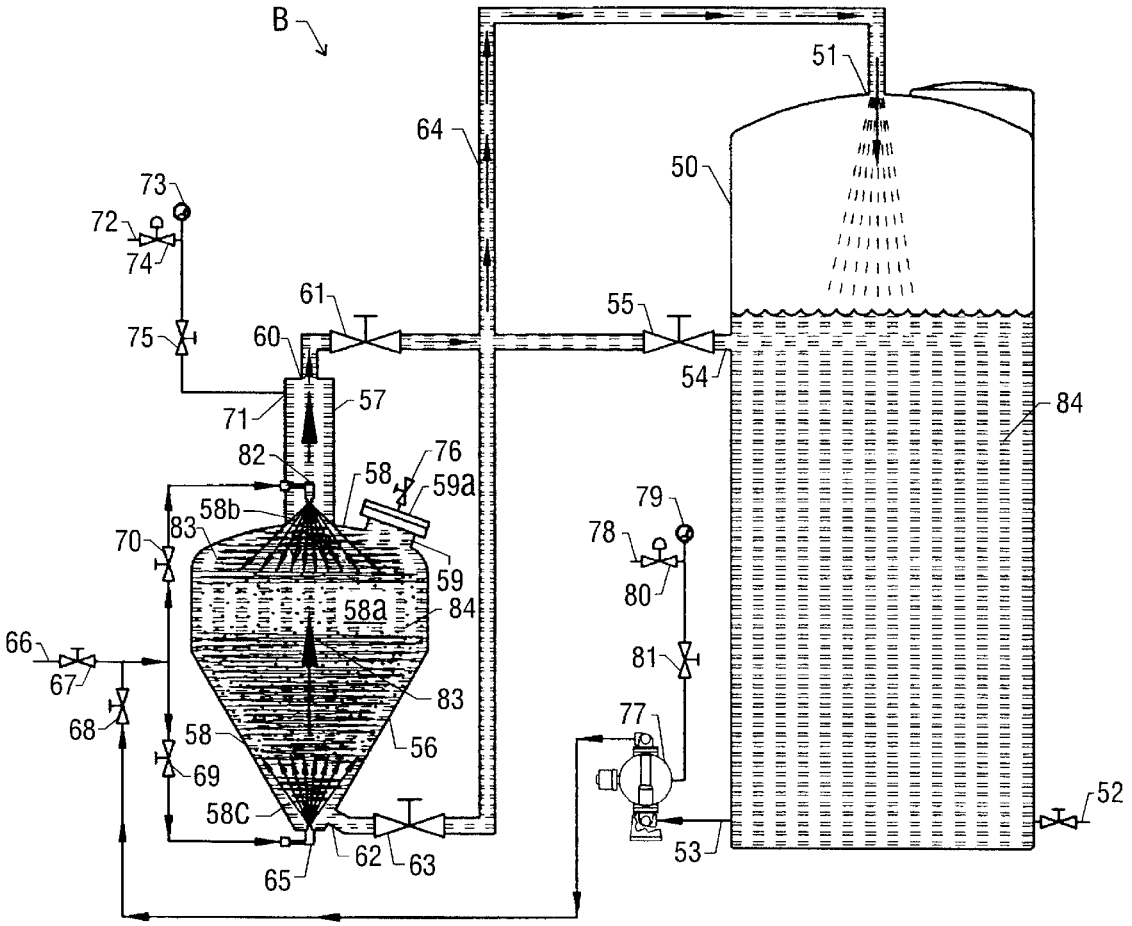

FIG. 12 depicts the system B in the salt dissolving and feeding function of the operating cycle with brine being re-circulated. The pump 77 provides re-circulated brine at the flow rate and pressure needed to dissolve the remaining part of the salt 83 and feed the brine into the top of the treating tank 50. The air to operate the pump 77 is supplied through the air inlet 78. The regulator 80 adjusts the incoming air pressure. The pressure gage 79 indicates the regulated air pressure. The pump 77 re-circulates the brine solution from the treating tank 50 through the apparatus 56, through the outlet port 60, through the piping 64, through the inlet port 51, and into the top of the treating tank 50 until it becomes saturated. The pump 77 is then shutdown by closing the air supply valve 81.

Figure 13:
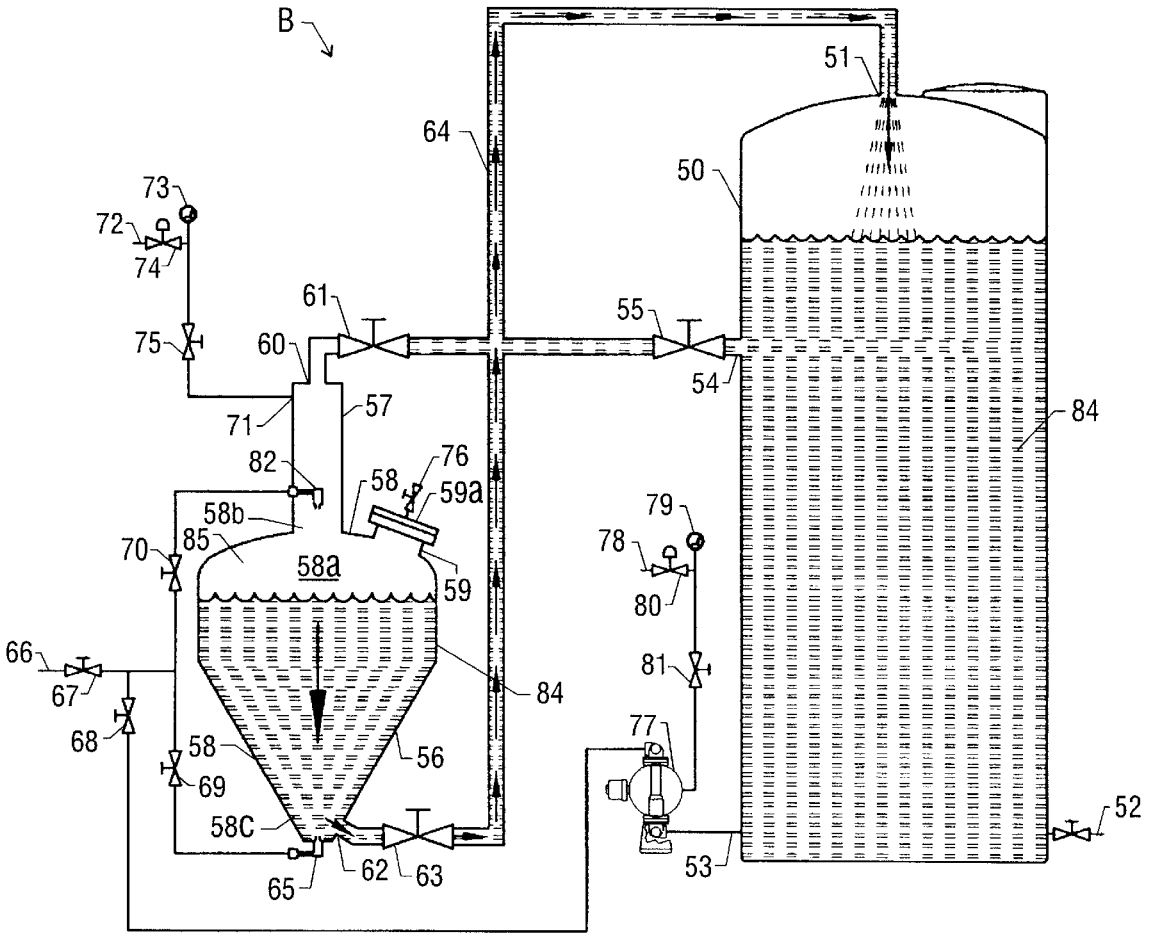

FIG. 13 depicts the system B as the saturated brine is drained from the apparatus 56 and transferred to the treating tank 50. To accomplish this transfer, the manual outlet valve 61 at the top of the column 57 is closed, manual outlet valve 63 at the bottom of the container 58 is opened, and the air inlet valve 75 is opened. Air 85 entering the apparatus 56 displaces the water 84 in the apparatus 56 and forces it to flow out through the outlet port 62, up through the piping 64 and into the top of the treating tank 50 through the inlet port 51. The air pressure is kept low enough so the velocity of the brine leaving the apparatus 56 remains low and does not carry any undissolved salt 83 to the treating tank 50. When the brine is drained from the apparatus 56, the air supply valve 75 and the manual outlet valve 63 are closed. The saturated brine 84 is then ready for its intended use.

A THIRD EMBODIMENT

Figure 14:
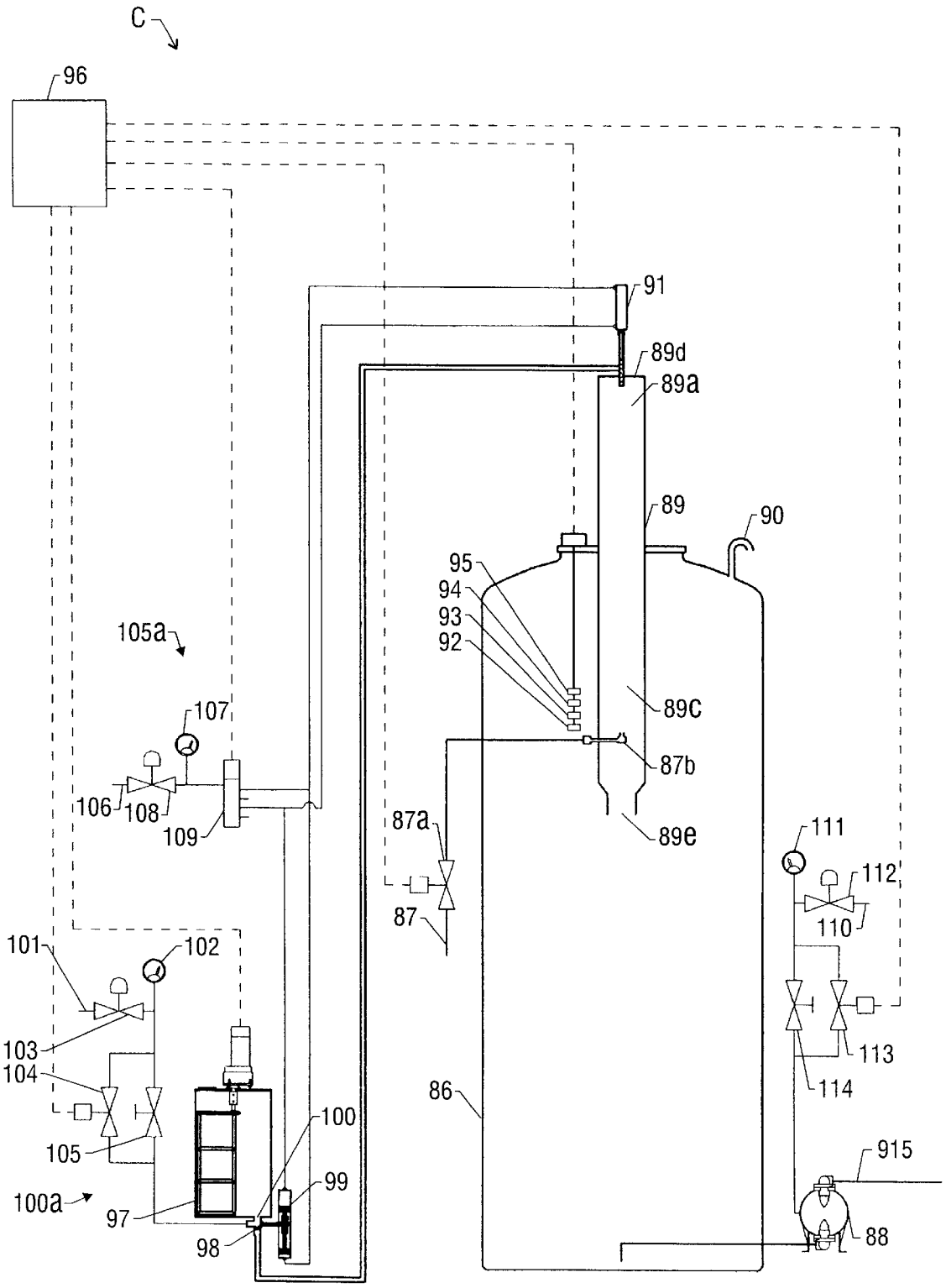
FIGS. 14–21 schematically depict an alternative, third embodiment of an automatic powder feeding system in accordance with the present invention in various stages of one exemplary method of operation of a system for treating a continuous flowing stream of fluid. More particularly.
Figure 15:
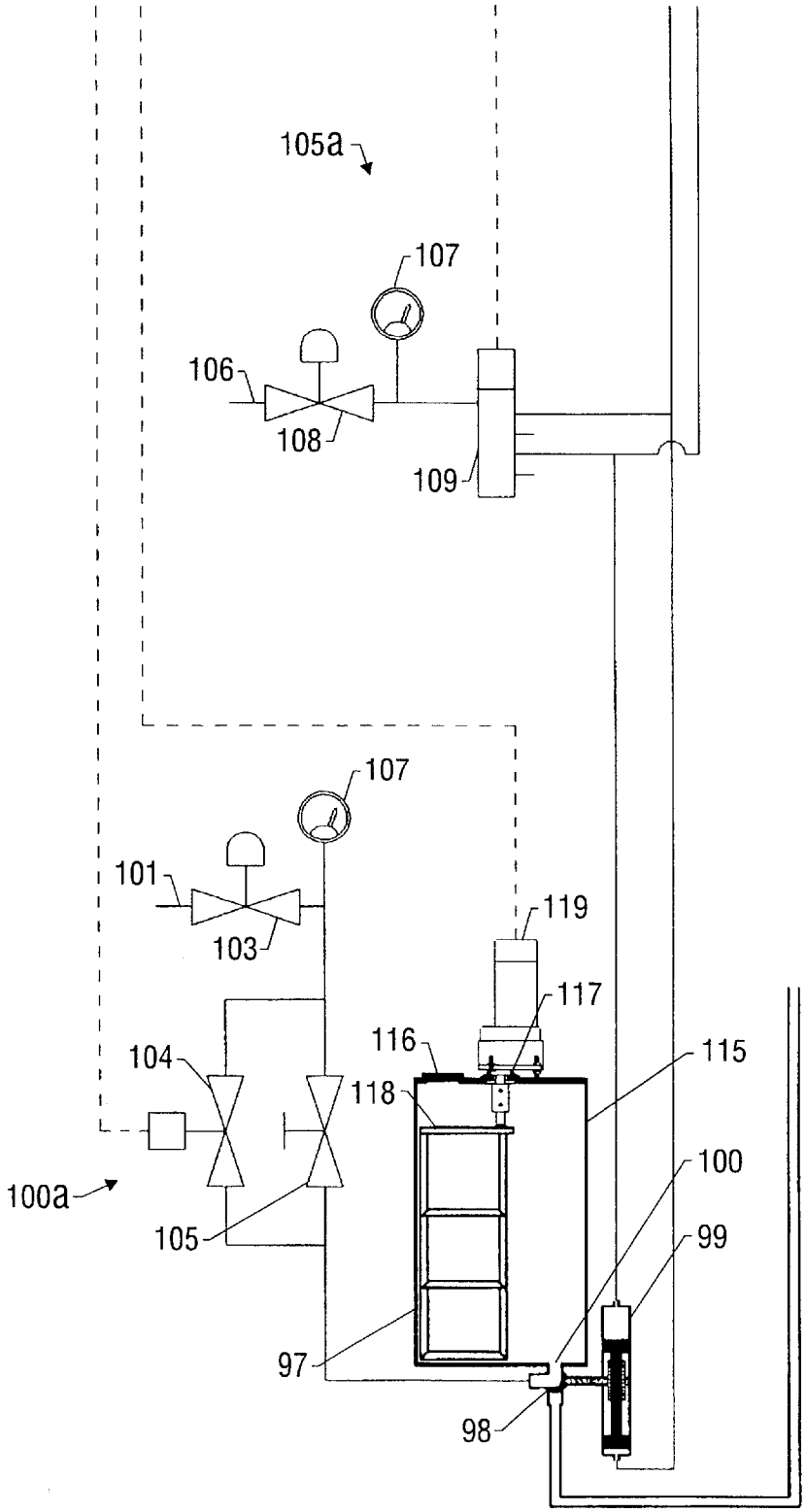

FIGS. 14–21 illustrate a third embodiment of an apparatus for mixing a powder into a liquid in accordance with the present invention alternative to those in FIGS. 1–13. A system C for mixing a powder into a liquid, e.g., feeding a powdered chemical into a continuous flowing stream of fluid, is shown. FIGS. 14 and 15 depict the system C for identification of system components. FIGS. 16–21 depict the system C during various stages of operation.

Apparatus of the Third Embodiment

More particularly, the system C is an automatic powder feeding system. An apparatus 89 including a wetting housing, or container, defining a wetting chamber 89*a* having a top part 89*b*, a bottom part 89*c*, a top port 89*d* in the wetting chamber 89*a*'s top part 89*b*, and a bottom port 89*e* in the wetting chamber 89*a*'s bottom part 89*c*; means 91 for preventing powder 115*a* (shown in FIG. 16) from clumping by fluid force imparted from the wetting chamber 89*a*'s top part 89*b* to is keep the powder 115*a* from accumulating before mixing; and a spray 87*b* at the wetting chamber 89*a*'s bottom part 89*c* to swirl the liquid 84 (shown in FIG. 16) and mix the powder 115*a* in the liquid 84. In this particular embodiment, the apparatus 89 comprises a part of the tank 86 and is fed by a separate powder feeder 97, thereby separating the wetting and feeding functions.

Furthermore, this embodiment includes a tank 86, and a source 89 of the liquid 86*a*.

Referring to FIG. 14, automatic powder feeding system C generally comprises of a treating tank 86, an automatic powder feeder 97, a wetting chamber 89*a*, and a controller 96. The treating tank 86 is selected with sufficient capacity to feed chemical powders 115*a* (shown in FIG. 16), dissolve or wet the powder 115*a*, mix the powder 115*a* into the water 86*a* (shown in FIG. 16), and provide enough retention time for the chemical powders 115*a* to react with the contaminants dispersed in the dirty water 86*a*. Sludge (not shown) results from the reaction of the powders 115*a* with the contaminants. The sludge generally settles in the water 86*a* and is pumped out of the tank 86 with the water 86*a* following the reaction.

The sensors 92, 93, 94 and 95 in the treating tank 86 detect the water 86*a* at four levels to balance the flow of the dirty water 86*a* coming into the treating tank 86 with the flow of water 86*a* leaving the treating tank 86. The upper, or fourth, level sensor 95 provides a signal to the controller 96 to close the inlet valve 87*a* and prevent the treating tank 86 from overflowing. The third level sensor 94 provides a signal to the controller 96 to reopen the inlet valve 87*a*. The controller 96 cycles the inlet valve 87*a* to turn the incoming source 87 of the water 86*a* on and off as water level changes between the third and fourth level sensors 94 and 95. The lowest, or first, level sensor 92 provides a signal to the controller 96 to shut down the pump 88 to prevent it from removing water from the treating tank 86 when the source 87 of water 86*a* is insufficient to keep the pump running. The second level sensor 93 provides the signal to the controller 96 to restart pump 88 when the water level has recovered. The controller 96 will cycle the pump 88 off and on as water level changes between the first and second level sensors 92 and 93 respectively.

The automatic powder feeder 97 meters the amount of the chemical powder 115*a* to be fed and injects the metered powder 115*a* into the wetting chamber 89*a* in the top of the treating tank 86. Referring to FIG. 15, the automatic powder feeder 97 comprises a storage chamber 115, a modified three-way ball valve 98, a valve actuator 99, an air supply 105*a* to operate the actuator, and a separate air supply 100*a* to blow the powder out of valve 98. A rotating paddle 118 inside the storage chamber 115 keeps the chemical powder from packing. The electric motor 119 that operates the paddle 118 is mounted on top the chamber 115. A seal 117 between the motor 119 and the storage chamber 115 keeps moisture out of the storage chamber 115.

The three-way ball valve 98 is mounted under the storage chamber 115 and aligned with a port 100 so the chemical powder 1151*a* can be fed from the storage chamber 115 into the ball of three-way valve ball 98. The size of the three-way ball valve 98 determines the amount of chemical powder 115*a* in each batch that can be fed at one time. The time interval between the feeding of each batch is adjustable on the controller 96. For example, a one-inch three-way ball valve holding three-quarters of a cubic inch of chemical powder and operated every 15 to 45 seconds is typically sufficient to treat a stream of water flowing at 5 to 20 gallon-per-minute.

Therefore, the size of the ball valve 98 and the interval of time between the feeding of each batch of chemical powder are selected on the bases of the quantity of contaminants in the water and the amount of water continuously flowing in the stream to be treated. Feeders can be made to treat any size stream. The actuator 99 is an air cylinder with a rack and pinion drive that rotates the ball in the three-way ball valve 98 to the fill and discharge positions.

Again referring to FIG. 14, the wetting chamber 89*a* in the top of treating tank 86 receives the chemical powder 115*a* and air discharged from valve 98. The wetting chamber 89*a* comprises a apparatus 89, a plunger 91 mounted on top the wetting chamber 89*a*, and a nozzle 87*b*, including a spray nozzle, mounted inside the apparatus 89 below the water level. The apparatus 89 extends out the top of the treating tank 86 and below the surface of the water inside the treating tank 86.

The transfer pump 88 sucks treated water 86*a* and sludge out of the treating tank 87 and transfers them via line 95 to another function (not shown) in the total treating process, such as a clarifier (not shown), to separate the sludge from the water 86*a*. The pump 88 illustrated is an air-operated diaphragm pump selected, in this particular embodiment, because of it ability to pump without shearing the sludge. Air to operate the transfer pump 88 is supplied through the air inlet 110. The regulator 112 adjusts incoming air pressure. The pressure gage 111 indicates the regulated air pressure. The controller 96 opens solenoid valve 113 to operate pump 88. A manual valve 114 can be used to bypass solenoid valve 113. Other non-shearing pumps can be used in place of the air operated diaphragm pump.

Operation of the Third Embodiment

Figure 16:
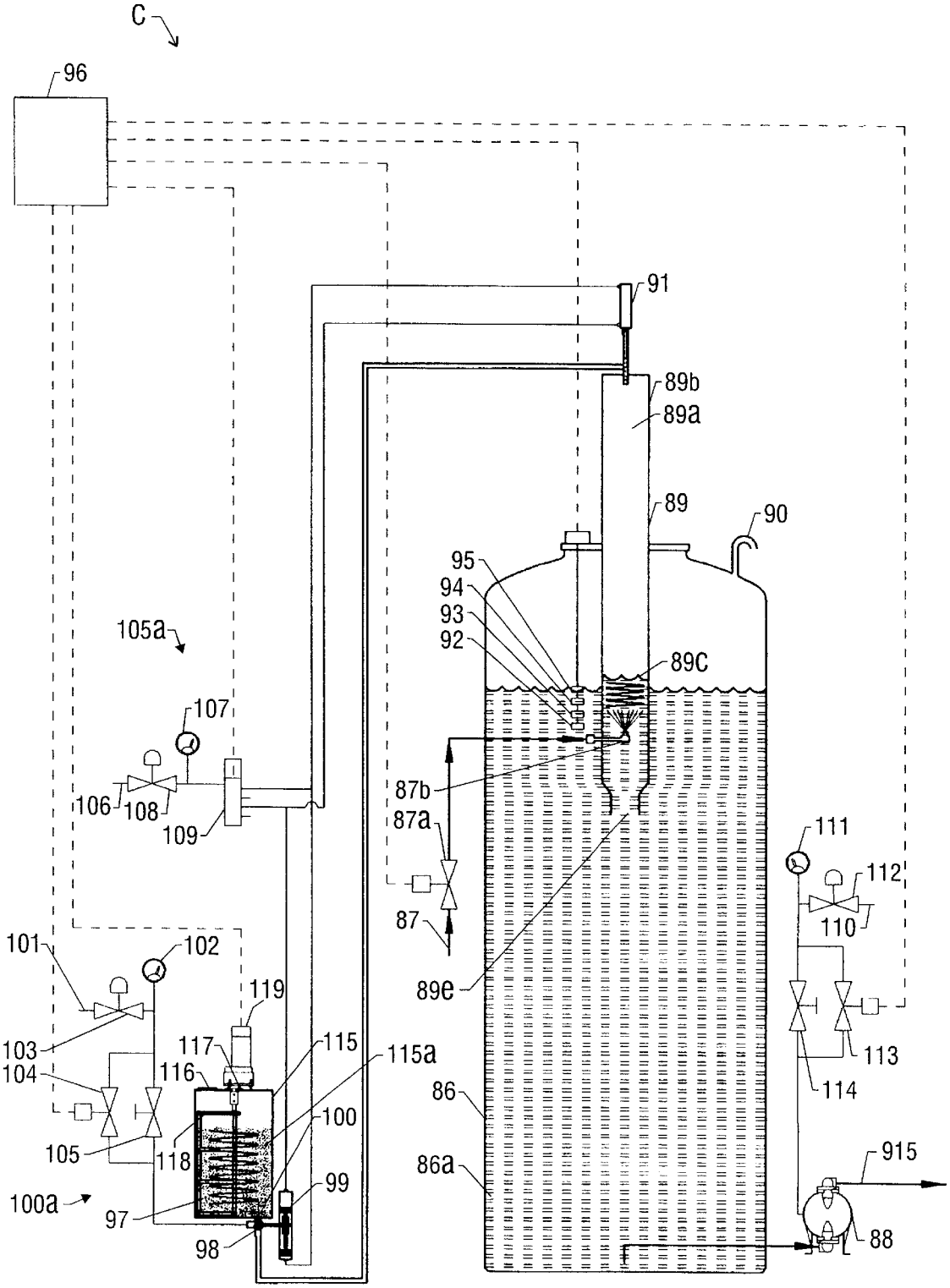

FIG. 16 depicts the system C while the water 86*a* is being treated with the automatic feeder three-way valve 98 in the filling position. Treating tank 86 is shown filled with water 86*a* to a level below sensor 95. Generally, the water 86*a* is pumped from a source of contaminated water (not shown) to the treating tank 86 at the flow rate to be treated. The automatic feeder 97 meters and injects the chemical powder 115*a* continuously as the water 86*a* flows into the treating tank 86. At the same time, the water 86*a* is pumped out of the treating tank 86 to a subsequent treating function (not shown), such as a clarifier, where sludge is separated from the water 86*a*.

Once the treating operation starts, the controller 96 uses signals from the level sensors 92–95 in the treating tank 86 to control the flow of the incoming and outgoing water 86*a*. More specifically, the water 86*a* at a flow rate to be treated enters though the inlet line 87 when the inlet valve 87*a* is opened. The inlet valve 87*a* is operated by controller 96 based on signals received from level sensors 94 and 95. Water flows through the spray 87*b* and is sprayed in a swirling motion upward in the wetting chamber 89. The water and sludge are transferred out of the treating tank 86 by the pump 88. Air to operate the pump 88 is supplied when the solenoid valve 113 is opened by the controller 96 based on signals received from the sensors 92 and 93. Incoming dirty water 86*a* to the treating tank 86 is set at a slightly higher flow rate than the outgoing water 86*a* transferred by the pump 88.

The controller 96 closes the inlet valve 87*a* when the water level reaches the set point of the high level sensor 95. The controller 96 also shuts down the automatic powder feeder 97 when the inlet valve 87*a* is closed. The controller 96 opens the inlet valve 87*a* when the water level drops to the set point of the third level sensor 94. The controller 96 also restarts the automatic powder feeder 97 when the inlet valve 87*a* is opened. The inlet valve 87*a* and the automatic powder feeder 97 will continue to cycle off and on as the water 86*a* level in the treating tank 86 rises and drops between the set points of the level sensors 95 and 94, respectively. The controller 96 shuts down the pump 88 if the water level drops to the set point of the low level sensor 92. The controller 96 restarts the pump 88 when the water level rises to the set point of the second level sensor 93. Typically, in normal operation, the outgoing water transfer pump 88 will stay on all the time and the pump 88 will cycle on and off only when the flow of the incoming water 86*a* is less than the flow of water 86*a* being transferred out of the treating tank 86 by the pump 88.

The automatic powder feeder 97 continues to inject batches of chemical powder to match the incoming water flow rate and concentration of contaminants dispersed in it. The chemical powder 115*a* to be fed is placed into the storage chamber 115 through fill port 116. The electric motor 119 is turned on and operated by the controller 96. Motor 119 rotates paddle 118 inside the storage chamber 115 to keep the chemical powder 115*a* from packing. Controller 96 opens the air solenoid valves 109 and 104 in sequence to rotate ball valve 98 from the fill position to the discharge position and flow of air to drive the powder out of the ball valve. The controller 96 then closes the air solenoid valves 109 and 104 in reverse sequence to return ball valve 98 to the fill position after the batch of chemical powder is injected into the incoming contaminated water.

Figure 17:
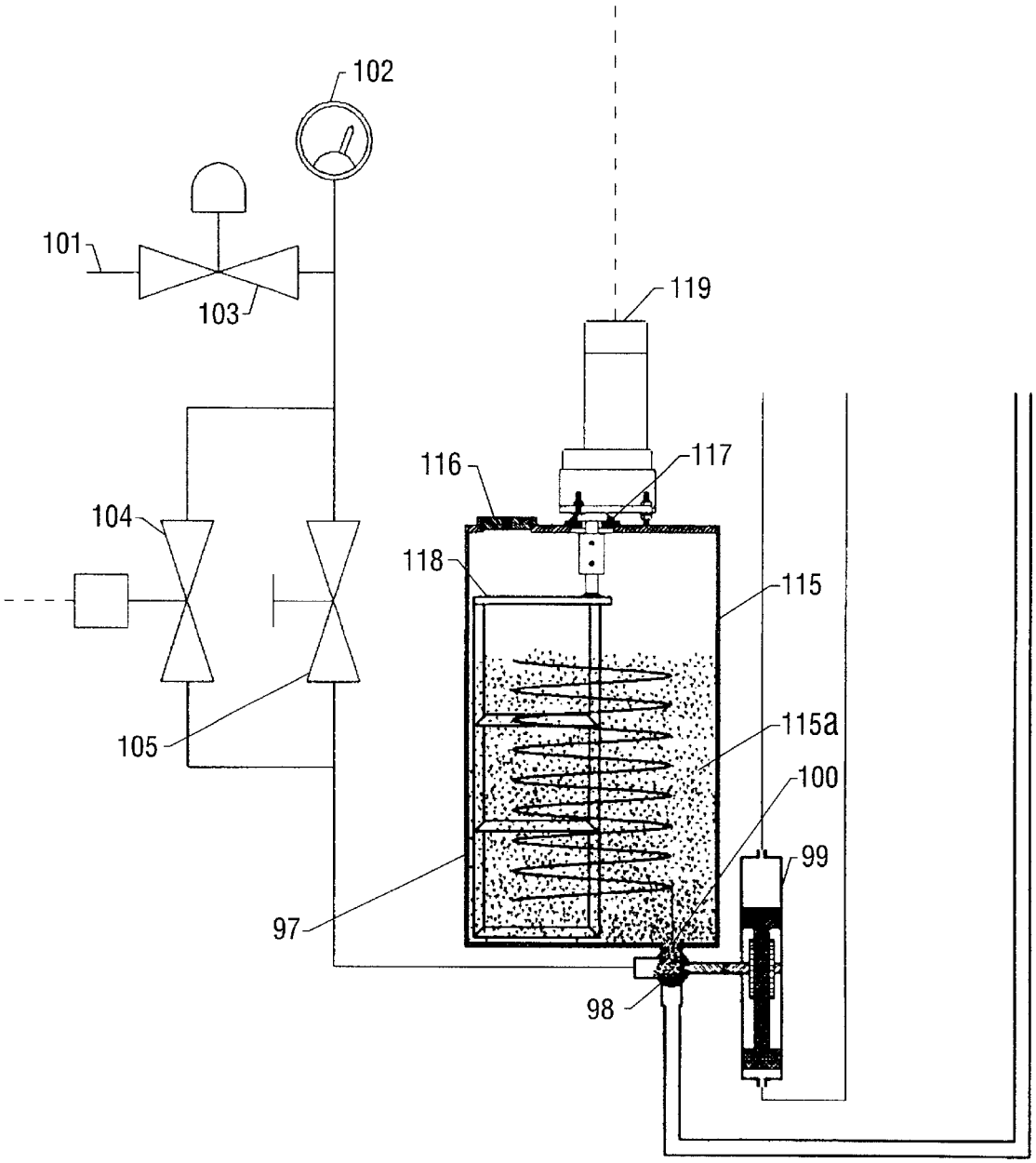

FIG. 17 depicts an enlarged view of the automatic powder feeder 97 in the fill position. With the three-way ball valve 98 in the fill position, the loose chemical powder 115*a* falls through port 100 into the cavity of the ball valve 98 turned upward. The controller 96 accounts for the time the ball valve 98 remains in the fill position. The time is adjustable in the controller 96, and the set time is based on a previous laboratory analysis of the contaminated water. After a set period of time, the controller 96 opens the solenoid valve 109. Air supplied though the solenoid valve 109 to the actuator 99 cylinder rotates the ball valve 98 to the powder discharge position.

Figure 18:
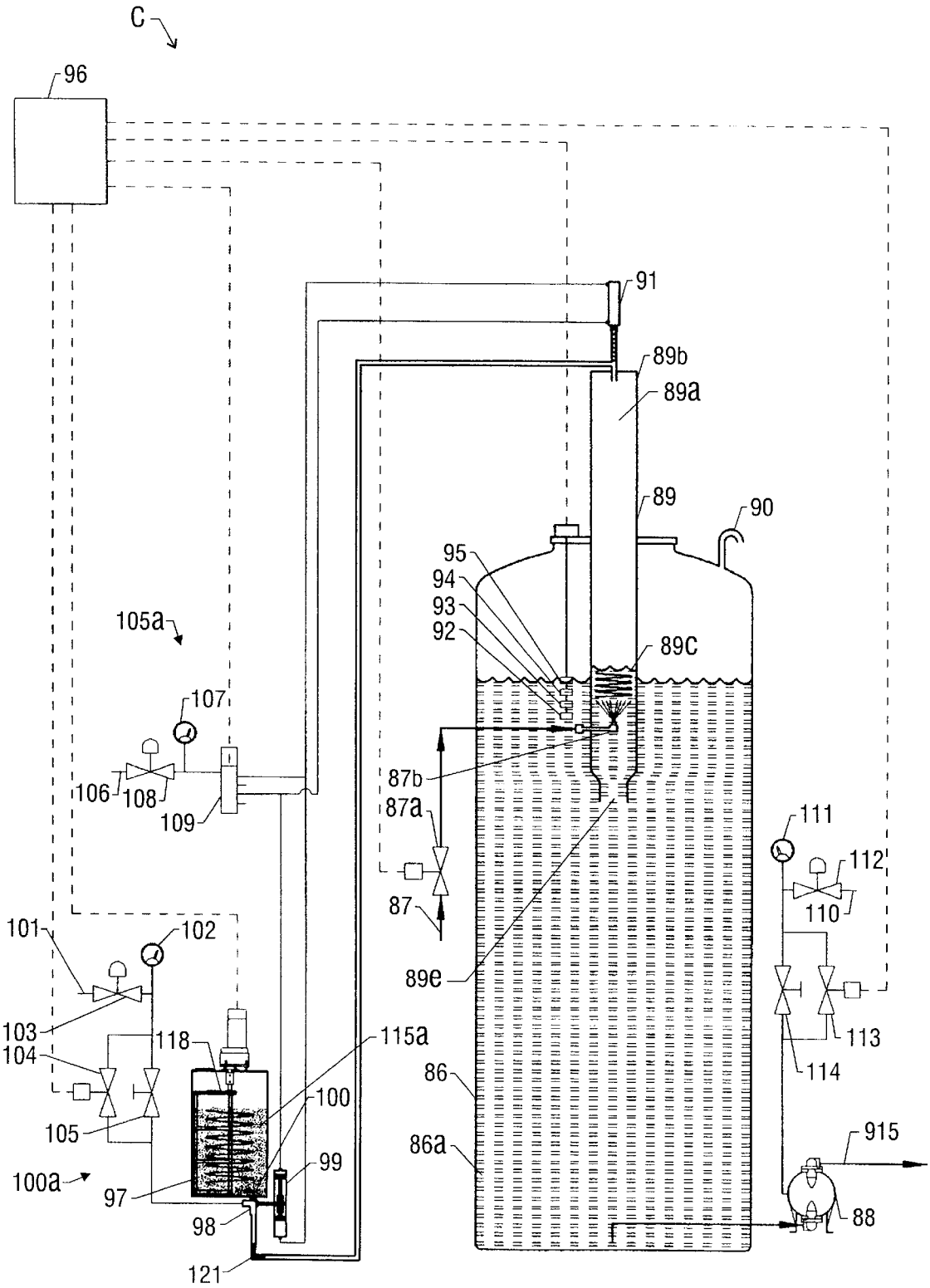

FIG. 18 depicts the system C while the water 86*a* is being treated with the automatic powder feeder 97 three-way ball valve 98 in the chemical powder discharge position. Air supplied through the solenoid valve 109 also retracts the plunger 91 to open the chemical powder inlet port 91*a* at the top of wetting chamber 89*a*. Note that the chemical powder inlet port 91*a* and the top port 89*b* are coincident at the point where they intersect the wetting chamber 89*a* in this embodiment. After an adjustable, preset time period to allow ball valve 98 rotation to the discharge position, the controller 96 opens solenoid valve 104.

Figure 19:
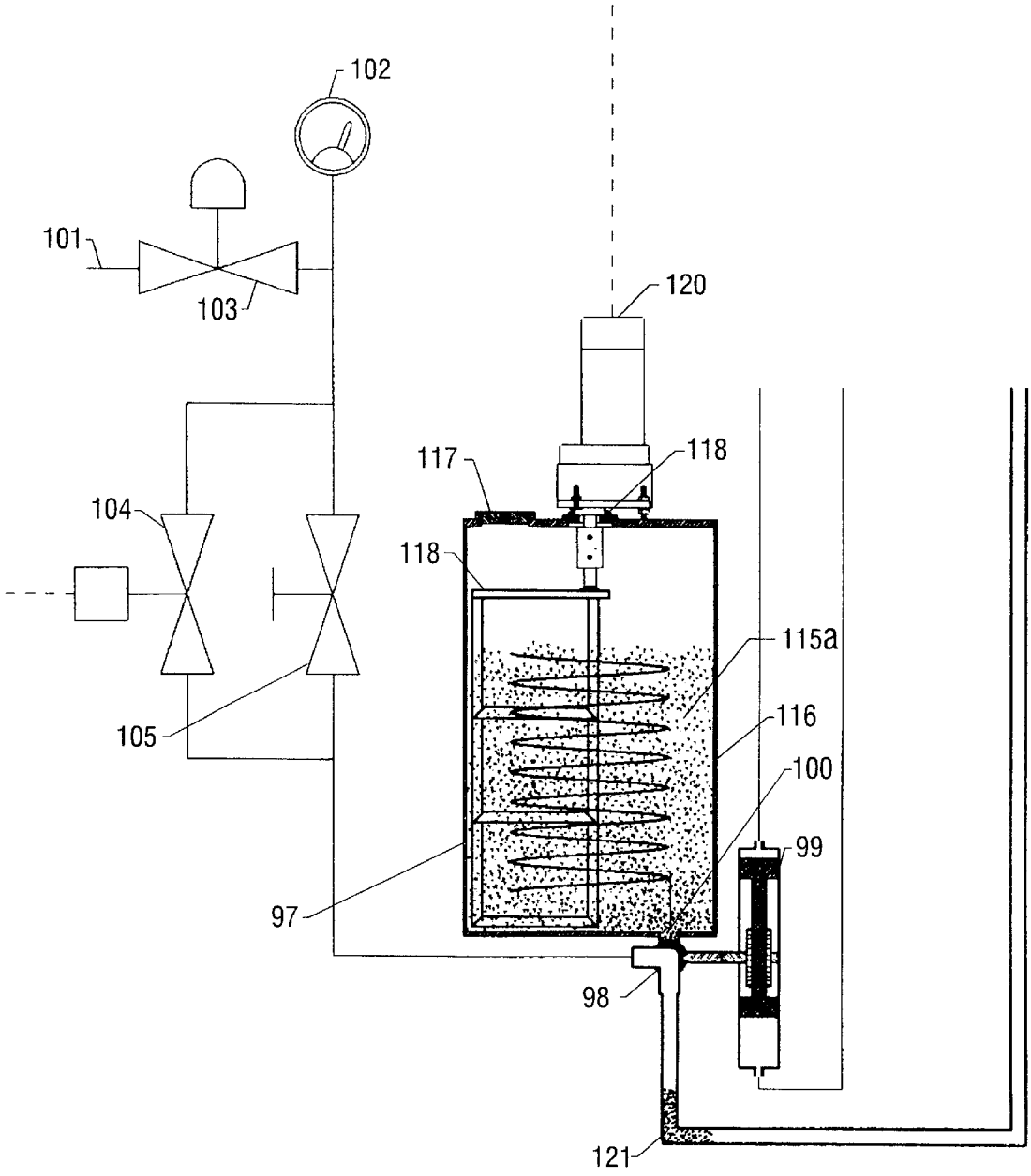

FIG. 19 is an enlarged view of the automatic powder feeder 97 in the discharge position. Air supplied through the solenoid valve 104 blows the batch 121 of chemical powder 115*a* out of ball valve 98 and transports it to the top of wetting chamber 89.

Figure 20:
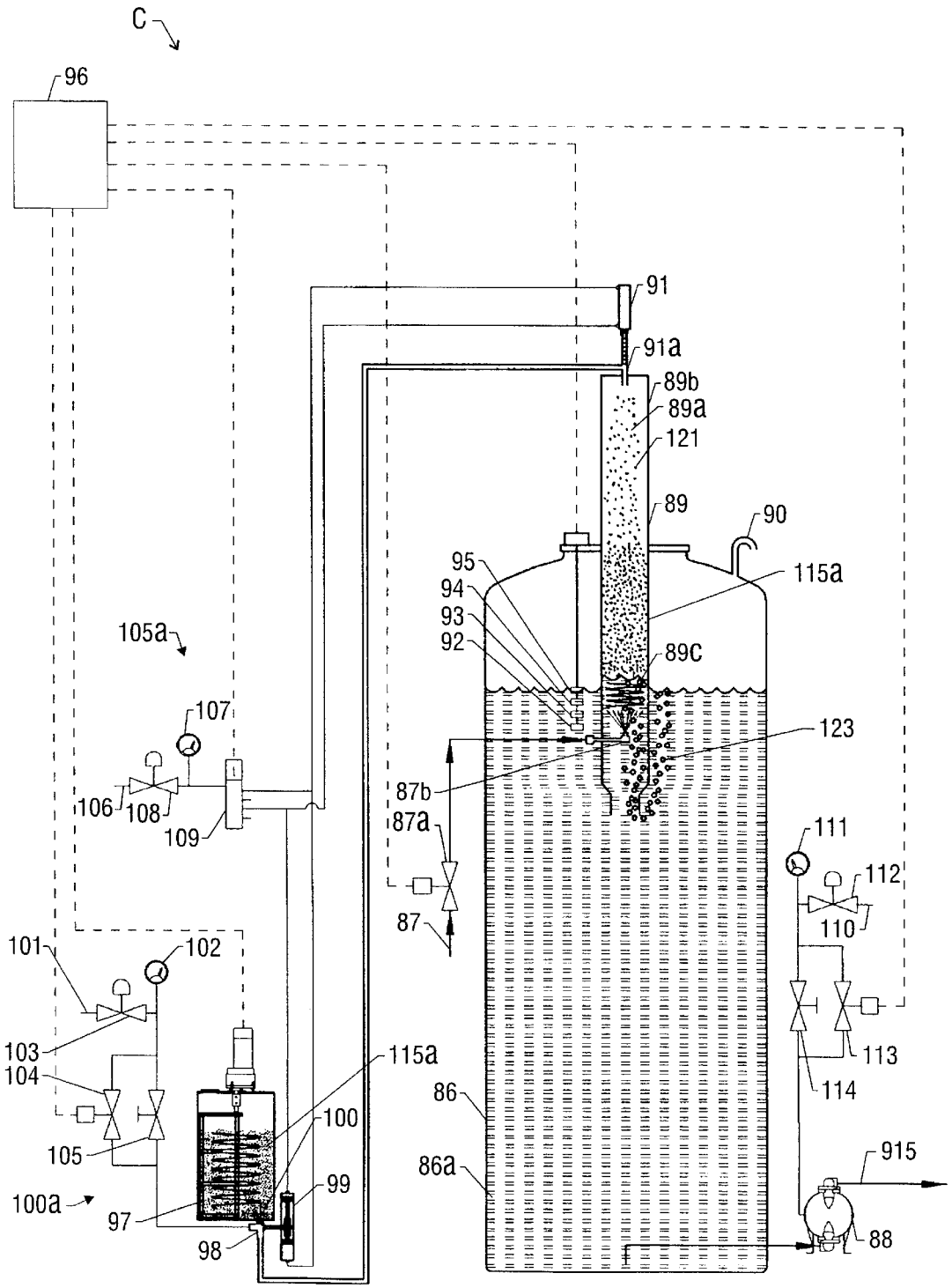

FIG. 20 depicts automatic powder feeding system C while the batch 121 of chemical powder 115*a* is being injected into the wetting chamber 89*a*.

Figure 21:
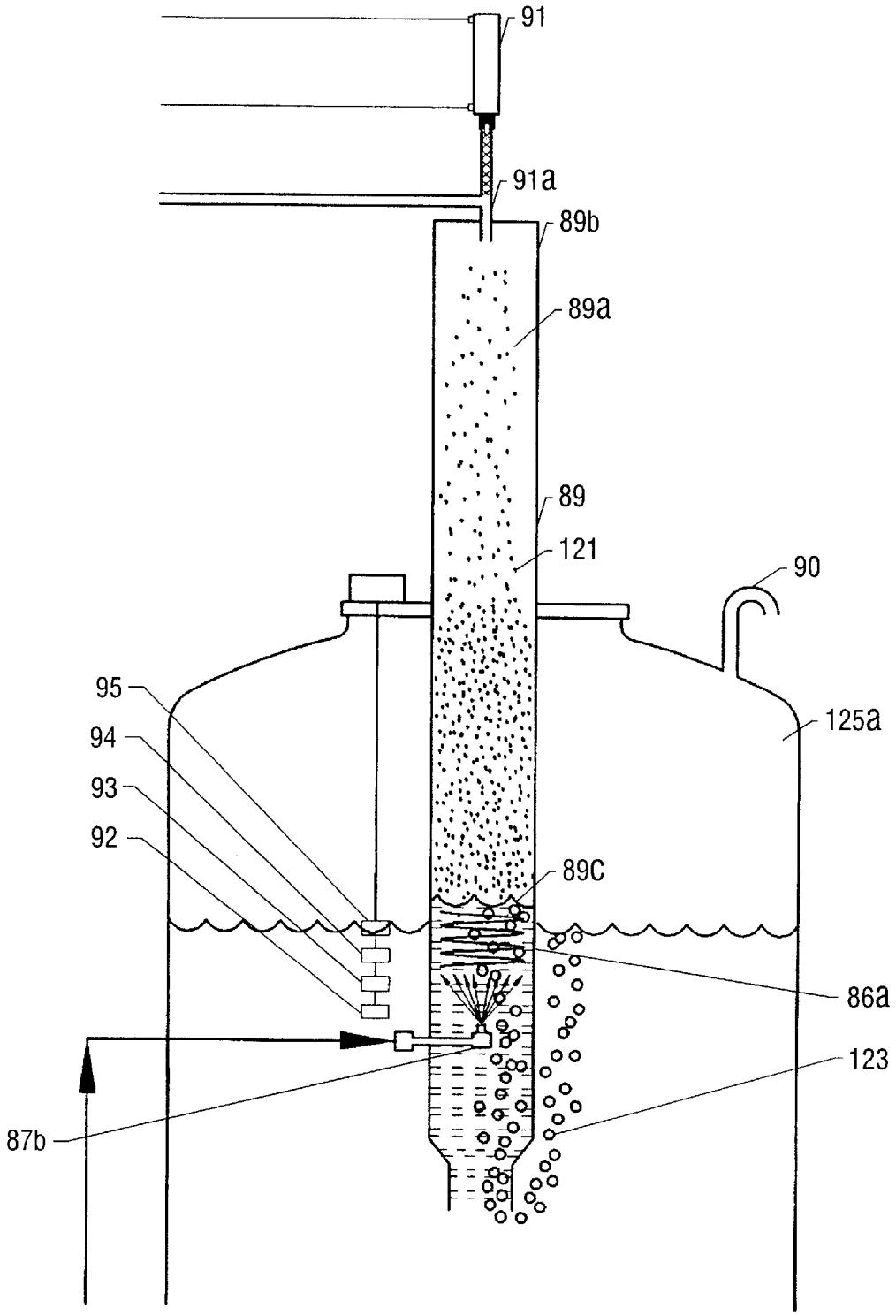

FIG. 21 is an enlarged view of the wetting chamber 89*a* in operation. The wetting chamber 89*a* is a vertical column in this particular embodiment. The contaminated water 86*a* is introduced into the bottom part of the apparatus 89 in a rotating motion through the spray 87*b*, that is directed upward. The batch 121 of chemical powder 115*a* and the air are injected into the wetting chamber 89*a* at the top part of the apparatus 89. The batch 121 of chemical powder 115*a* falls by gravity into the dirty water 86*a* at the bottom part of the apparatus 89. The swirling water 86*a* either wets or dissolves the batch 121 of chemical powder 115*a* and mixes it with the contaminants in the dirty water 86*a*. The injected air increases the pressure inside apparatus 89 and pushes the dirty water 86*a* down the apparatus 89 until it can escape as bubbles 123 out the open lower end 123*a* of the wetting chamber 89*a* below the surface of the water 86*a* in treating tank 86.

A large ullage 125*a* above the water 86*a* inside the treating tank 86 minimizes the pulsating effect of the air on the pressure inside the tank 86 and the sloshing of the water 86*a*. The large ullage 125*a* also reduces the air velocity as it is released from the treating tank 86 through a vent 90. The air operated plunger 91 on top the apparatus 89 keeps the batch 121 of chemical powder 115*a* from accumulating in the top port 91 a to the wetting chamber 89*a* to prevent it from becoming wet by condensation that can occur during certain periods when the system C is turned off.

Again referring to FIG. 20, the amount of time required to discharge the batch 121 of chemical powder 115*a* from the three-way ball valve 98 and inject it into the wetting chamber 89*a* is typically only a few seconds. Following the injection of the batch 122 into the wetting chamber 89*a*, the controller 96 closes air solenoid valve 104. The controller 96 then closes solenoid valve 109 to rotate the ball valve 98 back to the filling position, and the plunger 91 is extended to close the top port 91*a* at the top of wetting chamber 89. At the preset interval of time, the controller 96 repeats the chemical powder feeding cycle. The chemical feeding continues until the water treating function is completed.

A FOURTH EMBODIMENT

Figure 22:
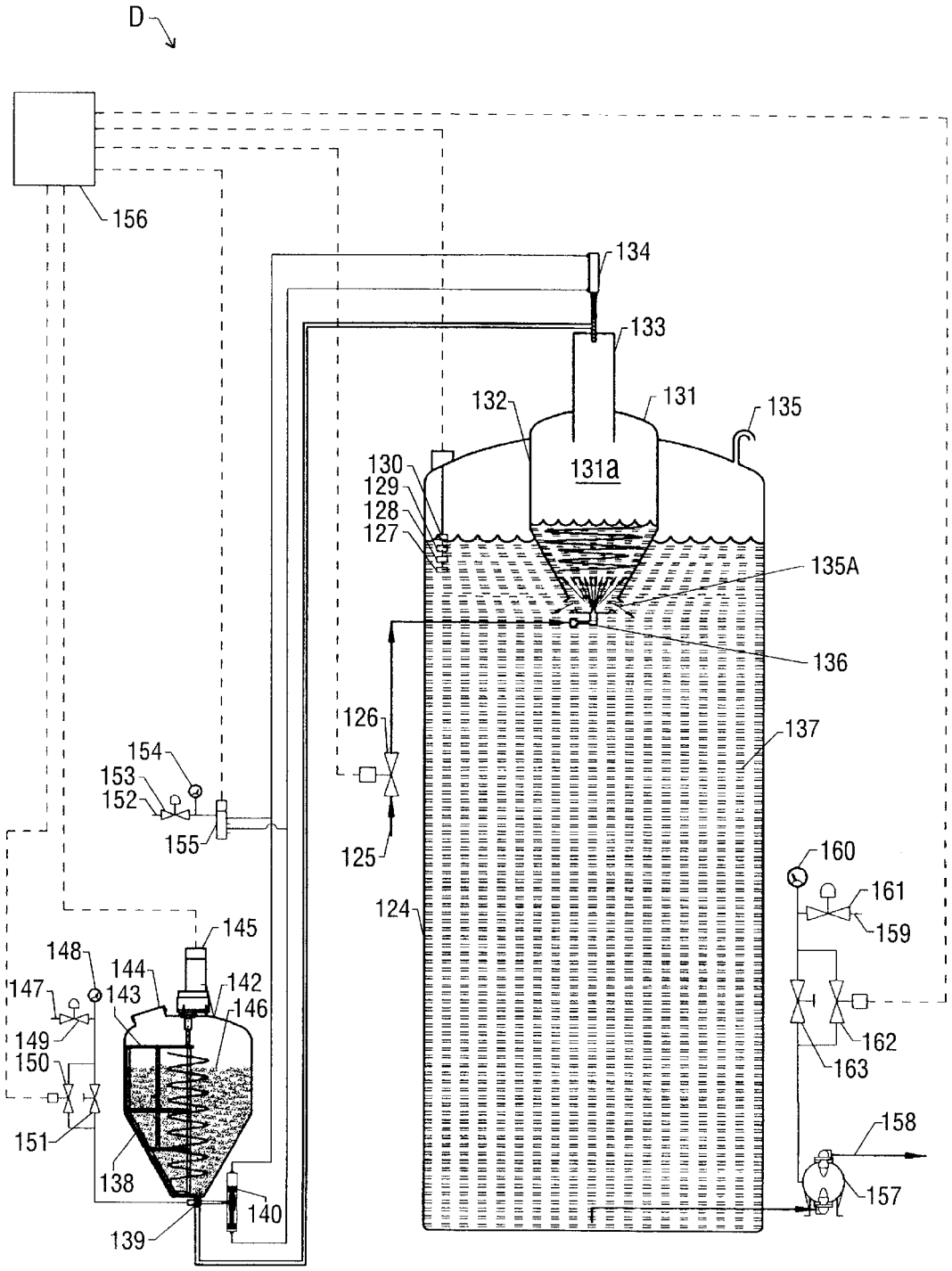
FIG. 22 schematically illustrates an alternative, fourth embodiment of an automatic powder feeding system in accordance with the present invention with a large automatic powder feeder and wetting chamber in one stage of one exemplary method of operation of a system for treating continuous flowing streams of fluid.

FIG. 22 schematically depicts an alternative, fourth embodiment of an apparatus for mixing a powder in a liquid in accordance with the present invention. This embodiment is a variant configuration of the system C in FIGS. 14–21 for feeding powdered chemicals in continuous flowing streams of fluid with high flow rates and large amounts of chemicals to be fed. The automatic powder feeding system D of FIG. 22 generally comprises a treating tank 124, an automatic powder feeder 138, an apparatus 131, and a controller 156.

The treating tank 124 is selected with sufficient capacity to feed chemical powders 146, dissolve or wet the powders 146, mix the chemicals 146 into the water 137, and provide enough retention time for the chemicals 146 to react with the contaminants dispersed in the dirty water 137. Sludge (not shown) results from the reaction of the chemicals 146 with the contaminants. The sludge generally settles in the water 137 and is pumped out of the tank 124 with the water 137 following the reaction. The sensors 127–130 in the treating tank 124 detect the water 137 at four levels to balance the flow of the dirty water 137 coming into the tank 124 with the flow of water 137 leaving the tank 124 similar to the system represented by FIG. 14.

Automatic powder feeder 138 meters the amount of chemical powder 146 to be fed and injects the powder 146 into the apparatus 131 in the top of the treating tank 124. The automatic powder feeder 138 comprises a storage tank 142, a modified three-way ball valve 139, a valve actuator 140, an air supply 152–155 to operate the actuator 140, and a separate air supply 147–151 to blow the powder 146 out of the valve 139. A rotating paddle 143 inside the tank 142 keeps the chemical powder 146 from packing. The electric motor 145 operating the paddle 143 is mounted on top of the tank 142. A seal between motor 145 and the storage tank 142 keeps moisture out of the storage tank 142.

The three-way ball valve 139 is mounted under the storage tank 142 and aligned with a port so the chemical powder 146 can be fed from the storage tank 142 into the ball of three-way valve ball 139. The size of the three-way ball valve 139 determines the amount of chemical powder 146 in each batch that can be fed at one time. The interval of time between the feeding of each batch is adjustable on the controller 156. The actuator 140 is an air cylinder with a rack and pinion drive that rotates the ball in three-way ball valve 139 to the fill and discharge positions.

The apparatus 131 in the top of the treating tank 124 receives the chemical powder 146 and air discharged from valve 139. The apparatus 131 comprises an enlarged container 132 and a vertical column 133 defining a wetting chamber 131*a*, a plunger 134 mounted on top of the column 133, and a spray 136, including a spray nozzle, mounted inside container 132 below the water level. The vertical column 133 demarks the top part of the wetting chamber 131 a and the enlarged container 132 demarks the bottom part of the wetting chamber 131 a in this particular embodiment. Bottom port 135*a* allows the mixture of water 137 and chemicals 146 to flow down from the wetting chamber 131*a* into the treating tank 124. The vertical column 133 extends out the top container 132 and down into container 132.

The transfer pump 157 draws treated water 137 and sludge out of the treating tank 124 and transfer them to another function (not shown) in the total treating process, such as a clarifier, to separate the sludge from the water 137. The pump 157 illustrated is an air operated diaphragm pump selected, in this embodiment, because of its ability to pump without shearing the sludge. The air supply 159–163 furnishes air to operate pump 157.

A FIFTH EMBODIMENT

Figure 23:
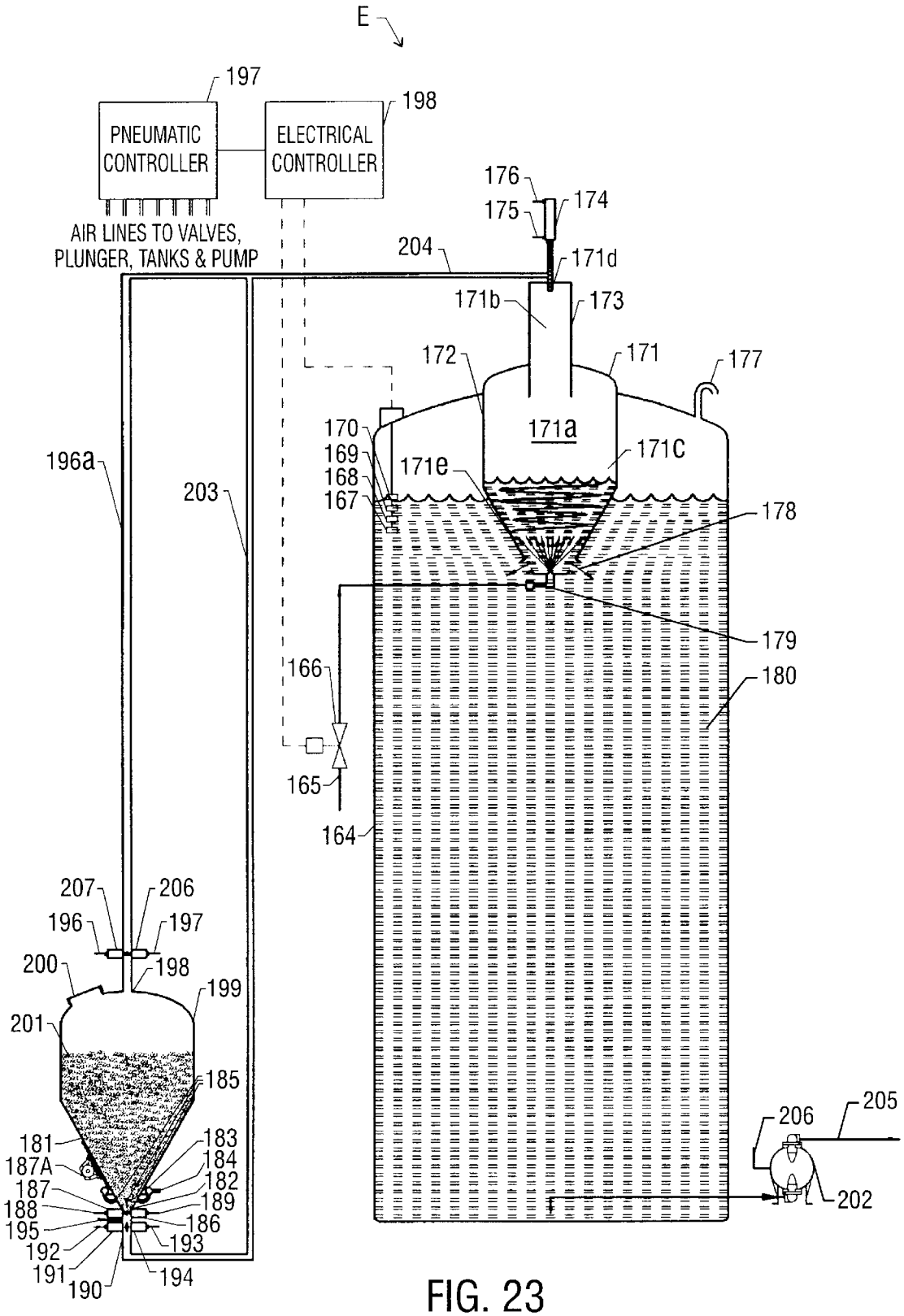
FIGS. 23–27 schematically illustrate an alternative, fifth embodiment of an automatic powder feeding system in accordance with the present invention in various stages of one exemplary method of operation of a system for treating continuous flowing streams of fluid. More particularly.
Figure 24:
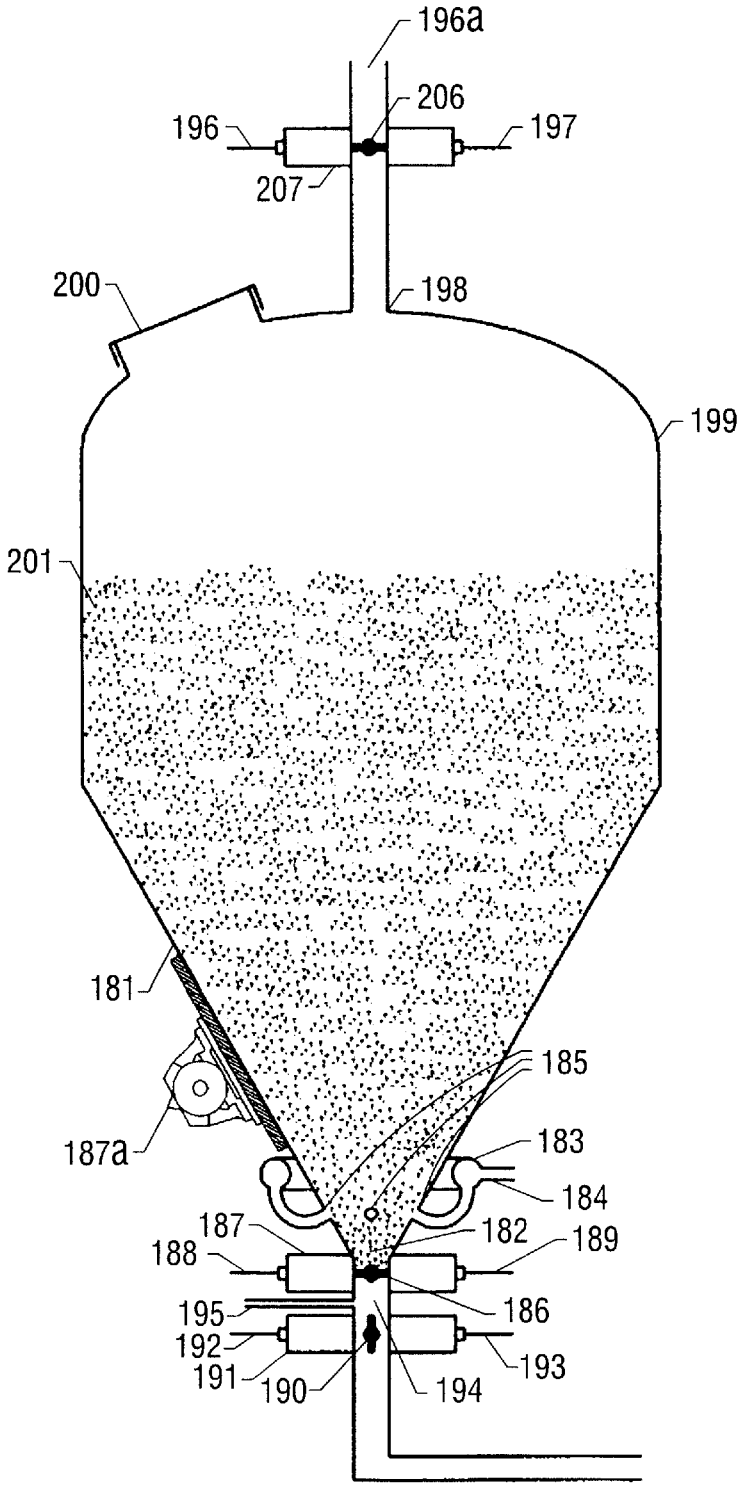
Figure 25:
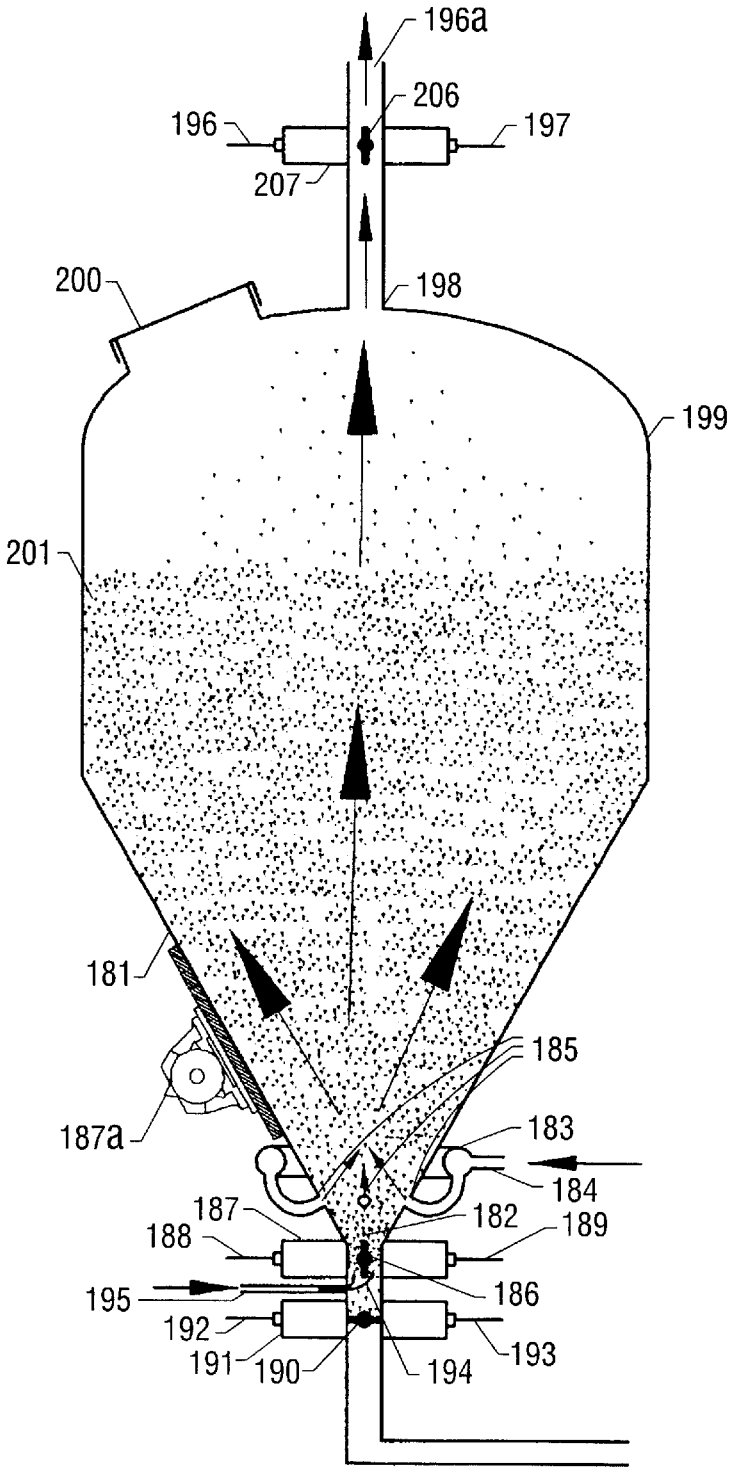
Figure 26:
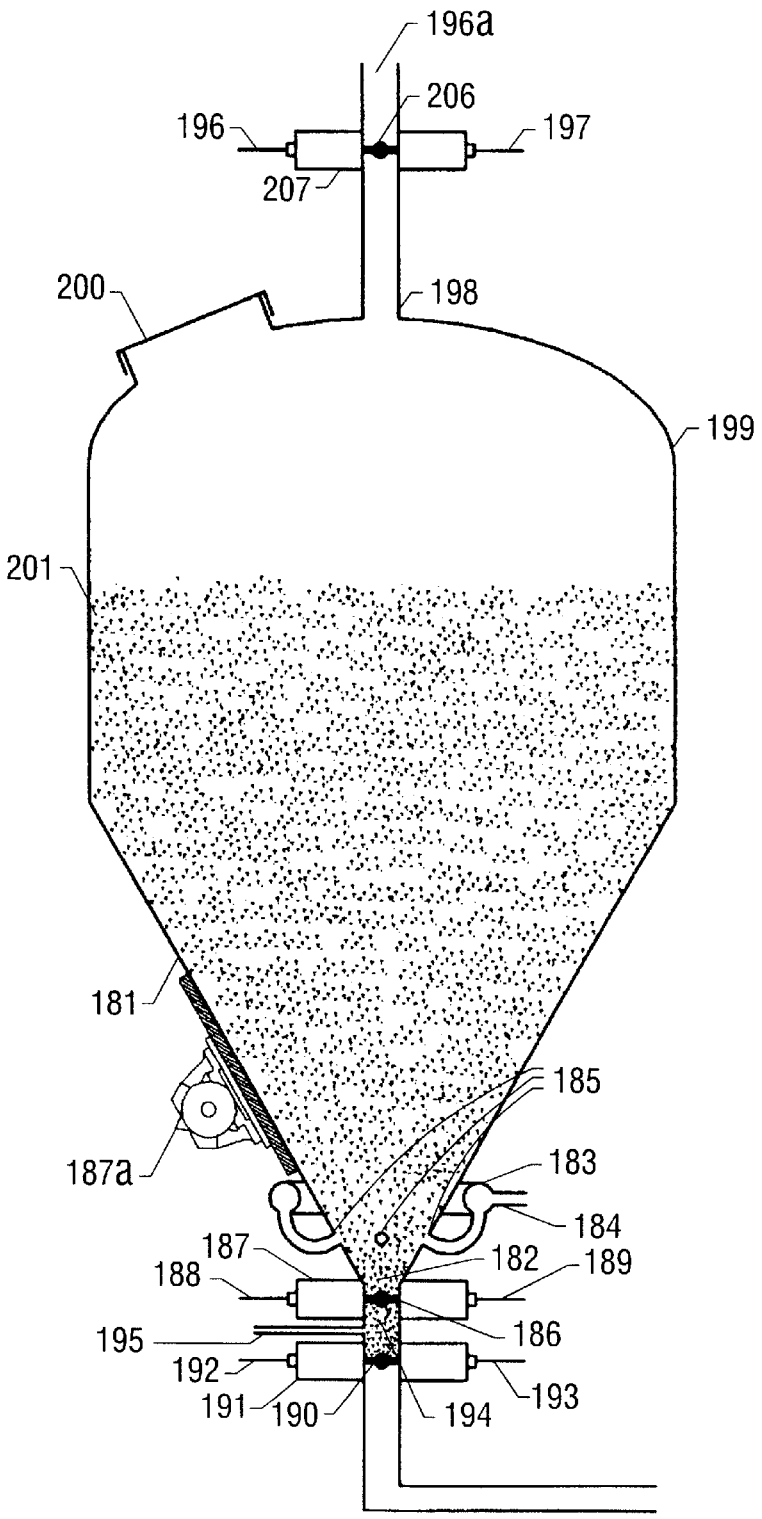
Figure 27:
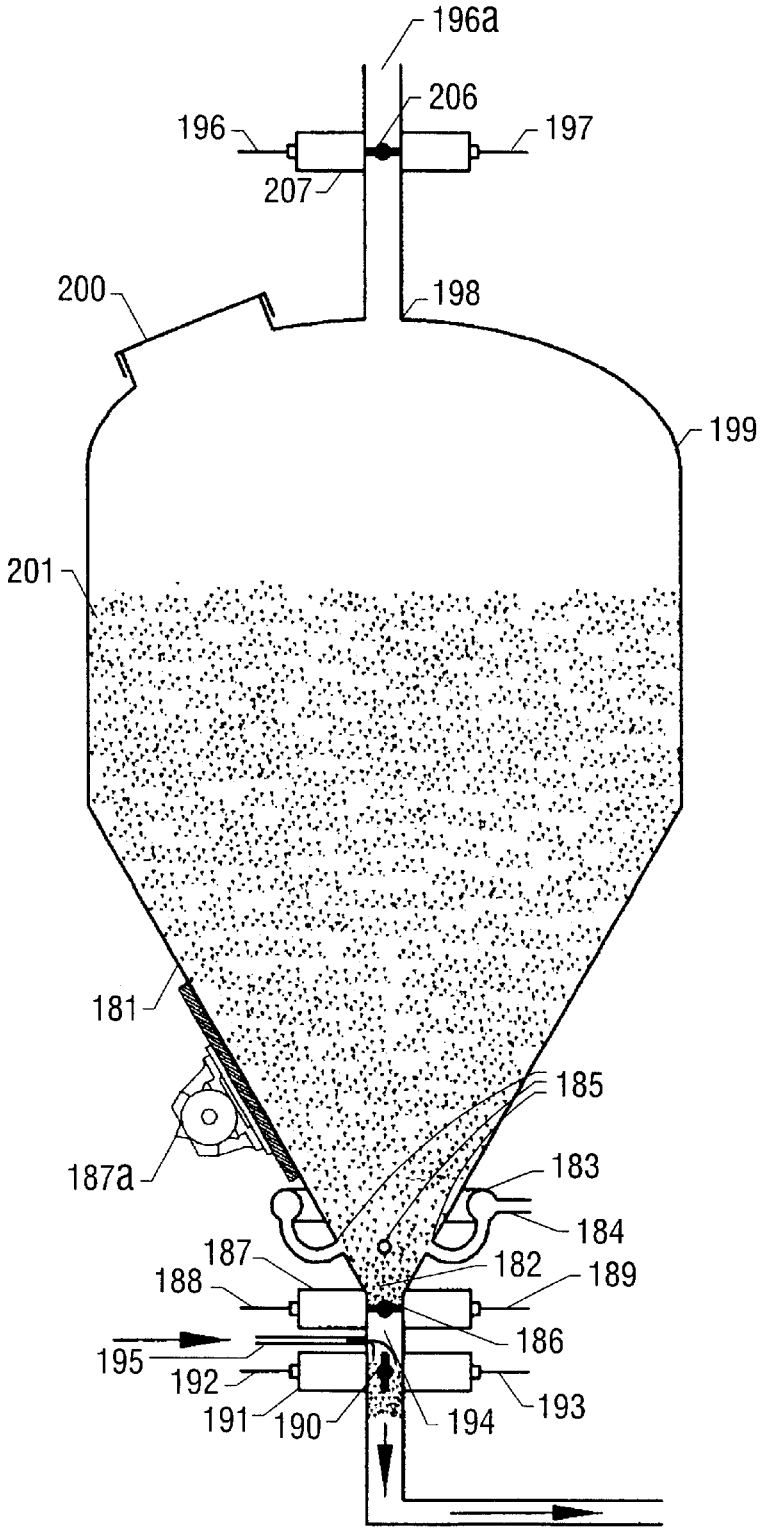

FIGS. 23–27 schematically illustrate an alternative, fifth embodiment of a system for mixing a powder into a liquid including an apparatus in accordance with the present invention. This embodiment feeds powdered chemicals into continuous flowing streams of fluids with high flow rates and large amounts of chemicals to be fed. This embodiment uses another powder feeder configuration employing air to keep the powdered chemical from packing in the feeder tank. FIGS. 23 and 24 depict a mixing system E for identification of system components. FIGS. 25–27 depict the system E during various stages of operation.

Apparatus of the Fifth Embodiment

More particularly, this embodiment is an automatic powder feeding system. An apparatus 171 including a wetting housing, or container, defining a wetting chamber 171*a* having a top part 171*b*, a bottom part 171*c*, a top port 171*d* in the wetting chamber 171*a*'s top part 171*b*, and a bottom port 171*e* in the wetting chamber 171*a*'s bottom part 171*c*; means 174 for preventing powder 201 from clumping by fluid force imparted from the wetting chamber 171*a*'s top part 171*b* to keep the powder 201 from accumulating before mixing; and a spray 179 at the wetting chamber 171*a*'s bottom part 171*c* to swirl the liquid 180 and mix the powder 201 in the liquid 180. in this particular embodiment, the apparatus 171 comprises a part of the tank 164 and is fed by a separate automatic powder feeder 181, thereby separating the wetting and feeding functions. Furthermore, this embodiment includes a tank 164, and a source 165 of the liquid 180.

Referring more particularly to FIG. 23, the system E comprises a treating tank 164, an automatic powder feeder 181, the apparatus 171, an electrical controller 198, and an pneumatic controller 197. The treating tank 164 is selected with sufficient capacity to feed chemical powders, dissolve or wet the powders, mix the chemicals into the water, and provide enough retention time for the chemicals to react with the contaminants dispersed in the dirty water. Sludge is formed as a result of the reaction of the chemicals with the contaminants. The sludge generally settles in the water and is pumped out of the tank with the water following the reaction.

The sensors 167, 168, 169, and 170 in the treating tank 164 detect water 180 at four levels to balance the flow of the dirty water 180 coming into the tank with the flow of water 180 leaving the tank 164. The upper or fourth level sensor 170 provides a signal to the electrical controller 198 to close the inlet valve 166 and prevent the treating tank 164 from overflowing. The third level sensor 169 provides a signal to the electrical controller 198 to reopen the inlet valve 166. The electrical controller 198 cycles the inlet valve 166 to turn the incoming water 180 on and off as the water level changes between the third and fourth level sensors 169 and 170. The lowest or first level sensor 167 provides a signal to the electrical controller 198 to close an air valve in the pneumatic controller 197 and shut down the pump 202 when the input water 180 is insufficient to keep the pump running. The second level sensor 168 provides the signal to the electrical controller 198 to open an air valve in the pneumatic controller 197 and the restart pump 202 when the water level has recovered. The controllers 198 and 197 will cycle the pump 202 off and on as the water level changes between the first and second level sensors 167 and 168 respectively.

The automatic powder feeder 181 meters the amount of chemical powder 201 to be fed and injects the powder 201 into the wetting chamber 171*a* in the top of the treating tank 164. Referring to FIG. 24, the automatic powder feeder 181 comprises a storage chamber 199, an air inlet manifold 183, the metering valves 186 and 190, a vibrator 187*a*, and a vent valve 206. Storage chamber 199 is sized to hold a desired quantity of chemical powder 201 to be used over a period of time. The chemical powder 201 is placed in the storage chamber 199 through the access port 200. The chemical powder 201 leaves the powder feeder 181 through an outlet port 182 in the bottom of storage chamber 199.

Air from a manifold 183 is injected into the storage chamber 199 below the chemical powder 201 through a number of ports 185 spaced around the bottom of storage chamber 199 to lift and loosen the chemical powder. The number of ports 185 provided is is determined by the ability of the dry powder 201 to flow. Air enters the manifold 183 through a pressurized air feed line 184. A port 198 allows the storage chamber 199 to be vented when air is injected through the ports 185. A vent valve 206 allows air to escape storage chamber 199 when opened, and prevents moisture from entering the storage chamber 199 when closed. An air actuator 207 rotates a valve 206 butterfly to the open and closed positions. Pressurized air is supplied to the actuator 207 through the lines 196 and 197.

Two metering valves 186 and 190 mounted below the outlet port 182 are spaced to create a cavity 194 sized to feed a metered amount of the chemical powder 201 at one time. The actuator 187 rotates the upper metering valve 186 butterfly to the open and closed positions. Pressurized air is supplied to actuator 187 through lines 188 and 189. Actuator 191 rotates the lower metering valve 190 butterfly to the open and closed positions. Pressurized air is supplied to the actuator 191 through the lines 192 and 193. The size, and diameter of the metering valves 186 and 190 and the space between them determines the amount of the chemical powder 201 in each batch that can be fed at one time. The interval of time between the feeding of each batch of powder 201 is adjustable on the electrical controller 198. Those skilled in the art having the benefit of this disclosure will realize that the metering valve sizes, spacing between the valves, and the feeding intervals can be selected for any size chemical powder batch needed for treating any size stream of fluid.

The vibrator 187*a* is operated during the period of time that the powder 201 is moved into and out of the space 194 between the metering valves 186 and 190. Again referring to FIG. 23, the vertical piping line 203 and the horizontal line 204 connect the bottom of the powder feeder 181 to the top of wetting chamber 171. The chemical powder 201 is transferred from the bottom of the powder feeder 181 through the piping lines 203 and 204 to the wetting chamber 171. The piping lines 203 and 204 are sized so air travels therethrough at a velocity high enough to carry the chemical powder 201 with it to the top of the wetting chamber 171. A second vertical line 196*a* vents when air is injected into the bottom of feeder storage chamber 199 to loosen the chemical powder 201 during metering operations. The vent line 196*a* is sized sufficiently large to keep air velocity low enough so most of the powder 201 actually falls back into the feeder storage chamber 199 and not carried with the air to the treating tank 164.

The wetting chamber 171 in the top of treating tank 164 receives the chemical powder 201 and air discharged from automatic powder feeder 181. The wetting chamber 171 comprises an enlarged container 172, a vertical column 173, a plunger 174 mounted on top of column 173, and a spray 179, including a spray nozzle, mounted inside the container 172 below the water level. The outlet ports 178 allow the mixture of water 180 and chemicals 201 to flow down from the wetting chamber 171 into the treating tank 164. Vertical column 173 extends out of the container 172 far enough to prevent water spray from reaching the inlet 174*a* below the plunger 174.

The transfer pump 202 draws treated water 180 and sludge (not shown) out of the treating tank 164 and transfers them via line 205 to another function (not shown) in the total treating process, such as a clarifier, to separate the sludge from the water 180. The pump 202 illustrated is an air operated diaphragm pump selected, in this embodiment, because of its ability to pump without shearing the sludge. Air to operate the transfer pump 202 is supplied through the pneumatic controller 197.

The pneumatic controller 197 comprises an array of solenoid operated pneumatic valves, pressure regulators, filters, flow controls, and gages to supply air at the pressures and flow rates needed by the various functions of the system.

The electrical controller 198 monitors fluid level in the treating tank 164, opens and closes the inlet valve 166, and controls the sequence and timing of components of the pneumatic controller 197.

Generally, in system operation, the water 180 is pumped from a source of contaminated water (not shown) to the treating tank 164 at the flow rate to be treated. The automatic feeder 181 meters and injects the chemical powder 201 continuously as the water 180 flows into the treating tank 164. At the same time, the water 180 is pumped out of the treating tank 164 to a subsequent treating function (not shown), such as a clarifier, where sludge (not shown) is separated from the water 180. Once the treating operation starts, the electrical controller 198 uses signals from the level sensors 167–170 in the treating tank 164 to control the flow of incoming and outgoing water 180.

More specifically, the water 180 at a flow rate to be treated enters though the inlet line 165 when the inlet valve 166 is opened. The inlet valve 166 is operated by the electrical controller 198 based on signals received from level sensors 169 and 170. The water 180 flows through the spray 179 and is sprayed in a swirling motion upward in the container 172 of the wetting chamber 171. The water 180 and sludge are transferred out of the treating tank 164 by the pump 202. Air to operate the pump 202 is supplied by the pneumatic controller 197. The electrical controller 198 operates the pneumatic controller 197.

The incoming dirty water 180 to the treating tank 164 is set at a slightly higher flow rate than the outgoing water 180 transferred by the pump 202. The controller 198 closes the inlet valve 166 when the water level reaches the set point of high level sensor 170. The controllers 197 and 198 also shut down the automatic powder feeder 181 when the inlet valve 166 is closed. The controllers 197 and 198 open the inlet valve 166 when the water level drops to the set point of the third level sensor 169. The controllers 197 and 198 also restart the automatic powder feeder 181 when the inlet valve 166 is opened. The inlet valve 166 and the automatic powder feeder 181 will continue to cycle off and on as water 180 level in the treating tank 164 rises and drops between the set points of the level sensors 170 and 169 respectively.

The pump 202 is shutdown by the controllers 197 and 198 if the water level drops to the set point of the low level sensor 167. The controllers 197 and 198 restart the pump 202 when the water level rises to the set point of the second level sensor 168. Typically, in normal operation, the outgoing water transfer pump 202 will stay on all the time. The pump 202 will cycle on and off only when the flow of the incoming water 180 is less than the flow of the water 180 being transferred out of the treating tank 164 by the pump 202.

The automatic powder feeder 181 continues to inject batches of chemical powder 201 to match the incoming water flow rate and concentration of contaminants (not shown) dispersed therein. The chemical powder 201 to be fed is placed into the storage chamber 199 through the fill port 200.

Operation of the Fifth Embodiment

Turning to FIG. 25, the top metering valve 186 and the vent valve 206 are opened. A burst of air is injected into the ports 185 from the manifold 183. Air supplied to the manifold 183 by the pneumatic controller 197 enters through the line 184. Air through the ports 185 lifts and loosens the chemical powder 201. Air is vented out the vent valve 206 through the port 198 at the top of feeder storage chamber 199. At the same time, a burst of air at a slightly higher pressure is injected into the metering cavity 194 through the line 195 to loosen any powder 201 in the outlet port 182 below the air inlet ports 185. The air supplied to the metering cavity 194 through the line 195 is shutoff. Several additional bursts of air are supplied through the ports 185 to ensure that the chemical powder 201 drops and fills the metering cavity 194. The vibrator 187*a* is operated during the entire powder transfer period.

Referring to FIGS. 26 and 27, with the metering cavity 194 full, the vent valve 206 and the top metering valve 186 are closed, capturing the intended volume of chemical powder 201. The quantity of chemical powder 201 captured in the metering cavity 194 is fed by opening the lower metering valve 190. The actuator 191 opens the lower metering valve 190 with air pressure supplied by the pneumatic controller 197 based on timing and electrical power from the electrical controller 198.

Returning to FIG. 23, the automatic powder feeder 181 continues to inject batches of the chemical powder 201 into the wetting chamber 171 to match the incoming water flow rate and concentration of contaminants dispersed in it. The operation of the wetting chamber 171 is the same as discussed in the description of FIG. 21.

The time required to discharge the chemical powder 201 from the metering cavity 194 and inject it into the wetting chamber 171 is typically only a few seconds for this particular embodiment. Following the injection of the powder 201 into the wetting chamber 171, the controllers 197 and 198 close the metering valve 190. The controllers 197 and 198 then immediately open the metering valve 186 and vent the valve 206, turns the vibrator 187*a* on, and refills the metering cavity 194, as previously discussed, to be ready for the next chemical injection at the time interval set on the electrical controller 198. The plunger 174 is extended to close the chemical powder inlet port 174*a* at the top of wetting chamber 171 during the filling operation of the metering cavity 194. At the preset interval of time the controllers 197 and 198 repeat the chemical powder feeding cycle. The chemical feeding continues until the water treating function is completed.

A SIXTH EMBODIMENT

Figure 28:
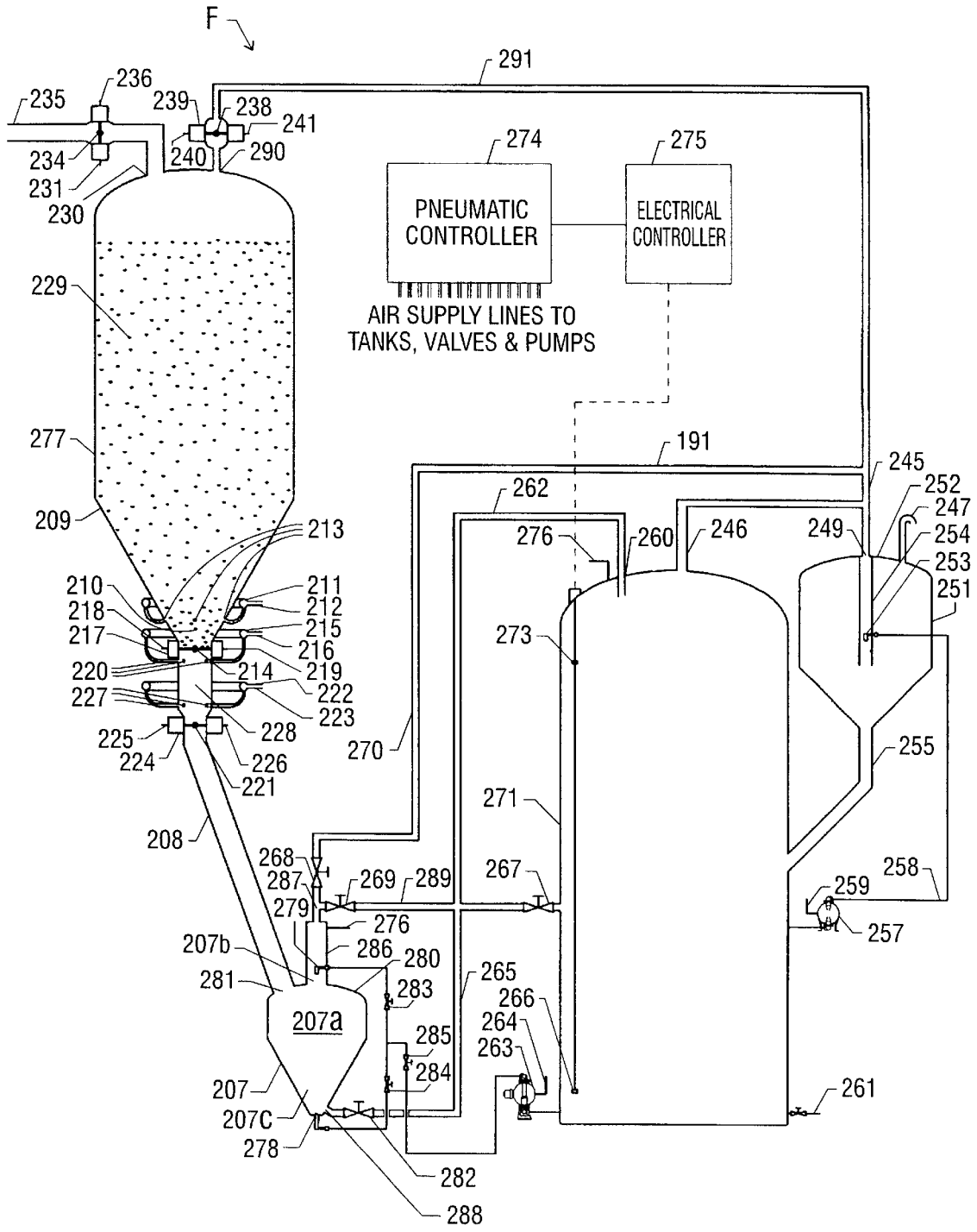
FIGS. 28–30 schematically illustrate an alternative, sixth embodiment of a manual dry chemical powder feeding system with an automatic bulk metering system in accordance with the present invention in various stages of one exemplary state of operation of the system for production of brine from solid salt. More particularly.
Figure 29:
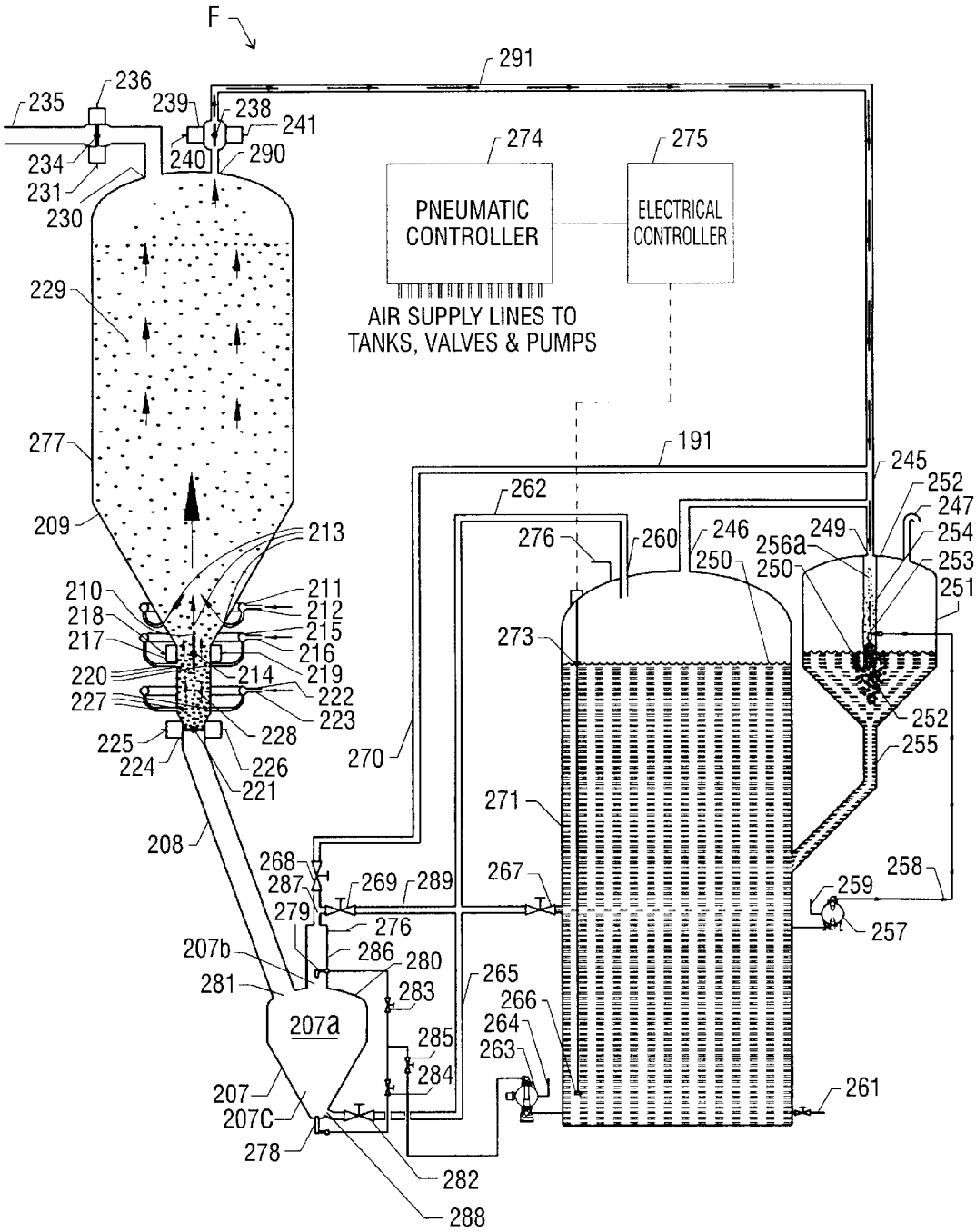
Figure 30:
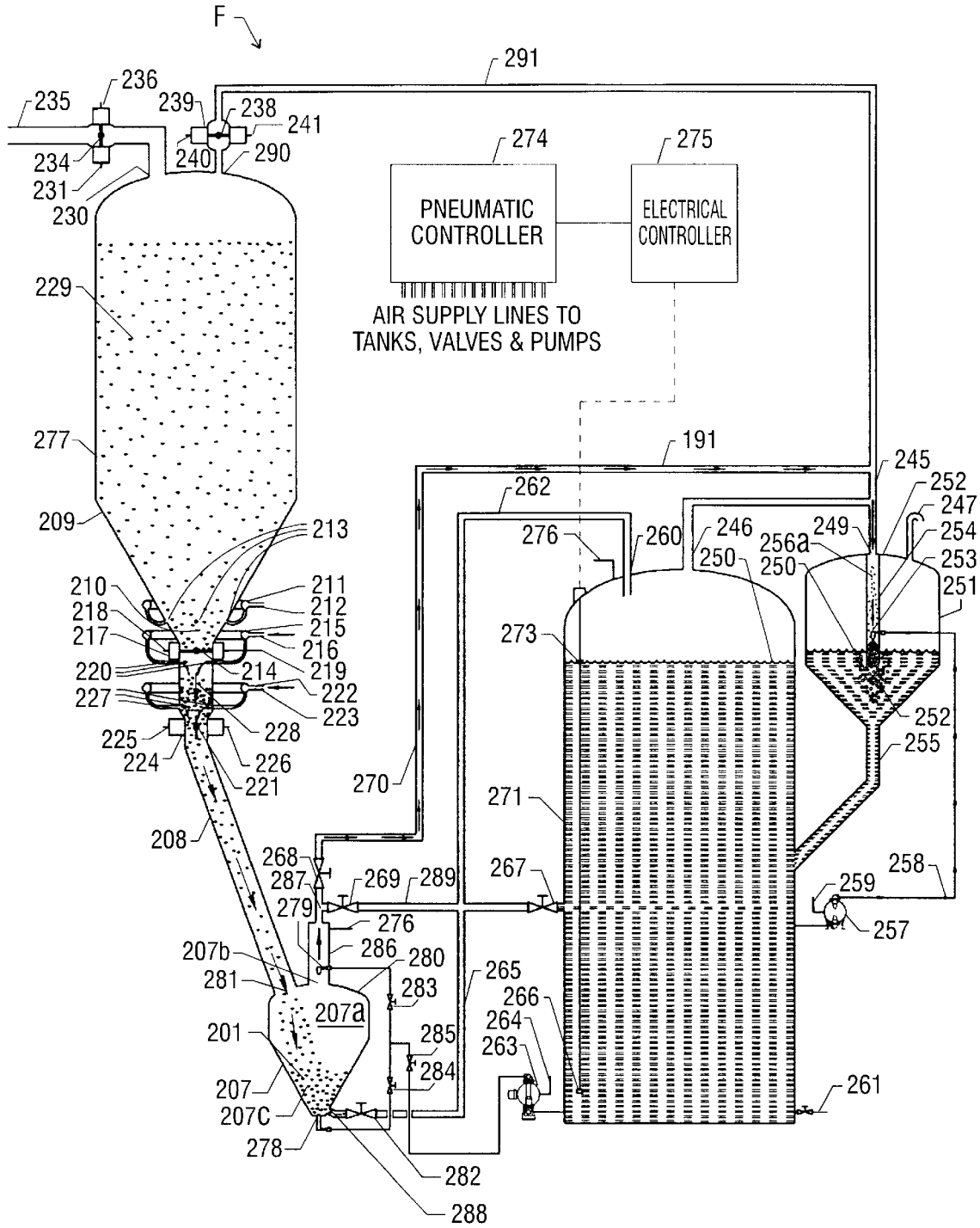

FIGS. 28–30 schematically illustrate an alternative, sixth embodiment of a system for mixing a powder into a liquid in accordance with the present invention. This particular embodiment is a manual powder feeding system F with a bulk storage system and venting of both the bulk storage tank and manual powder feeder during dry powder transfer. The system F, for convenience, is discussed in terms of a manual powder mixing system for producing brine from salt; however, the invention is not so limited. It should be understood that the methods and apparatus of the present invention may be used in the processing of many other chemical powders. FIG. 28, schematically, depicts, in schematic representation, manual feeding system F for identification of system components. FIGS. 29–30 depict manual powder feeding system F in bulk powder metering and transferring operations.

Apparatus of the Sixth Embodiment

More particularly, this embodiment is a bulk automatic powder feeding system. An apparatus 207 including a wetting housing, or container, defining a wetting chamber 207*a* having a top part 207*b*, a bottom part 207*c*, a top port 287 in the wetting chamber 207*a*'s top part 207*b*, and a bottom port 288 in the wetting chamber 207*a*'s bottom part 207*c*; means 279 for preventing powder 201 from clumping by fluid force imparted from the wetting chamber 207*a*'s top part 207*b* to keep the powder 201 from accumulating before mixing; and a spray 278 at the wetting chamber 207*a*'s bottom part 207*c* to swirl the water 250 and mix the powder salt 229 in the water 250. In this particular embodiment, the apparatus 207 is a wetting chamber separate from the tank 271 and is fed by a separate powder feeder 209, thereby separating the wetting and feeding functions. Furthermore, this embodiment includes a tank 271, a secondary wetting chamber 251, and a source 276 of the water 250.

Referring to FIG. 28, the manual powder feeding system F comprises a treating tank 271, a wetting chamber 207*a*, an automatic bulk powder feeder 209, a wetting and venting chamber 251, a pneumatic controller 274, and an electrical controller 275. In this system, no dry powder salt is fed into the treating tank 271 by the wetting chamber 207*a*. There are no "batches" of salt powder fed to be broken up, wetted and mixed with water to be treated as in a system with the automatic feeder embodiments previously discussed. As a result only a small amount of powder salt floating in the air needs to be wetted to prevent it from escaping to the ambient atmosphere when venting occurs. The wetting and venting system selected in this embodiment of the present invention minimizes the amount of pressure in the system during powder transfer and associated venting operations.

The treating tank 271 is sized to hold the amount of saturated brine to be produced in a batch. The water 250 used for the production of brine enters the treating tank 271 through a water inlet port 276. The brine formed as the result of the treating process is transferred out of the treating tank 271 through an outlet port 261. The level sensors 266 and 273 monitor low and high water levels respectively. The inlet port 260 in the top of the treating tank 271 is provided to receive water, chemicals, and air from the wetting chamber 207*a*. A side outlet valve 267 and a port are located below the surface of the water in the treating tank 271 and fills the apparatus 207 with the water 250. A tank vent line 246 connects the top of the treating tank 271 to the venting and wetting chamber 251. Makeup water for production of a new batch of brine is also used to fill the treating tank 271 before any powder is transferred so the venting system can be used for the transfer. The makeup water enters the treating tank through an inlet piping 276.

The wetting chamber 207 holds the amount of salt 229, in powder or granular form, needed for the batch of brine to be produced. The wetting chamber 207 comprises a container 280 with a vertical column 286 and a side access port 281 through which the solid salt 229 is transferred into the container 280. The top outlet port 287 and a manual outlet valve 269 allow the salt solution 272 to leave the feeder 207 from the top. A second manual outlet valve 268 at the top of the column 286 allows air to be vented to the secondary wetting chamber 251 when the dry powder 229 is transferred into wetting chamber 207*a* from the bulk storage tank 277.

A bottom outlet port 288 and a manual outlet valve 282 allow the salt solution to leave the container 208 from the bottom. The top outlet port 287 and the bottom outlet port 288 connect both ends of the feeder 207*a* to the top inlet port 260 of the treating tank 271 through the piping 265 and 262 outside the apparatus 207*a*. The valve 267 and associated piping connect the apparatus 207 to the treating tank 271 below the water level to allow water from the treating tank 271 to flow into the apparatus 207.

A spray 278, including a spray nozzle, in the bottom of the wetting chamber 207*a* sprays and swirls the incoming water 250 upward into the wetting chamber 207*a* to lift and stir the solid salt 229 with the incoming water 250. A second spray 279, including a spray nozzle, mounted in the column 286 above the powder salt 229 is directed to spray and swirl incoming water 250 downward and in the opposite direction to break up any cluster of salt 229 as it is lifted by the water 250 flowing upward from below. The valves 283 and 284 on the incoming water feed lines regulate the amount of water 272 flowing into the apparatus 207 and direct the flow to the upper or lower sprays 279 and 278, respectively. The water 250 can be directed to flow upward out of the apparatus 207 by opening the outlet valve 269 at the top of column 286 and closing the outlet valve 282 at the bottom of the container 280. Conversely, the water can also be directed to flow downward out of the apparatus by opening the outlet valve 282 at the bottom of the apparatus 207 and closing the outlet valve 269 at the top of the column 286. The flow of water 250 is directed upward for wetting and dissolving the salt 229 and downward for draining the apparatus 207. Air is injected into the top of the apparatus 207 through the air inlet port 276 when flowing downward for draining the apparatus 207, and also to accelerate the flow through the piping 265 outside the apparatus 207 when solid chemicals are used for treating water.

A pump 263 provides the water 272 at the flow rate and pressure needed to dissolve the salt 229 and feed the brine into the top of the treating tank 271. Air to operate the pump 263 is supplied by the pneumatic controller 274 through the piping 264.

The wetting chamber 207*a* is connected at the inlet port 281 by a duct 208 to the bulk storage and transfer system 209. The bulk storage and transfer system 209 is a separate embodiment of an automatic powder feeder designed to meter the amount of solid salt powder 229 to be fed into the wetting chamber 207 for producing a batch of brine.

The bulk storage and transfer system 209 comprises a storage tank 277, an air inlet manifold 211, the metering valves 214 and 221, and a vent valve 238. The storage tank 277 is sized to hold a desired quantity of salt powder 229 to be used over a period of time. The salt powder 229 is placed in the storage tank 277 through the access port 230, the valve 234, and the inlet piping 235. Air to open and close the valve 234 is supplied to the actuator through the lines 231 and 236. The salt powder 229 leaves the bulk storage tank 277 through an outlet port 210 in the bottom of the storage tank 277. Air from the manifold 211 is injected into the storage tank 277 below the salt powder 229 through a number of ports 213 spaced around the bottom of the storage tank 277 to lift and loosen the salt powder 229.

Air enters the manifold 211 through a pressurized air feed line 212. The venting valve 238 allows air to escape the storage tank 277 when the tank 277 is filled with salt powder 229 and when air is injected through the ports 213. An air actuator 239 rotates the butterfly of the vent valve 238 to the open and closed positions. Pressurized air is supplied to the actuator 239 through the lines 240 and 241. The metering valves 214 and 221 mounted below the outlet port 210 are spaced to create a metering cavity 228 sized to feed a specific amount of salt powder 229 at one time. The actuator 217 rotates the butterfly of the upper metering valve 214 to the open and closed positions. Pressurized air is supplied to the actuator 217 through the lines 218 and 219. The actuator 224 rotates the butterfly of the lower metering valve 221 to the open and closed positions.

Pressurized air is supplied to the actuator 224 through the lines 225 and 226. The size and diameter of the metering valves 214 and 221 and the space between them determines the amount of solid powder 229 in each batch that can be fed at one time. A fixed number of metered batches of salt powder 229 are fed into the wetting chamber 207 for each batch of brine to be produced. Those skilled in the art having the benefit of this disclosure will recognize that the metering valve sizes, spacing between the valves, and the feeding intervals can be selected for any amount of the salt powder 229 needed for production of each batch of brine The secondary wetting chamber 251 located outside the top of the treating tank 271 wets any powder 229 carried by air vented from both the bulk storage tank 277 and the wetting chamber 207*a* during dry salt powder transfer operations. The secondary wetting chamber 251 comprises an enlarged container 252, a spray nozzle 253 mounted above the water level inside vertical column 254, a conduit 255 through which wetted and dissolved chemicals can flow down into the treating tank 271, and the piping 247 to allow air out to atmosphere without any floating salt powder. The water 250 at the pressure and flow rate needed for the spray 253 is supplied by the pump 257 through the piping 258. Air to operate the pump 257 is supplied by the pneumatic controller 274 through the inlet piping 259.

The pneumatic controller 274 comprises an array of solenoid operated pneumatic valves, pressure regulators, filters, flow controls, and gages to supply air at the pressures and flow rates needed by the various functions of the system. Electrical controller 275 monitors fluid level in the treating tank 271, controls the sequence and timing of components of the pneumatic controller 274, and controls the number of metered batches of salt powder 229 transferred from bulk storage to the manual powder feeder 209.

Operation of the Sixth Embodiment

Referring to FIGS. 29 and 28A, the system F is shown metering solid salt powder 229 for the transfer from the bulk storage and transfer system 209. The treating tank 271 is filled with the water 250 to the upper water level sensor 273 before any of the salt powder 229 is transferred so the venting system can be operated. The water 250 also enters the wetting tank 251. The manual outlet valve 268 at the top of wetting chamber 207 is opened to vent the air when the dry salt powder 229 is transferred.

The dry powder metering and transferring operations are controlled and performed automatically by the electrical controller 275. The top vent valve 238 and upper metering valve 214 are opened. The lower metering valve 221 remains closed. Air is injected into the bulk storage tank 277 in bursts through the ports 213 to lift and loosen the dry salt powder 229. Air breaking through the salt powder 229 is vented out the top of the bulk storage tank 277 through the vent port 290, the vent valve 238, the piping 291 and 245, and the inlet port 249. Any dry salt powder 256*a* carried by the air is separated from the air and dissolved in the secondary wetting chamber 251. Air is allowed to escape to atmosphere through vent piping 247. A burst of air is also injected into the metering cavity 228 through the manifolds 215 and 222 at a pressure slightly higher than that injected into the inlet ports 213 to breakup any bridging in the outlet port 210 below the ports 213. The air continues to be injected in bursts through the inlet ports 213 until the metering cavity 228 is full of the dry salt powder 229. The air is then shut off.

Figure 29A:
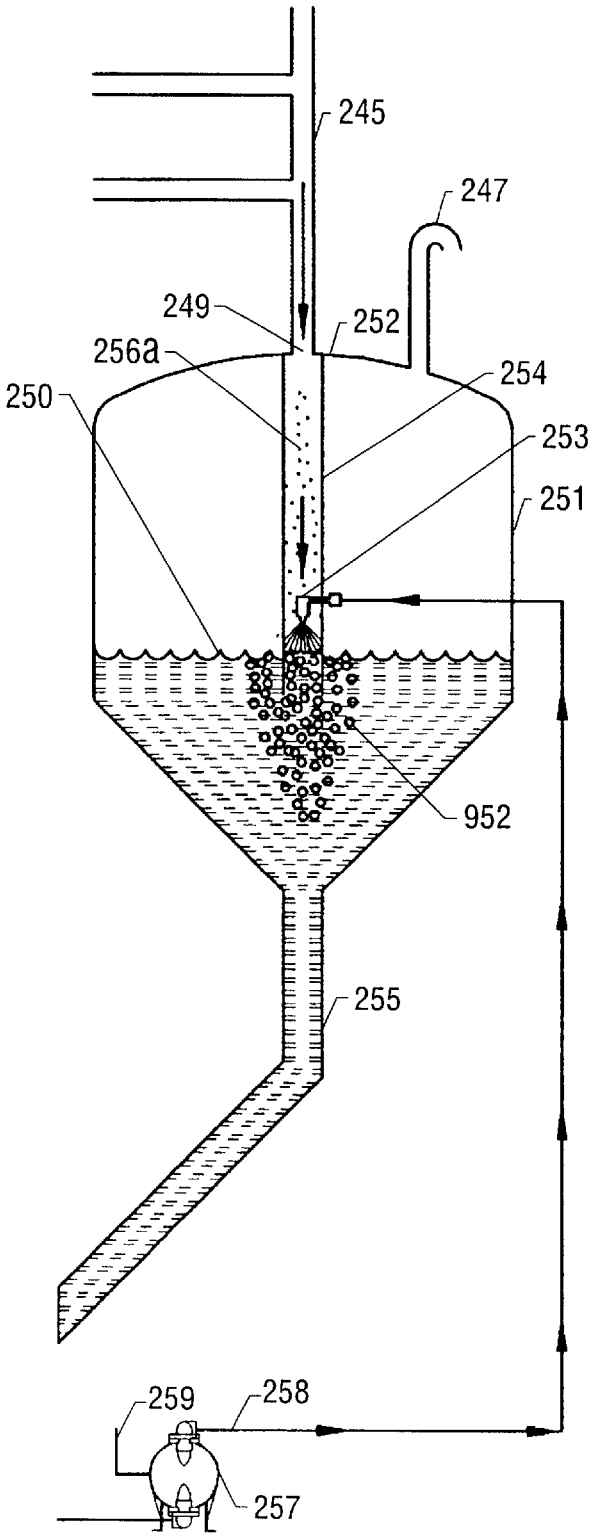
FIG. 29A details the secondary wetting chamber.

Referring to FIG. 29*a*, vent 249 enters the wetting and venting chamber 251 through the column 254. The column 254 extends below the surface of the water 250. The spray 253, mounted above the water level, injects water at a high velocity in a swirling motion into the water 250 in the lower end of the column 254. Water for the spray 253 is drawn from the treating tank 271 by the diaphragm pump 257 and supplied through the piping 258.

The vented salt powder 256*a* becomes wet, and pressurized air above the spray 253 is sucked into the turbulent water currents flowing downward to form bubbles 952 in the water. The air bubbles 252 are driven down into the water below the end of column 254 where they bubble up outside the column and escape to the ambient atmosphere free of powder through vent piping 247. The bubbling action reduces the pressure in the ullage, ie., the space above the water inside the treating tank 271 and the vent piping 247. This air pumping action may also form a vacuum in the ullage between powder transfer operations. Referring again to FIG. 29, the amount of pressure in the venting system creates a difference between the level of water 250 in the treating tank 271 and the level of water 250 in the wetting and venting chamber 251. The diameter of the container 252 determines the difference in water levels and the amount of pressure allowed in the treating tank 271.

Turning now to FIG. 30, the air supplied to the manifold 211 is turned off. The vent valve 238 and the metering valve 214 are both closed. The metering valve 221 is opened. Pressurized air applied through the manifolds 215 and 222 blows the dry salt powder 229 out of the metering cavity 228, down the ducting 208, and into the wetting chamber 207. Air enters the metering cavity 228 at two levels, from two independent air supplies (not shown). Air supplied to the upper level of the metering cavity 228 enters through the manifold 215, and air supplied to the lower level of the metering cavity 228 enters through the manifold 222. The air is blown into the metering cavity 228 at each level through four ports spaced around the diameter of the metering cavity 228. The ports are positioned to force the air to flow at a tangent to the inside surface of the metering cavity 228 and swirl around inside the metering cavity 228 to blow the surfaces clean of powder.

Air in the wetting chamber 207 is vented out the port 287, through the valve 268, piping 270, 191 and 245, and into the top of the secondary wetting chamber 251. Any dry salt powder 256*a* carried by the air is separated from the air and dissolved in the secondary wetting chamber 251. Air is vented to the atmosphere through the vent piping 247. The time required for metering and transferring each batch of dry salt powder 229 in this particular embodiment is only 2 to 4 seconds. The metering and transferring operation is repeated automatically by the electrical controller 275 for a set, predetermined number of batches until the required amount of dry salt powder 229 is transferred into the wetting chamber 207.

A SEVENTH EMBODIMENT

Figure 31:
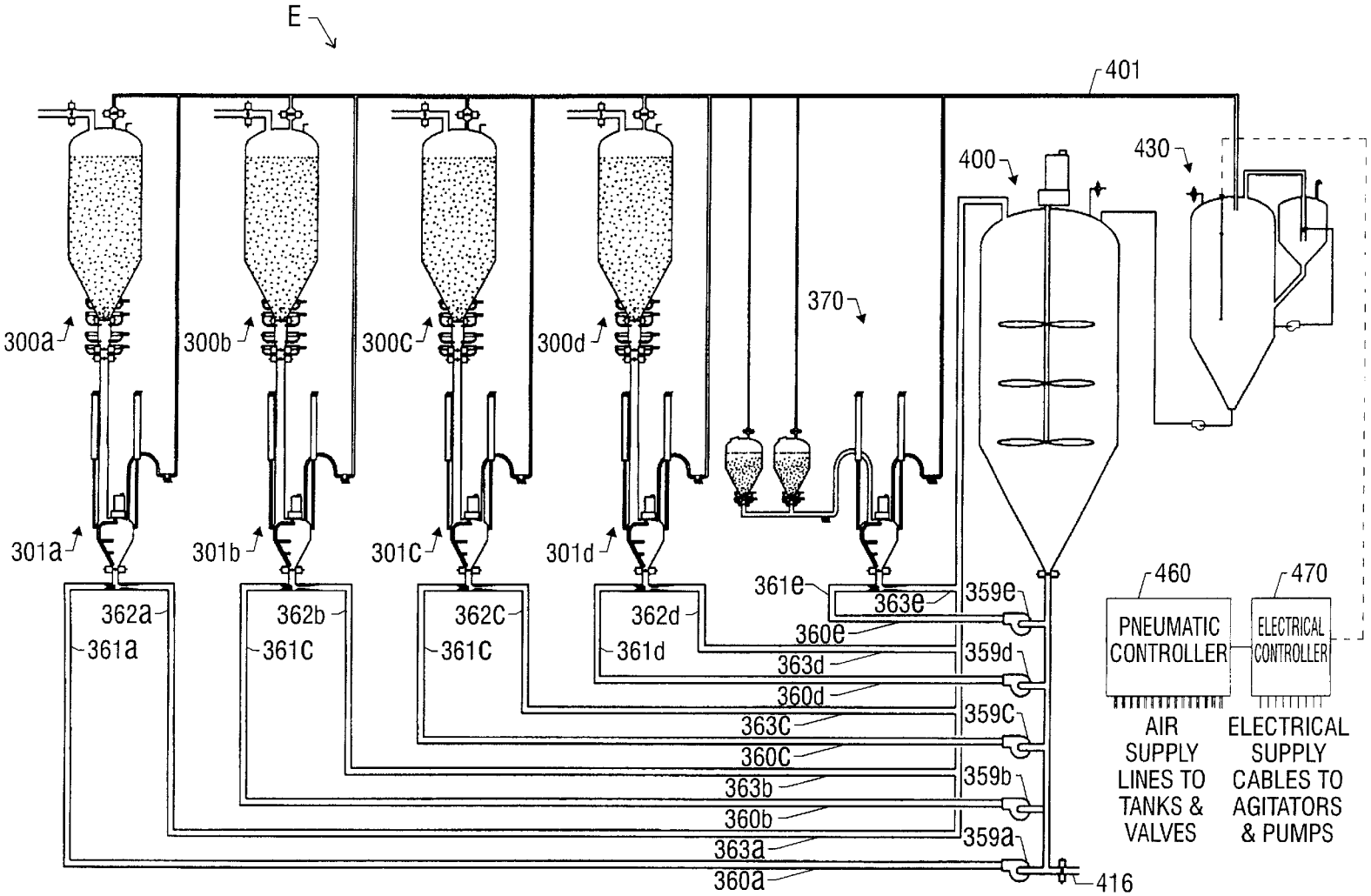
FIGS. 31–46 schematically illustrate an alternative, seventh embodiment of a bulk metering and feeding system in accordance with the present invention in various stages of one exemplary state of operation of a system for blending dry chemical powders used as oil well drilling fluids. More particularly.
Figure 32:
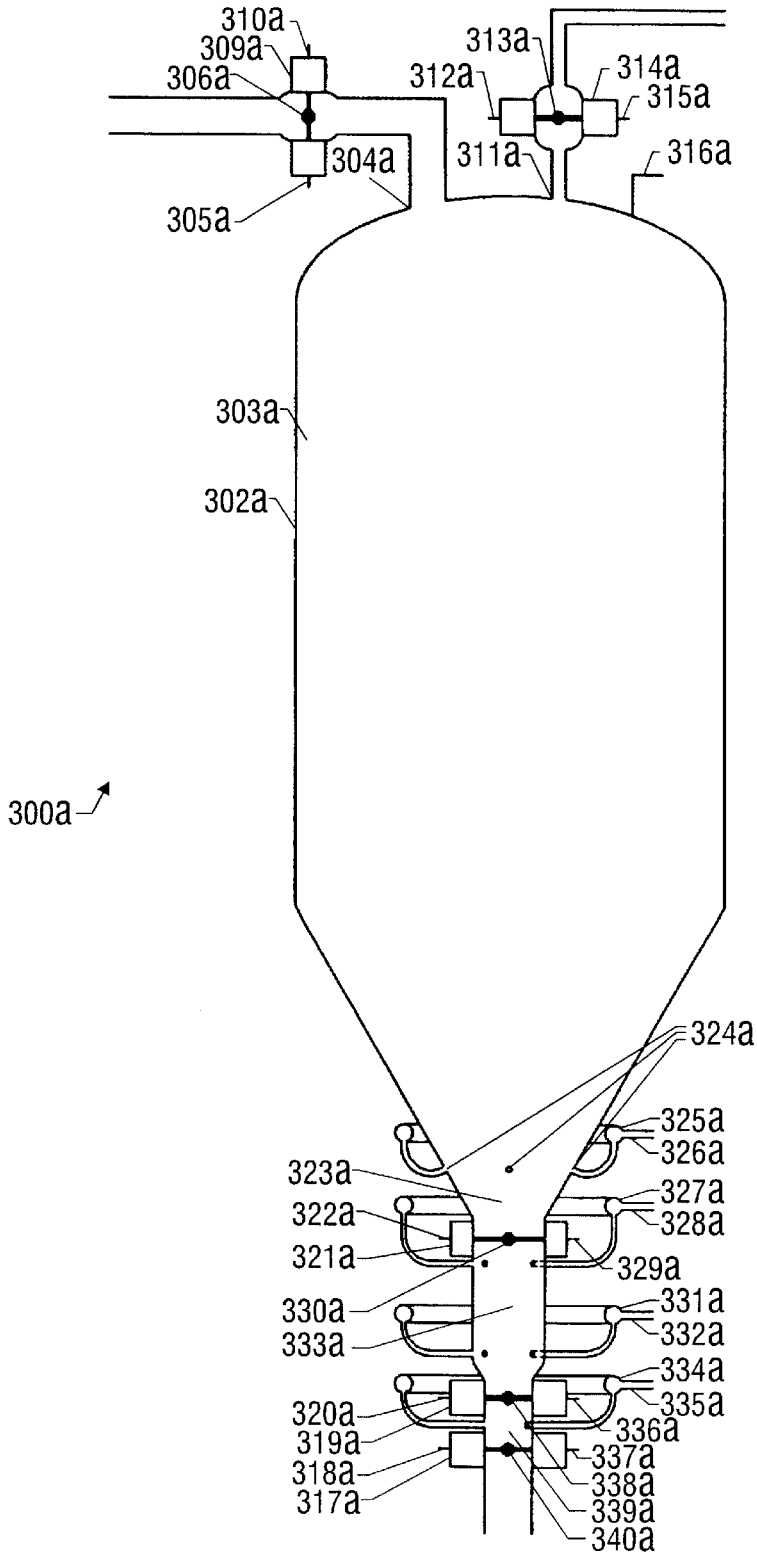

FIGS. 31–46 schematically illustrate an alternative, seventh embodiment of a system including an apparatus for mixing a powder into a liquid in accordance with the present invention. More particularly, this embodiment is an automatic powder feeding and blending system for blending various powdered chemicals into oil well drilling fluids. FIGS. 31–32 depict various components of the system G for identification of system components. FIGS. 33–46 depict the system G in various stages of operation.

Apparatus of the Seventh Embodiment

Referring now to FIG. 31, the automatic powder feeding and blending system G comprises four bulk-metering systems 300*a* –300*d*; four hopper feeding systems 301*a*–301*d*, with each hopper positioned directly under one of the bulk-metering systems; a sacked powder feeding system 370; a mixing system 400; five slurry pumps 359*a*–359*d*; a venting system 430; a pneumatic controller 460, and an electrical controller 470. Four bulk metering and feeding systems are presented to illustrate their use for four of the largest quantities of powdered chemicals typically used in oil well drilling including Barite, Bentonite, lignite, and lignosulfonate. Those skilled in the art having the benefit of this disclosure, however, will recognize that any number of bulk-metering and feeding systems can be used in accordance with the present invention.

FIG. 32 illustrates the bulk metering system 300*a*, which comprises a holding tank 302*a*, a bulk powder inlet port 304*a*, an air vent port 311*a*, a pressurized air inlet 316*a*, a chemical powder outlet port 323*a*, lower tank air inlet ports 324*a*, and three metering valves 330*a*, 338*a* and 340*a*. The holding tank 302*a* is sized to hold 100–150 sacks of chemical powder 303*a*. The chemical powder 303*a* is transferred from bulk storage (not shown) and enters the holding tank 302*a* through a valve 306*a* and an inlet port 304*a*.

The actuator 309*a* rotates valve 306*a* to the open and close positions. To operate the actuator 309*a*, air enters through the lines 305*a* and 310*a*. When transferring the chemical powder 303*a* in and out of the holding tank 302*a*, air is released through the outlet port 311*a* by opening the vent valve 313*a*. The actuator 314*a* rotates the vent valve 313*a* to the open and close positions. Air to operate the actuator 309*a* is supplied through the lines 312*a* and 315*a*. Air to pressurize the holding tank 302*a* enters through the inlet line 316*a*. The chemical powder 303*a* is transferred out of the holding tank 302*a* through the outlet port 323*a*.

The air inlet ports 324*a* are located around the lower part of holding tank 302*a* below the chemical powder 303*a*. The number of the air inlet ports 324*a* depends on the specific powder and its tendency towards packing and resistance to flow. Air is injected through ports 324*a* to lift and loosen the powder chemical 303*a*. Air is supplied to the inlet ports 324*a* through the manifold 325*a*. Air enters the manifold 325*a* through the line 326*a*.

The metering valves 330*a* and 338*a* are mounted below the outlet port 323*a* and spaced to create a metering cavity 333*a* sized to hold one sack of the chemical powder 303*a* to be metered by this system. The actuator 321*a* rotates the butterfly of the upper metering valve 330*a* to the open and close positions. Pressurized air is supplied to the actuator 321*a* through the lines 322*a* and 329*a*. Pressurized air is also injected into the metering cavity 333*a* at two levels to blow the chemical powder 303*a* out of the metering cavity 333*a* when discharging the chemical powder 303*a*. Air entering through the manifold 327*a* is injected at the upper level of the metering cavity 333*a*. Air enters manifold 327*a* through the line 328*a*. Air entering through the manifold 331*a* is injected at the lower level of the metering cavity 333*a*.

Air enters the manifold 33 la through the line 332*a*. The actuator 319*a* rotates the butterfly of the second-level metering valve 338*a* to the open and close positions. Pressurized air is supplied to the actuator 319*a* through the lines 320*a* and 336*a*. A metering cavity 339*a* is also created by the space between the second-level metering valve 338*a* and the lower metering valve 340*a*. The metering cavity 339*a* is sized to hold one-tenth of a sack of the chemical powder 303*a*.

The actuator 317*a* rotates the butterfly of the lower metering valve 340*a* to the open and close positions. Pressurized air is supplied to the actuator 317*a* through the lines 318*a* and 337*a*. Pressurized air is also injected into the metering cavity 339*a* to blow the chemical powder 303*a* out of the metering cavity 339*a* when discharging the chemical powder 303*a*. Air injected into the metering cavity 339*a* enters through the manifold 334*a*. Air enters the manifold 334*a* through the line 335*a*. The size or diameter of the metering valves 330*a*, 338*a* and 340*a* and the spaces between them determine the amount of the solid chemical powder 303*a* that can be fed at one time. Those skilled in the art having the benefit of this disclosure will recognize that metering valve sizes, spacing between the valves, and the feeding intervals can be selected for any amount of powder needed for production of each batch of drilling mud to be produced. Too, valve types other than butterfly valves may be used in alternative embodiments.

Operation of the Seventh Embodiment

Figure 33:
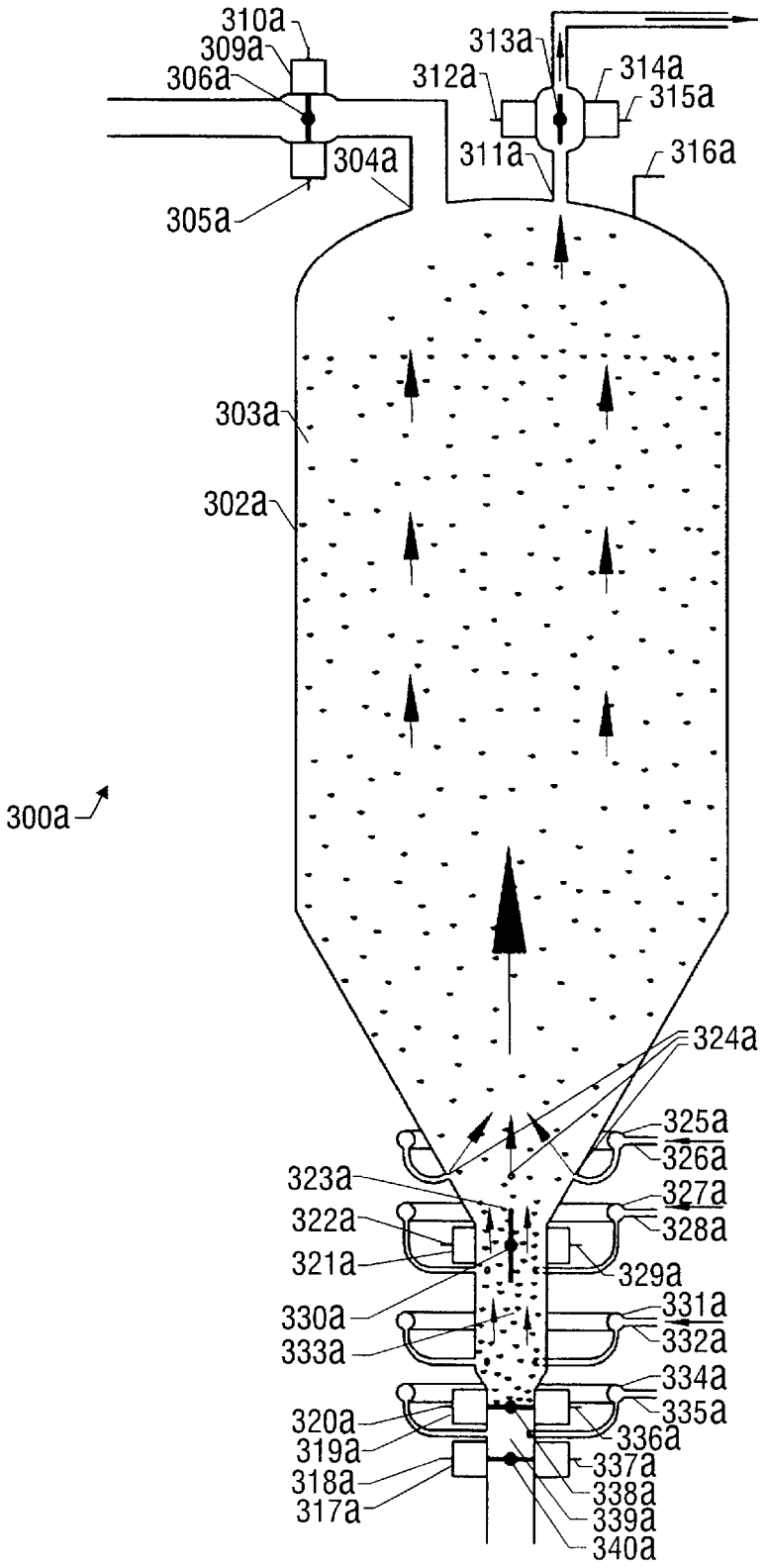

FIG. 33 shows the bulk metering system 300*a* filling the large metering cavity 333*a*. The number of metered batches of dry powder 303*a* to be transferred is preset on the electrical controller 470. The upper metering valve 330*a* and the vent valve 313*a* are opened. The second-level metering valve 338*a* remains closed. The lower metering valve 340*a* is shown closed and must be opened before the powder transfer can occur. Air is injected into the holding tank 302*a* in bursts through the ports 324*a* to loosen and lift the chemical powder 303*a*. Air breaking through the chemical powder 303*a* is vented out the top of the holding tank 302*a* through the vent port 311*a* and open the vent valve 313*a*. Bursts of air are also injected into the metering cavity 333*a* at both levels at a pressure slightly higher than that injected into the inlet ports 324*a* to breakup any bridging in the outlet port 323*a* below the ports 324*a*. The air continues to be injected in bursts through the inlet ports 324*a* until the metering cavity 333*a* is fill of the dry powder 303*a*. The air is then shut off.

Figure 34:
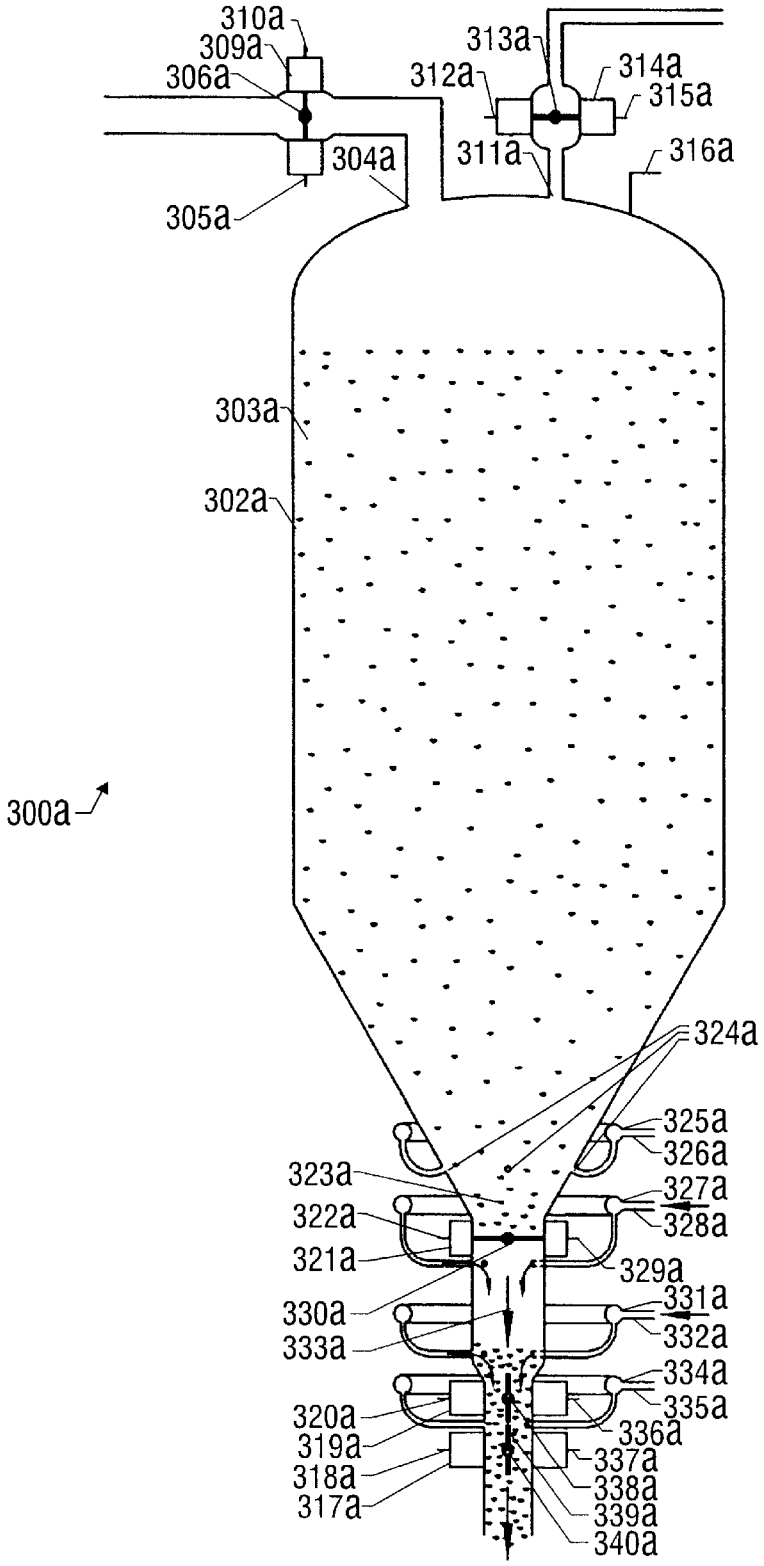

FIG. 34 shows the dry powder 303*a* being discharged from the metering cavity 333*a*. The air supplied through the inlet ports 324*a* is turned off. The vent valve 313*a* and the metering valve 330*a* are both closed. The metering valves 333*a* and 340*a* are opened. Pressurized air applied through the manifolds 327*a* and 331*a* blows the dry powder 303*a* out of the metering cavity 333*a* and down past the metering valves 338*a* and 340*a*. Air enters the metering cavity 333*a* at two levels, from two independent air supplies (not shown). Air supplied to the upper level of the metering cavity 333*a* enters through the manifold 327*a*, and air supplied to the lower level of the metering cavity 333*a* enters through the manifold 331*a*. The air is blown into the metering cavity 333*a* at each level through the four ports spaced around the diameter of the metering cavity 333*a*. The ports are positioned to force the air to flow at a tangent to the inside surface of the metering cavity 333*a* and swirl around inside the metering cavity 333*a* to blow the surfaces clean of the powder 303*a*.

Figure 35:
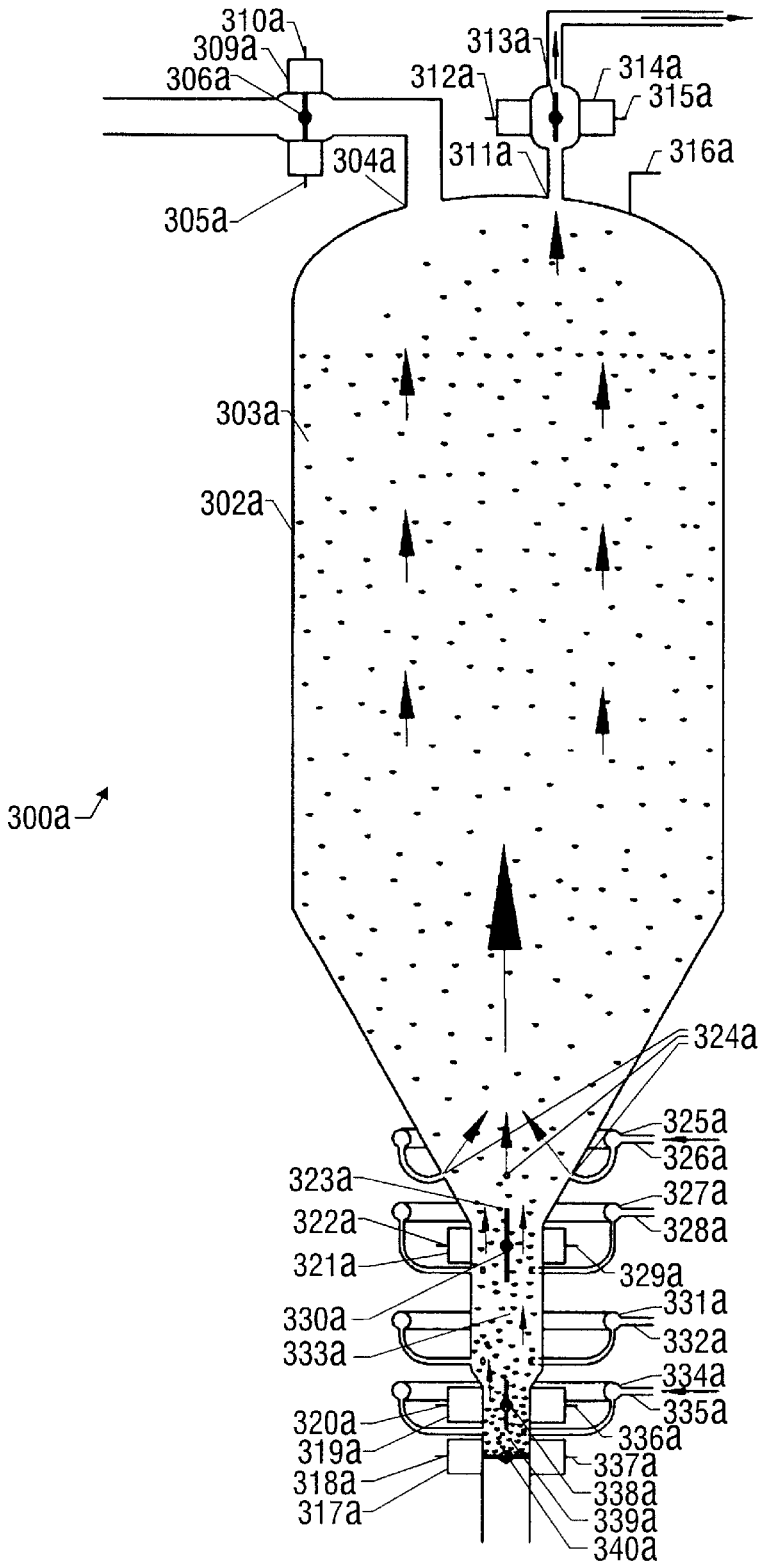

FIG. 35 depicts the bulk metering system 300*a* filling the small metering cavity 339*a*. The number of metered batches of dry powder 303*a* to be transferred is preset on the electrical controller 470. The upper metering valve 330*a*, second-level metering valve 338*a*, and vent valve 313*a* are opened. The lower metering valve 340*a* remains closed. Air is injected into the holding tank 302*a* in bursts through ports 324*a* to loosen and lift the chemical powder 303*a*. Air breaking through the powder 303*a* is vented out the top of the holding tank 302*a* through the vent port 311 a and the open vent valve 313*a*. Bursts of air are also injected into the metering cavity 339*a* at a pressure slightly higher than that injected into the inlet ports 324*a* to break up any bridging in the outlet port 323*a* below the ports 324*a*. The air continues to be injected in bursts through the inlet ports 324*a* until the metering cavity 339*a* is full of the dry powder 303*a*. The air is then shut off.

Figure 36:
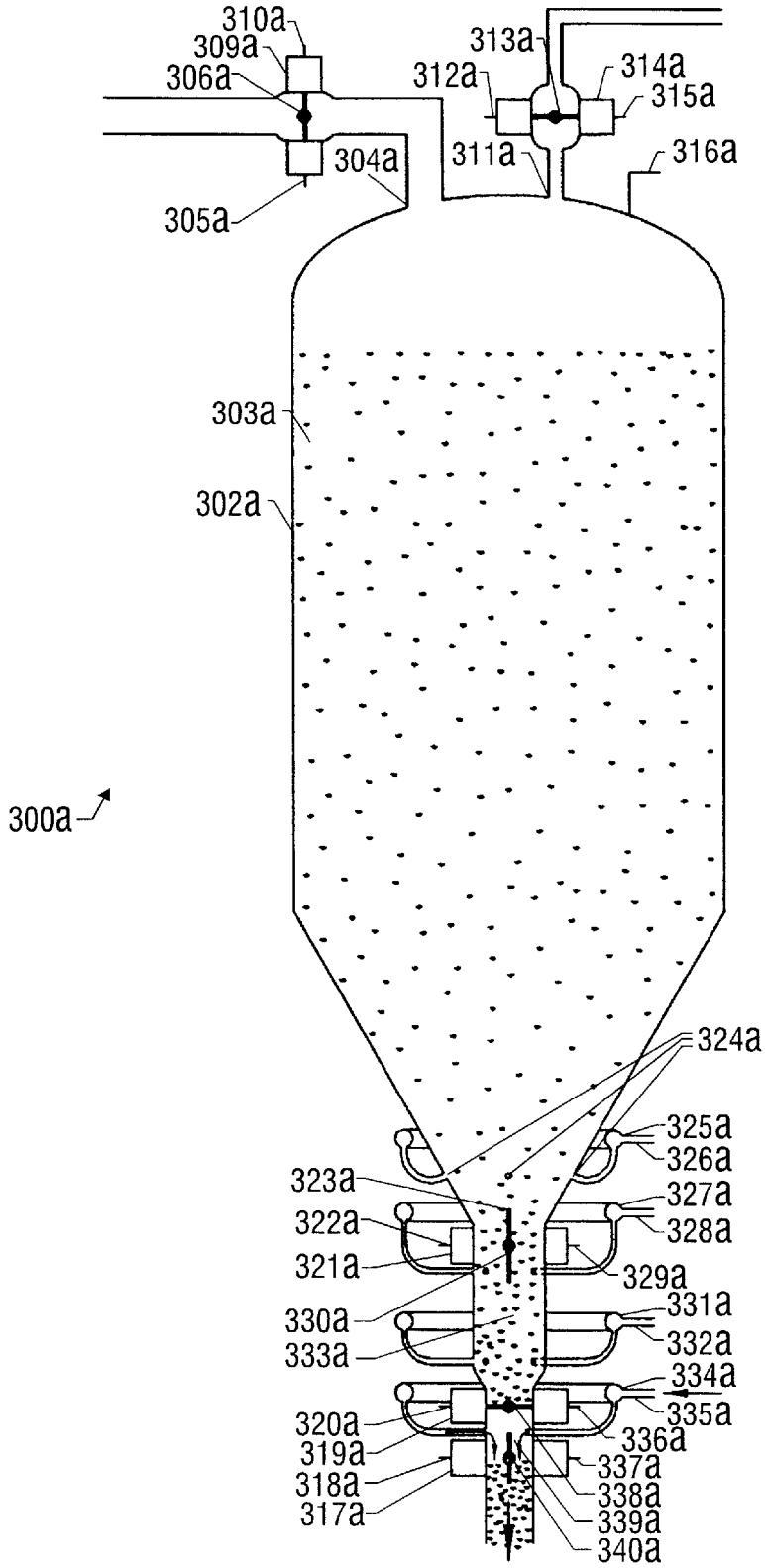

FIG. 36 shows the dry powder 303*a* being discharged from the metering cavity 339*a*. The air supplied through the inlet ports 324*a* is turned off. The vent valve 313*a* and the metering valve 338*a* are both closed. The metering valve 340*a* is opened. Pressurized air applied through the manifold 334*a* blows the dry powder 303*a* out of the metering cavity 339*a* and down past the metering valve 340*a*. The air is blown into the metering cavity 339*a* through four ports spaced around the diameter of the metering cavity 339*a*. The ports are positioned to force the air to flow at a tangent to the inside surface of the metering cavity 339*a* and swirl around inside the metering cavity 339*a* to blow the surfaces clean of the powder 303*a*.

Figure 37:
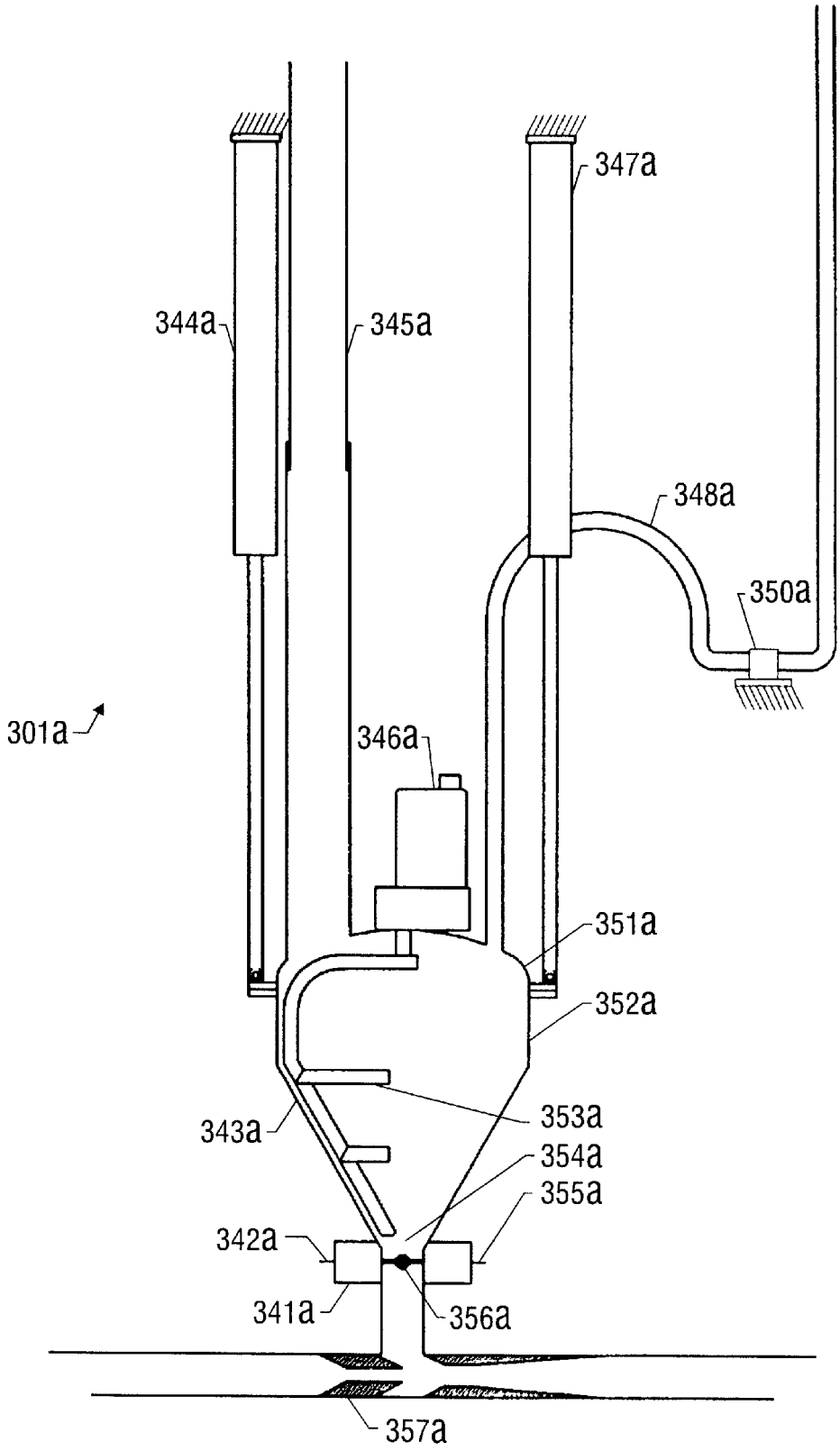

Referring to FIG. 37, the hopper feeding system 301*a* comprises a hopper vessel 343*a*, a telescoping duct 345*a* connecting the hopper vessel 343*a* with the bulk metering system 300*a*, two rigid actuators 344*a* and 347*a*, a flexible vent hose 348*a*, a rotating paddle 353*a*, a motor drive 346*a* for the paddle, and outlet port 354*a*, an outlet valve 358*a*, and an eductor 357*a* or venturi. The hopper vessel 343*a* has a lower cone 352*a* and a cover 351*a*. The chemical powder 303*a* is fed into the eductor 357*a* from the lower cone 352*a*.

Figure 38:
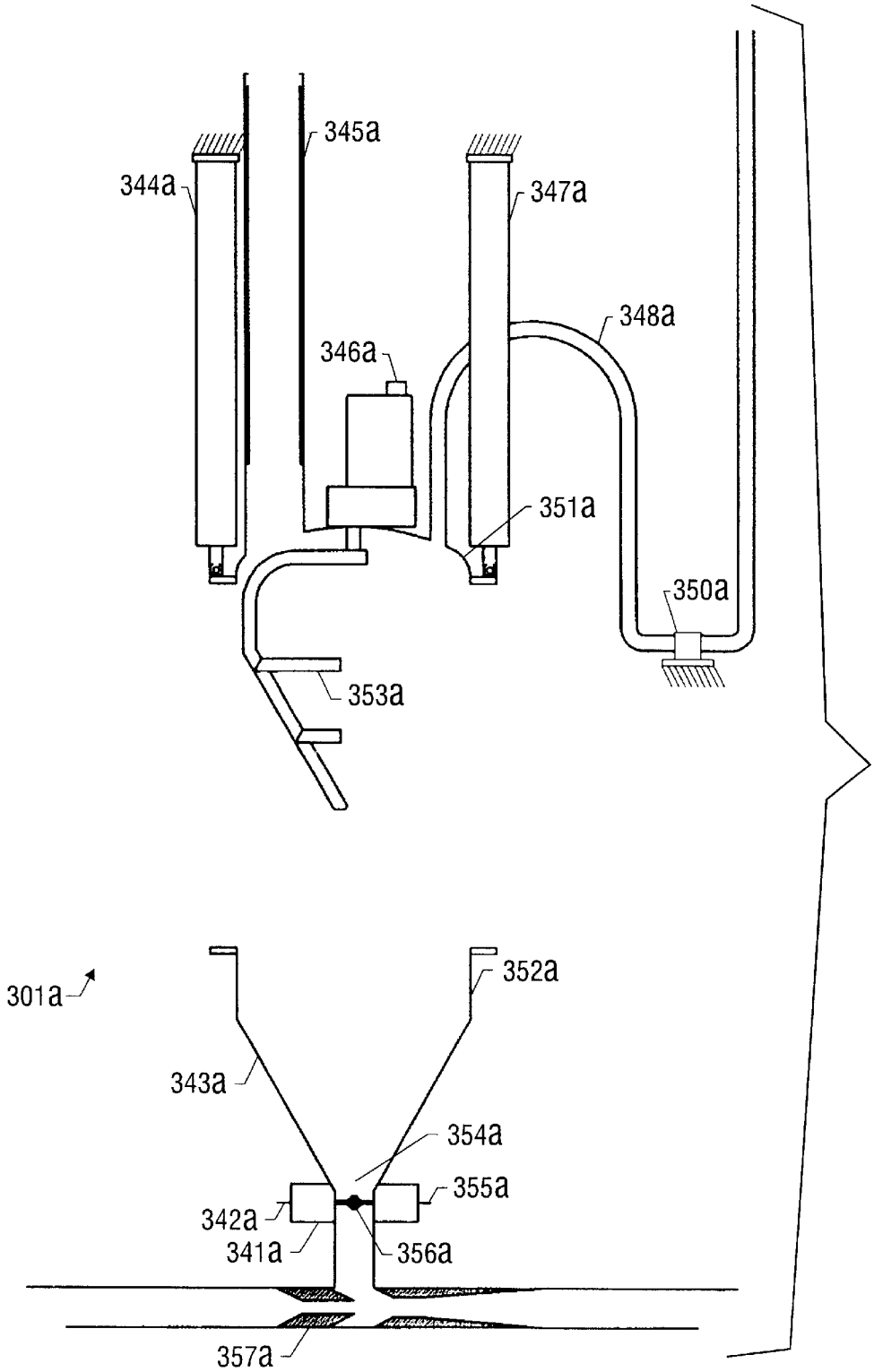

FIG. 38 shows the hopper feeding system 301*a* with the hopper cover 351*a* is removed by retracting the actuators 344*a* and 347*a*. The paddle 353*a* and the motor drive 346*a* are attached to the cover 35 la and are also moved to clear the lower cone 352*a*.

Figure 39:
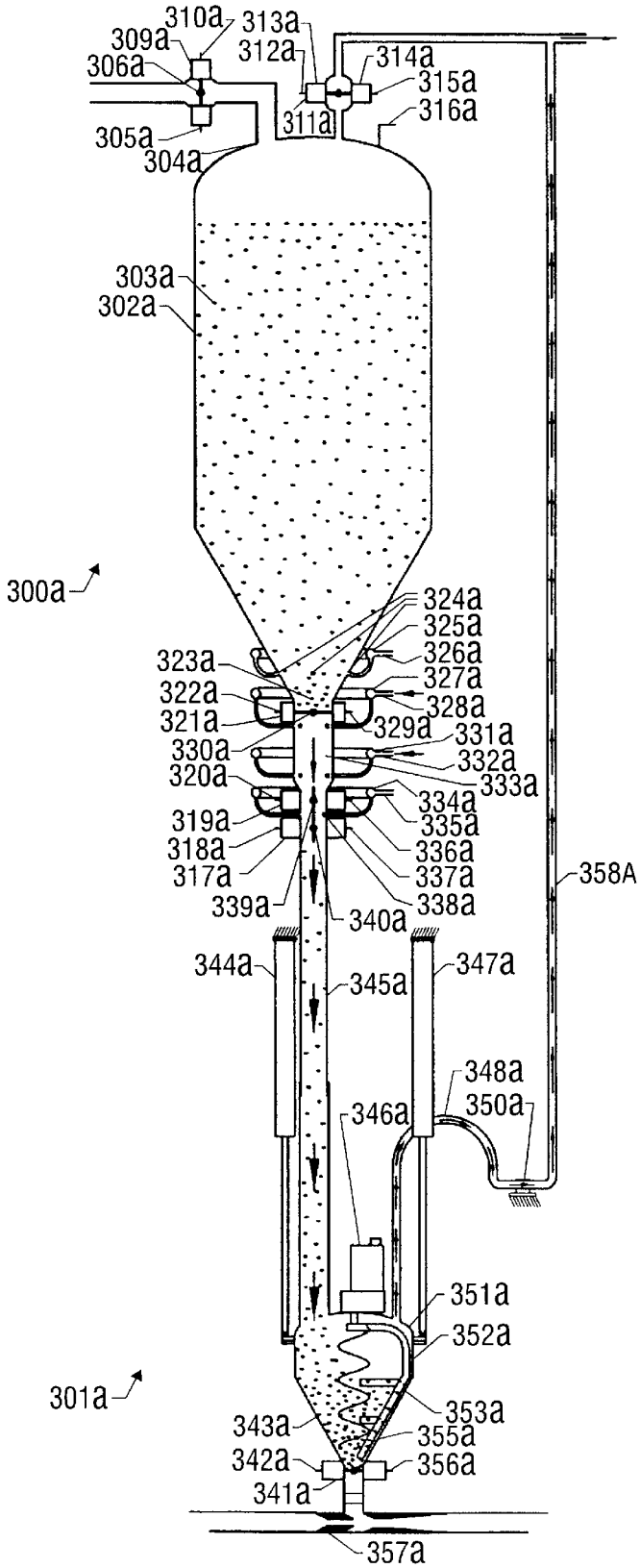

Referring to FIG. 39, bulk metering system 300*a* and hopper feeding system 301*a* are shown with the chemical powder 303*a* being transferred through the telescoping duct 345*a* and into the hopper vessel 343*a*. The paddle 353*a* is rotated by the motor drive 346*a* during the powder transfer operation. Air is vented out of the hopper vessel 343*a* through a flexible vent hose 348*a* and the vertical piping 358*a* to the venting system discussed below.

Figure 40:
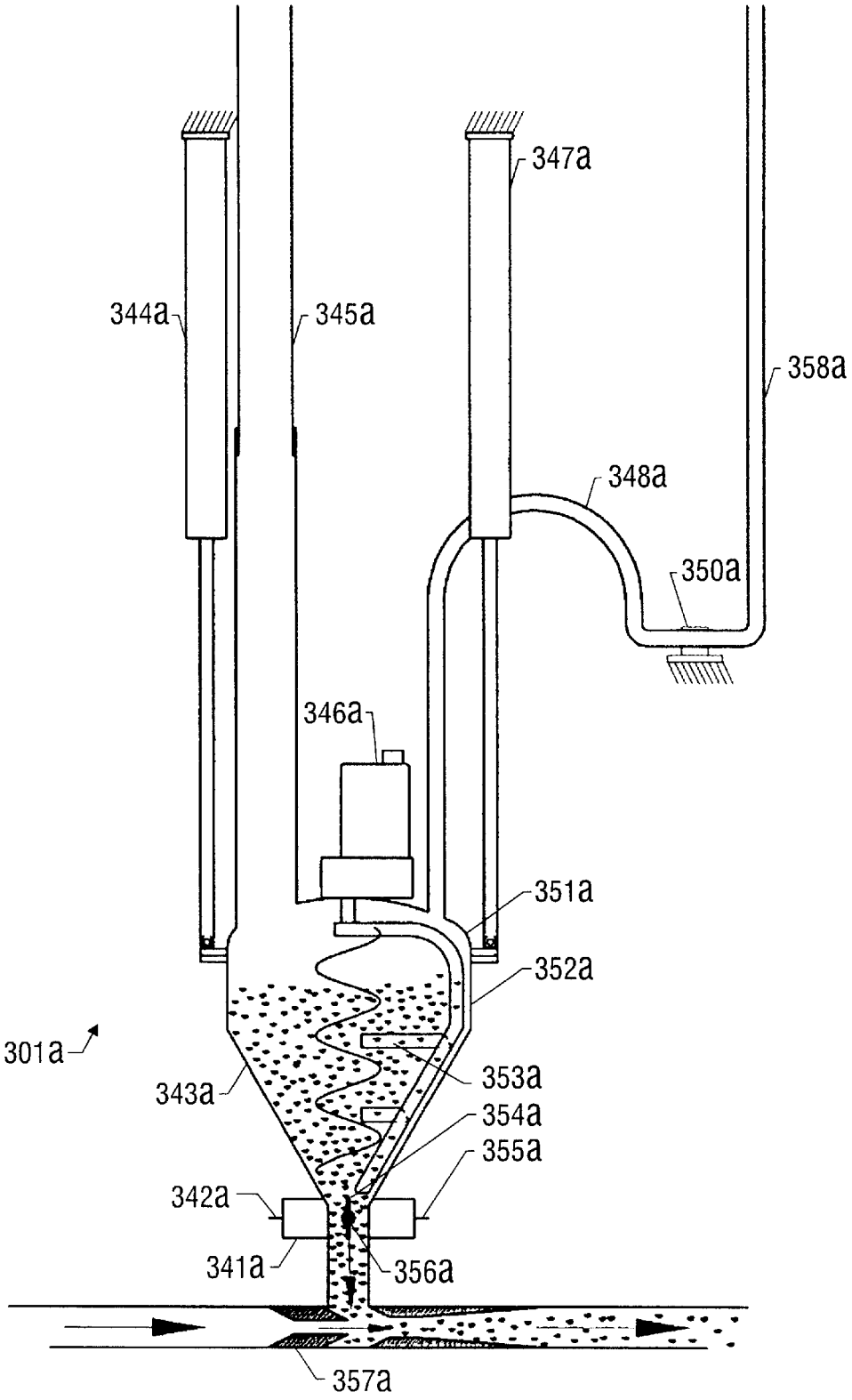

FIG. 40 depicts the hopper feeding system 301*a* with the chemical powder 303 feeding into the eductor 357*a*. The paddle 353*a* continues rotating throughout the feeding operation. The outlet valve 356*a* is rotated to the open position by the actuator 341*a*. As pressurized slurry, or drilling mud, is pumped through the eductor 357*a*, suction is created and the dry chemical powder 303*a* is drawn into the piping where it is transferred to the mixing tank 409 shown in FIG. 43 and discussed further below.

Figure 41:
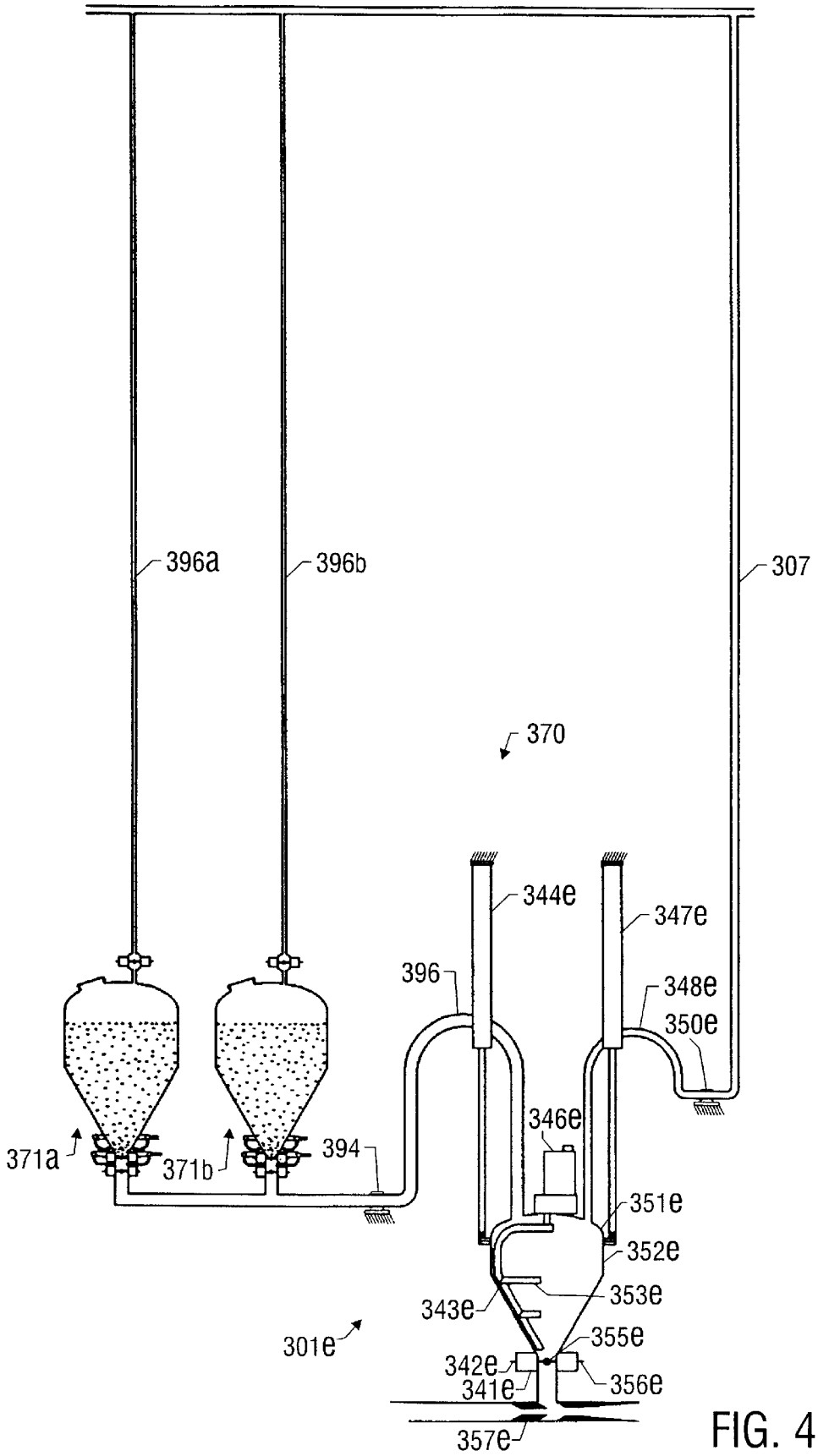

Referring to FIG. 41, the sacked powder feeding system 370 comprises two identical automatic sacked powder metering systems 371*a* and 371*b* and a fifth hopper feeding system 301*e*. The hopper feeding system 301e is identical to the hopper feeding system 301*a* described in the discussions of FIGS. 37–40 with the exception of a flexible hose 396 replacing the telescoping duct 345*a*. The automatic sacked powder metering system 371*a* will be referenced in the following discussions. All discussions also apply to automatic sacked powder metering system 371*b* since the systems are identical.

Figure 42:
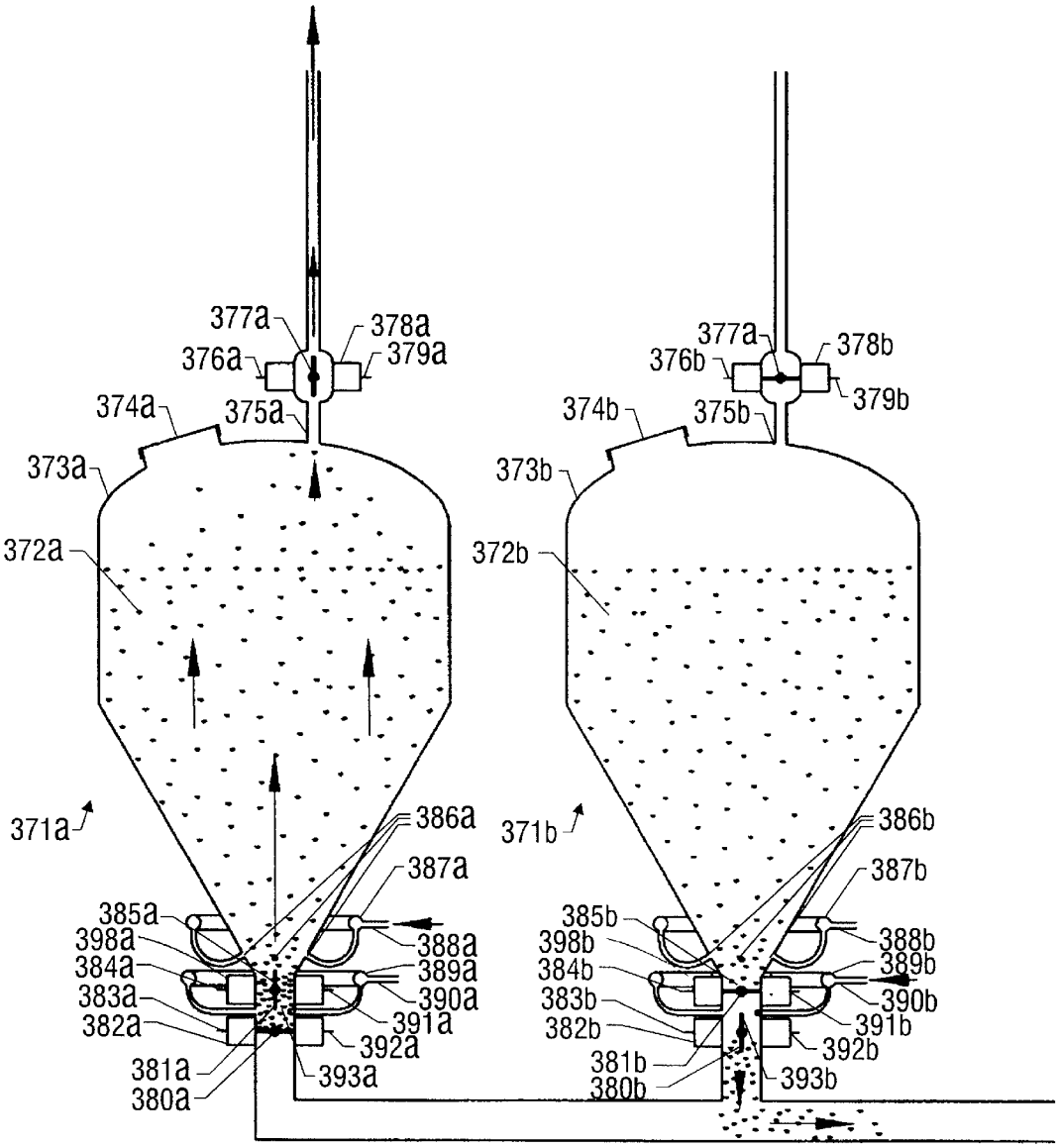

FIG. 42 provides an enlarged view of automatic powder metering systems 371*a* and 371*b*. The automatic sacked powder metering system 371*a* meters the amount of the chemical powder 372*a* to be fed and then injects the chemical powder 372*a* into the hopper feeding system 301*e*. The automatic sacked powder metering system 371*a* comprises a storage tank 373*a*, an air inlet manifold 387*a*, metering valves 381*a* and 380*a*, and vent valve 377*a*.

The storage tank 373*a* is sized to hold a desired quantity of chemical powder 372*a* to be used over a period of time. The chemical powder 372*a* is placed in the storage tank 373*a* through the access port 374*a*. The chemical powder 372*a* leaves the sacked powder metering system 371*a* through an outlet port 385*a* in the bottom of the storage tank 373*a*. Air from the manifold 387*a* is injected into the storage tank 373*a* below the chemical powder 372*a* through a number of ports 386*a* spaced around the bottom of the storage tank 373*a* to lift and loosen the chemical powder 372*a*. Air enters the manifold 387*a* through a pressurized air feed line 388*a*. A port 375*a* allows the storage tank 373*a* to be vented when air is injected through the ports 386*a*. The vent valve 377*a* allows air to escape the storage tank 373*a* when opened during chemical powder transfer operations.

An air actuator 378*a* rotates the butterfly of the valve 377*a* to the open and closed positions. Pressurized air is supplied to the actuator 378*a* through the lines 376*a* and 379*a*. Two metering valves 381*a* and 380*a* mounted below the outlet port 385*a* are spaced to create a cavity 393*a* sized to feed a metered amount of chemical powder 372*a* at one time, such as one-tenth or one-twentieth of a sack. The actuator 398*a* rotates the butterfly of the upper metering valve 381 a to the open and closed positions. Pressurized air is supplied to the actuator 398*a* through the lines 384*a* and 391*a*. The actuator 382*a* rotates the butterfly of the lower metering valve 380*a* to the open and closed positions. Pressurized air is supplied to the actuator 382*a* through the lines 383*a* and 392*a*. The size, diameter, of the metering valves 381*a* and 380*a* and the space between them determines the amount of the chemical powder 372*a* in each batch that can be fed at one time. The interval of time between the feeding of each batch of powder 372*a* is adjustable on the electrical controller 470. Those skilled in the art having the benefit of this disclosure will recognize that metering valve sizes, spacing between the valves, and the feeding intervals can be selected for any amount of chemical powder needed.

The sacked powder feeding systems 371*a–b* are shown with automatic sacked powder metering system 371*a* filling the metering cavity 393*a* with the dry chemical powder 372*a* and automatic sacked powder metering system 371*b* discharging the dry chemical powder 372*b* from the metering cavity 393*b*. The operation of both automatic powder metering systems 371*a* and 371*b* are the same as for the automatic powder feeder described in the discussion of FIGS. 24–27.

Figure 43:
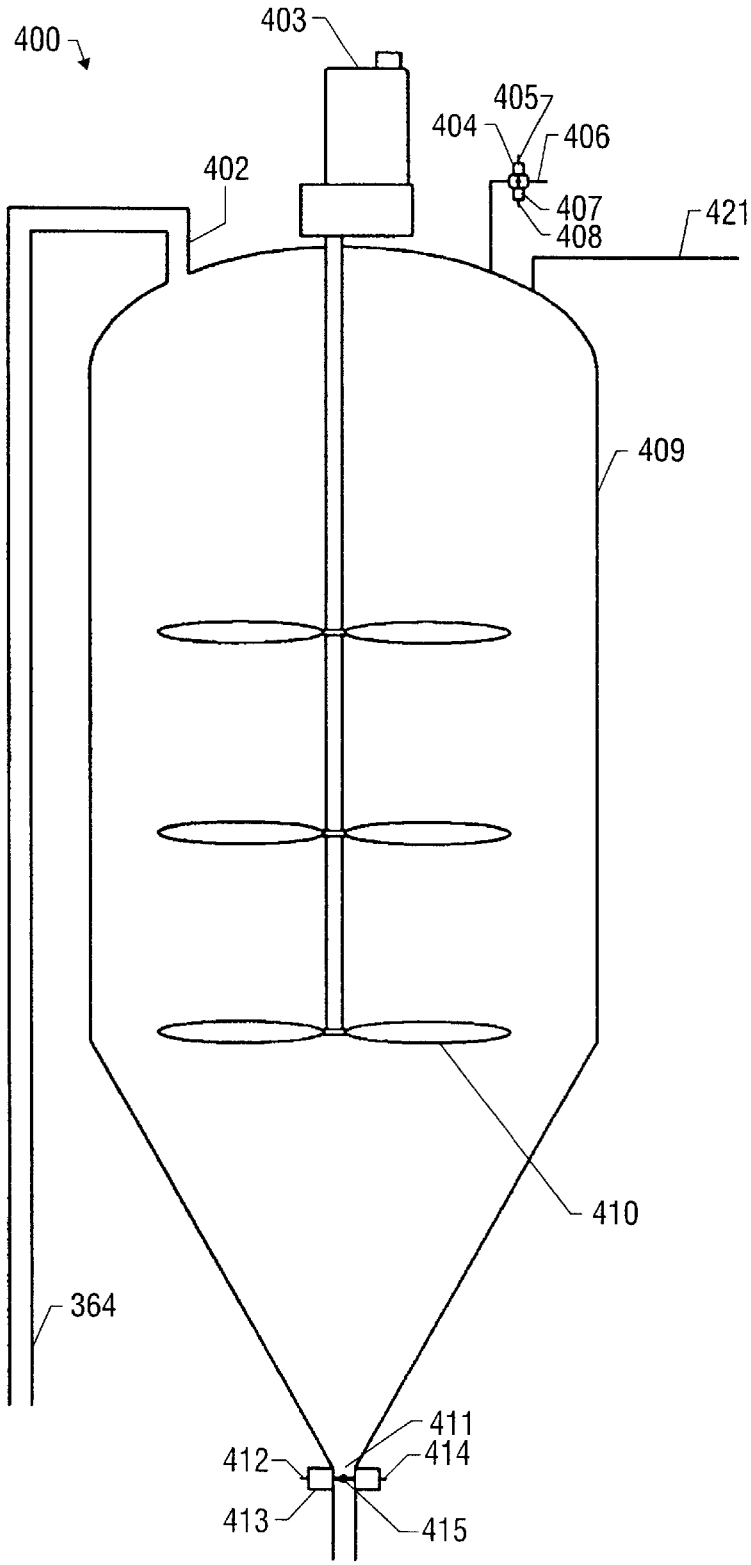

Referring to FIG. 43, the mixing system 400 comprises a mixing tank 409, a mixing paddle 410, a motor drive 403, a water supply line 406 where water from the general supply enters, a supply line 421 where water pumped from the venting system enters, an outlet port 411 where drilling mud leaves the mixing system, an outlet valve 415, and an inlet port 402 where drilling fluids used to draw dry powdered chemicals into the system returns to the mixing tank 409. The capacity of mixing tank 409 may be 300–500 barrels. Water supplied through the line 406 is controlled by the valve 404. The actuator 407 rotates the butterfly of the valve 404 to the open and closed positions. Pressurized air is supplied to the actuator 407 through the lines 405 and 408. The outlet valve 415 is opened and closed by the actuator 413. Pressurized air is supplied to the actuator 413 through the lines 412 and 414.

Figure 44:
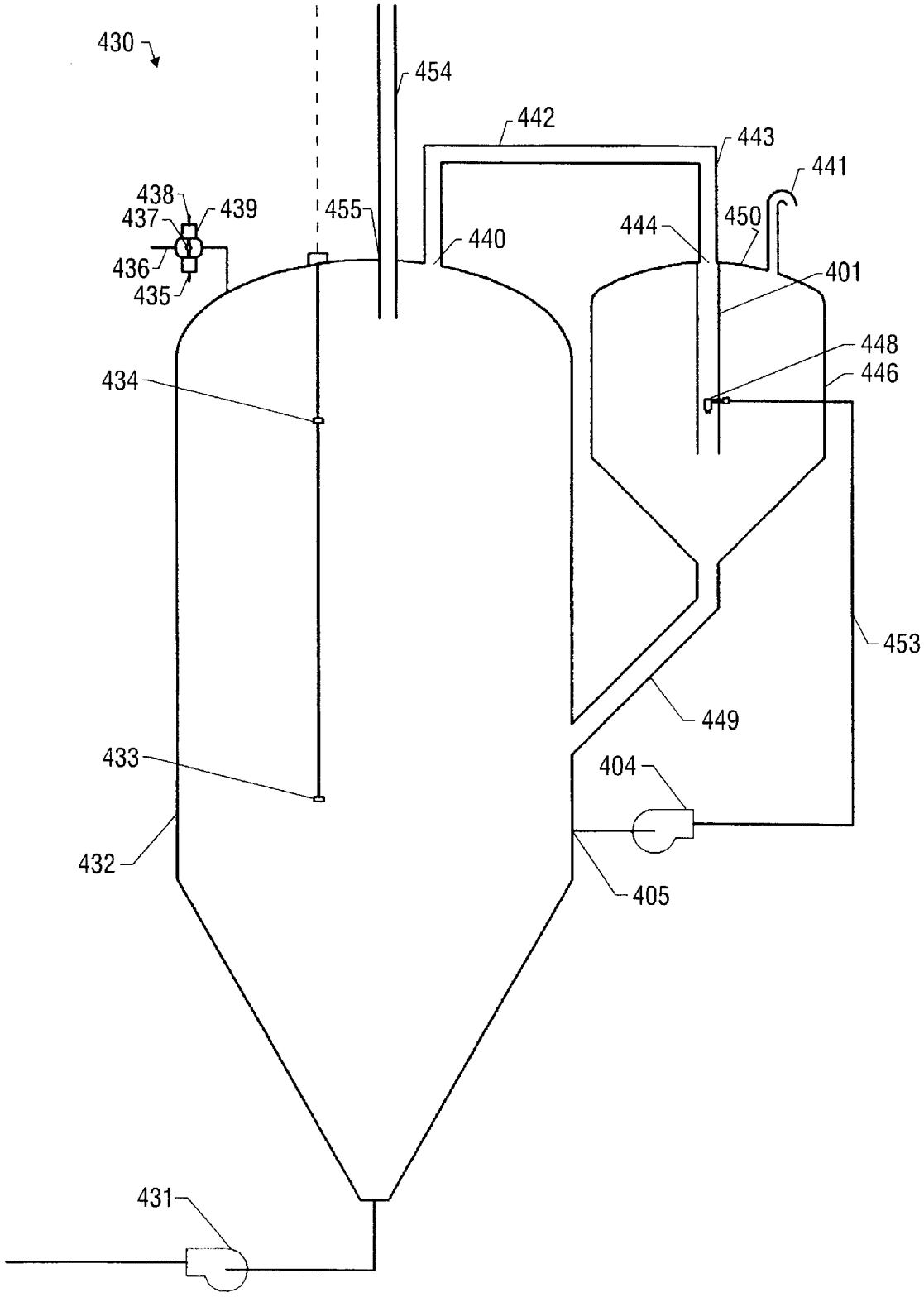

Referring to FIG. 44, the venting system 430 receives the chemical powder 372*a* and air discharged from the bulk metering tanks 302*a–d*, sacked chemical powder metering tanks 352*a*, and the hopper feeding systems 371*a–d*. The venting system 430 comprises a venting tank 432, a vented powder wetting system 446, level sensors 433 and 434, a water supply line 436, and inlet line 454 and port 455 where powder carried with air vented from all powder transfer operations enters venting tank 432, and a pump 431 to transfer water with the wetted powder to the mixing tank 409. The vented powder wetting system 446 comprises an inlet piping 443 and a port 444, a wetting tank 450, a nozzle 448, the piping 449 to return water and wetted powder to the venting tank 432, the piping 441 to allow air to escape, and the pump 404 with the associated piping 405 and 453 to supply water at the pressure and flow rate required to effectively operate the nozzle 448.

Figure 45:
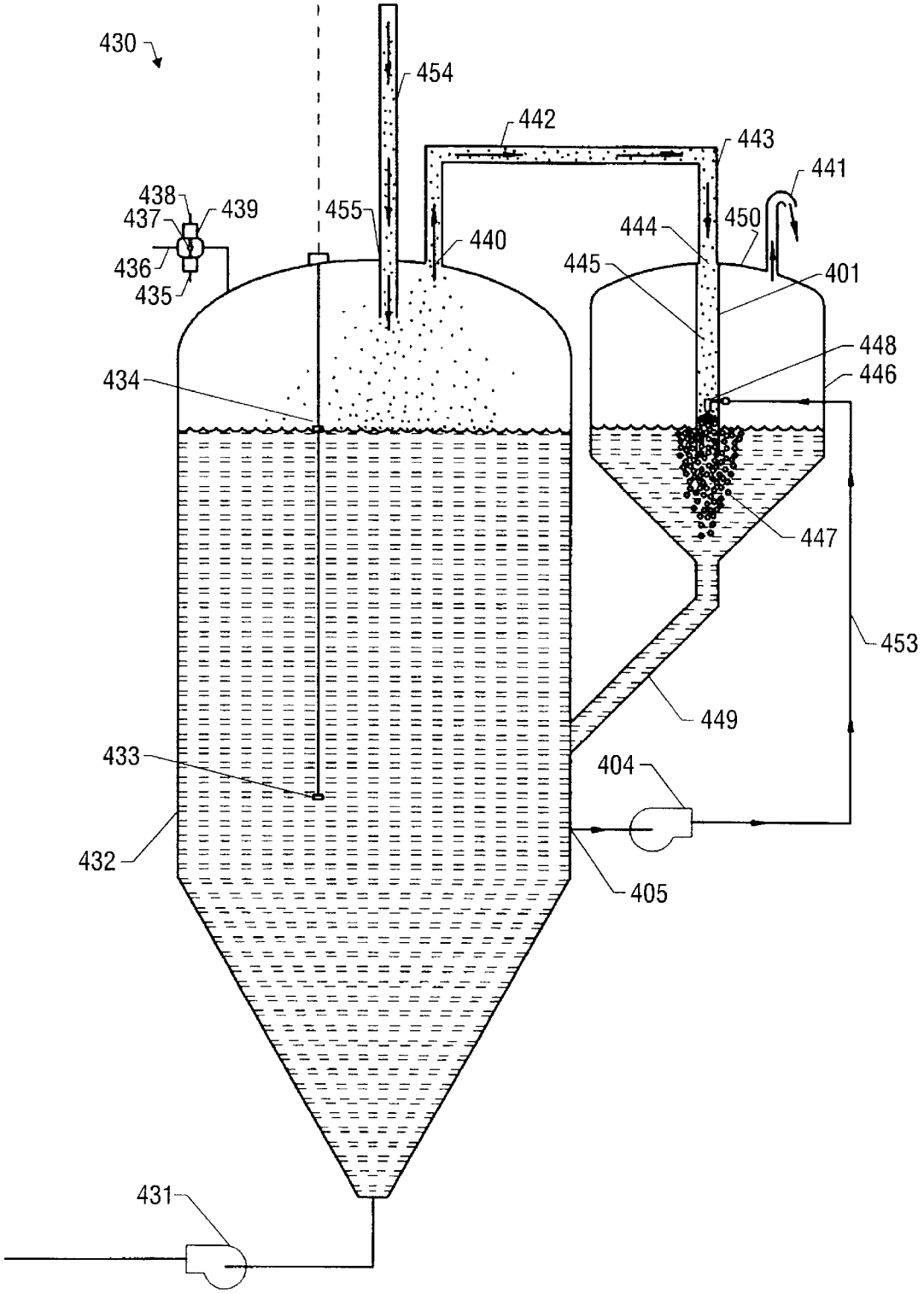

FIG. 45 illustrates the operation of the venting system 380. The dry powder 445 carried by air during powder transfers enter the venting tank 432 through the piping 454 and the port 455. The air from the outlet port 440 will flow through the piping 442 and 443 and into the wetting chamber 446 through the inlet port 444 and the vertical column 401. The powder 445 entering the vertical column 401 will fall by gravity into the water. The column 401 extends below the surface of the water in the wetting and venting chamber 446. Water inside the wetting and venting chamber 446 enters through the nozzle 448. The spray 448 mounted above the water level injects water at a high velocity in a swirling motion into the water in the lower end of the column 401. Water for the spray 448 is drawn from the venting tank 432 by the pump 404 and supplied through the piping 453.

The vented powder becomes wet and pressurized air above the spray 448 is sucked into the turbulent water currents flowing downward to form bubbles. The air bubbles 447 are driven down into the water below the end of the column 401 where they bubble up outside the column 401 and escape to the ullage in the wetting chamber 382 and out to the ambient atmosphere through the vent piping 441. This action reduces the ullage pressure inside the venting tank 432 and the vent piping 443 throughout the system. This air pumping action can create a vacuum in the venting system 380 between powder transfer operations. As described previously, the size of the tank 450 of wetting and venting chamber 446 is selected to minimize the pressure before venting operations are completed.

Figure 46:
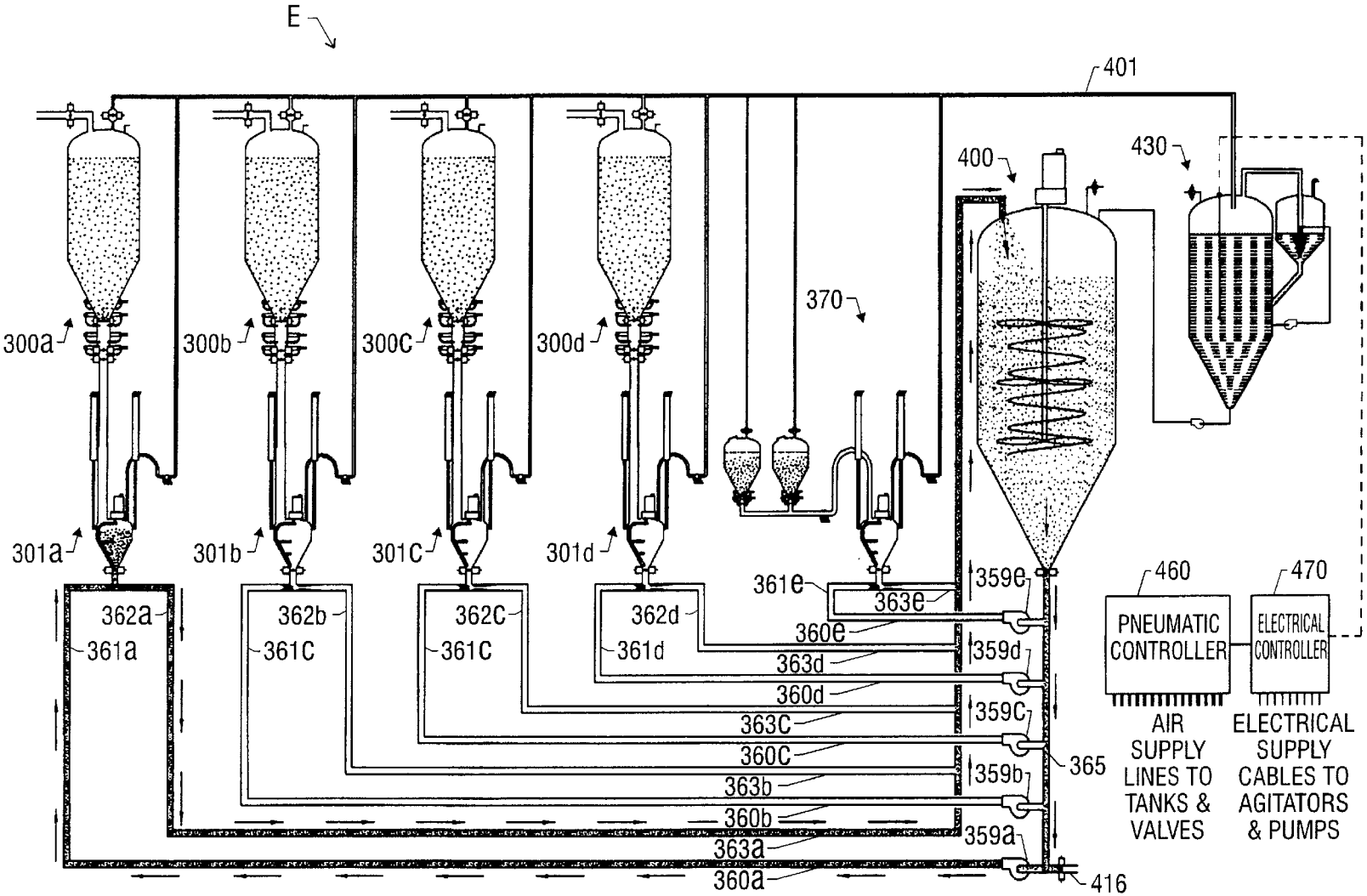

FIG. 46 depicts the automatic powder feeding system G with drilling fluid re-circulating and dry chemical powder being added. The drilling fluid is mixed in the mixing system 400. The pump 359*a* is turned on. The drilling fluid is drawn from the mixing system 400 through the line 365 by the pump 359*a*. The drilling fluid is then pumped through the lines 360*a* and 361*a* towards the hopper feeding system 301*a*. The dry chemical powder is drawn into the drilling fluid as it flows through the eductor of the hopper feeding system 301*a*. The drilling fluid with the added dry chemical powder flows back to the mixing system 400, down the line 362*a*, through the horizontal piping 363*a*, up the vertical piping 364 and into the top of the mixing tank 409. Water is sent to the mixing system F as needed to prepare the drilling fluid for use in drilling operations. When the drilling fluid is ready for use in well drilling operations, it is drawn out of the system through the outlet 416.

What is claimed is:

1. An apparatus into which a powder can be fed for mixing into a liquid, the apparatus comprising:

a wetting housing defining a wetting chamber having a top part, a bottom part, a top port in the wetting chamber's top part, and a bottom port in the wetting chamber's bottom part; and means for preventing powder from clumping by fluid force imparted from the wetting chamber's top part to keep the powder from accumulating before mixing; and a spray at the wetting chamber's bottom part to swirl the liquid and mix the powder in the liquid, said spray acting to spray the liquid in a direction toward said means for preventing powder from clumping by fluid force.

2. The apparatus of claim 1, further comprising a controller, said controller controlling a level of the liquid in the wetting chamber, the spray, and the means for preventing clumping.

3. The apparatus of claim 1, further comprising a feeder from which the powder can be fed into the wetting chamber.

4. The apparatus of claim 3, wherein the feeder comprises:

a feeder housing defining a storage chamber and an access port through which the powder may be loaded into the storage chamber;

a valve controlling the feed of the powder from the storage chamber; and a paddle rotatable within the storage chamber.

5. The apparatus of claim 1, further comprising a tank; and piping connecting the tank to the wetting chamber, said tank, when filled, contains the liquid into which the mixed powder and liquid may be introduced from the wetting chamber, and from which the mixed powder and liquid may be extracted.

6. The apparatus of claim 1, wherein the means for preventing powder from clumping includes a top spray that, when operated, swirls a second portion of the liquid into the wetting chamber from the top part to agitate the powder and the liquid, said top spray acting in a direction toward said spray at the wetting chamber's bottom part.

7. The apparatus of claim 1, further comprising an access port through which the powder can be fed, said access port being located on said wetting housing between said top port and said bottom port.

8. An apparatus into which a powder can be fed for mixing into a liquid, the apparatus comprising:

a wetting housing defining a wetting chamber having a top part, a bottom part, a top port in the wetting chamber's top part, and a bottom port in the wetting chamber's bottom part; and means for preventing powder from clumping by fluid force imparted from the wetting chamber's top part to keep the powder from accumulating before mixing; and a spray at the wetting chamber's bottom part to swirl the liquid and mix the powder in the liquid; and a feeder from which the powder can be fed into the wetting chamber, said feeder having a feeder housing defining a storage chamber and an access port through which the powder may be loaded into the storage chamber;

a three-way ball valve controlling the feed of the powder from the storage chamber; and a paddle rotatable within the storage chamber.

9. An apparatus into which a powder can be fed for mixing into a liquid, the apparatus comprising:

a wetting housing defining a wetting chamber having a top part, a bottom part, a top port in the wetting chamber's top part, and a bottom port in the wetting chamber's bottom part; and means for preventing powder from clumping by fluid force imparted from the wetting chamber's top part to keep the powder from accumulating before mixing; and a spray at the wetting chamber's bottom part to swirl the liquid and mix the powder in the liquid; and a feeder from which the powder can be fed into the wetting chambers said feeder having a feeder housing defining a storage chamber and an access port through which the powder may be loaded into the storage chamber;

at least one metering valve controlling the feed of the powder from the storage chamber; and an air injection manifold for aerating the powder loaded into the storage chamber.

10. The apparatus of claim 9, wherein the feeder further comprises a hopper feeder system.

11. The apparatus of claim 9, wherein the wetting chamber is vertically, bilaterally symmetrical.

12. The apparatus of claim 9, wherein the wetting chamber is horizontally bilaterally symmetrical.

13. An apparatus into which a powder can be fed for mixing into a liquid, the apparatus comprising:

a wetting housing defining a wetting chamber having a top part, a bottom part, a top port in the wetting chamber's top part, and a bottom port in the wetting chamber's bottom part; and means for preventing powder from clumping by fluid force imparted from the wetting chamber's top part to keep the powder from accumulating before mixing; and a spray at the wetting chamber's bottom part to swirl the liquid and mix the powder in the liquid, wherein the means for preventing powder from clumping includes a plunger that, when operated, imparts a fluid force from the wetting chamber's top part to keep the powder from accumulating before mixing.

14. An apparatus into which a powder can be fed for mixing into a liquid, the apparatus comprising:

a wetting chamber including:

a wetting housing defining a chamber having a top part, a bottom part, a top port in the wetting chamber's top part, and a bottom port in the wetting chamber's bottom part; and means for preventing powder from clumping by fluid force imparted from the wetting chamber's top part to keep the powder from accumulating before mixing; and a spray at the wetting chamber's bottom part to swirl the liquid and mix the powder in the liquid, said spray acting to spray the liquid in a direction toward said means for preventing powder from clumping by fluid force;

a tank that, when filled, contains the liquid and includes a first port and a second port permitting fluid flow through the tank;

a source of the liquid, said source of liquid being connected via a piping to the tank, the spray and the means for preventing powder from clumping; and a controller controlling the operation of the wetting chamber and the tank.

15. The apparatus of claim 14, further comprising a controller, said controller controlling a level of the liquid in the wetting chamber, the spray, and the means for preventing clumping.

16. The apparatus of claim 14, further comprising a feeder from which the powder can be fed into the wetting chamber.

17. The apparatus of claim 16 wherein the feeder comprises:

a feeder housing defining a storage chamber and an access port through which the powder may be loaded into the storage chamber;

a valve controlling the feed of the powder from the storage chamber; and a paddle rotatable within the storage chamber.

18. The apparatus of claim 14, wherein the means for preventing powder from clumping includes a top spray that, when operated, swirls a second portion of the liquid into the wetting chamber from the top part to agitate the powder and the liquid, said top spray acting in a direction toward said spray at the wetting chamber's bottom part.

19. The apparatus of claim 14, further comprising an access port through which the powder can be fed, said access port being located on said wetting housing between said top port and said bottom port.

20. An apparatus into which a powder can be fed for mixing into a liquid, the apparatus comprising:

a wetting chamber including:

a wetting housing defining a chamber having a top part, a bottom part, a top port in the wetting chamber's top part, and a bottom port in the wetting chamber's bottom part; and means for preventing powder from clumping by fluid force imparted from the wetting chamber's top part to keep the powder from accumulating before mixing; and a spray at the wetting chamber's bottom part to swirl the liquid and mix the powder in the liquid, a tank;

a first piping connecting the tank to the wetting chamber;

said tank, when filled, containing the liquid and including a first port and a second port permitting fluid flow through the tank;

a source of the liquid, said source of liquid being connected via a second piping to the tank, the spray, and the means for preventing powder from clumping;

a controller controlling the operation of the wetting chamber and the tank; and a feeder from which the powder can be fed into the wetting chamber having:

a feeder housing defining a storage chamber and an access port through which the powder may be loaded into the storage chamber;

a three-way ball valve controlling the feed of the powder from the storage chamber; and a paddle rotatable within the storage chamber.

21. An apparatus into which a powder can be fed for mixing into a liquid, the apparatus comprising:

a wetting chamber including:

a wetting housing defining a chamber having a top part, a bottom part, a top port in the wetting chamber's top part, and a bottom port in the wetting chamber's bottom part;

means for preventing powder from clumping by fluid force imparted from the wetting chamber's top part to keep the powder from accumulating before mixing;

a spray at the wetting chamber's bottom part to swirl the liquid and mix the powder in the liquid;

a tank;

said tank, when filled, containing the liquid and including a first port and a second port permitting fluid flow through the tank;

a first piping connecting the tank to the wetting chamber, a source of the liquid, said source of liquid being connected via a second piping to the tank, the spray, and the means for preventing powder from clumping, a controller controlling the operation of the wetting chamber and the tank; and a feeder from which the powder can be fed into the wetting chamber having:

a feeder housing defining a storage chamber and an access port through which the powder may be loaded into the storage chamber;

at least one metering valve controlling the feed of the powder from the storage chamber; and an air injection manifold for aerating the powder loaded into the storage chamber.

22. The apparatus of claim 21, wherein the feeder further comprises a hopper feeder system.

23. An apparatus into which a powder can be fed for mixing into a liquid, the apparatus comprising:

a wetting chamber including:

a wetting housing defining a chamber having a top part, a bottom part, a top port in the wetting chamber's top part, and a bottom port in the wetting chamber's bottom part; and means for preventing powder from clumping by fluid force imparted from the wetting chamber's top part to keep the powder from accumulating before mixing; and a spray at the wetting chamber's bottom part to swirl the liquid and mix the powder in the liquid;

a tank, said tank, when filled, containing the liquid and including a first port and a second port permitting fluid flow through the tank;

a first piping connecting the tank to the wetting chamber;

a source of the liquid, said source of liquid being connected via a second piping to the tank, the spray, and the means for preventing powder from clumping; and a controller for controlling the operation of the wetting chamber and the tank, wherein the means for preventing powder from clumping includes a plunger that, when operated, imparts a fluid force from the wetting chamber's top part to keep the powder from accumulating before mixing.

24. The apparatus of claim 23, wherein the wetting chamber is vertically, bilaterally symmetrical.

25. The apparatus of claim 23, wherein the wetting chamber is horizontally bilaterally symmetrical.

26. A method for mixing a powder into a liquid, comprising:

feeding the powder into a chamber having a bottom part and a top part;

swirling the liquid into the bottom part of the chamber;

injecting a fluid into the top part of the chamber to prevent the powder from clumping;

spraying the liquid from the bottom part of the chamber toward the top part of the chamber; and extracting the mixed powder and liquid from the chamber.

27. The method of claim 26, further comprising electronically controlling a level of the liquid in the wetting chamber;

controlling the spray; and controlling the means for preventing clumping.

28. The method of claim 27, further comprising providing a hopper feeder system.

29. The method of claim 26, further comprising:

providing a feeder including a feeder housing defining a storage chamber and an access port through which the powder may be loaded into the storage chamber;

controlling the feeding of the powder with a valve; and rotating a paddle within the storage chamber to feed the powder into the wetting chamber.

30. The method of claim 29, wherein the controlling the feeding of the powder is accomplished by providing a three-way ball valve.

31. The method of claim 26, further comprising providing a tank, and extracting the mixed liquid and powder to said tank.

32. The method of claim 26, further comprising providing a tank, and extracting the mixed liquid and powder from the tank.

33. The method of claim 26, wherein injecting the fluid into the top part of the chamber to prevent the powder from clumping includes swirling a second portion of the liquid into the wetting chamber from the top part to agitate the powder and the liquid.

34. The method of claim 26, wherein injecting the fluid into the top part of the chamber to prevent the powder from clumping includes actuating a plunger that allows air into the wetting chamber's top part.

35. The method of claim 26, further comprising:

providing an access port located on the chamber between the top part and the bottom part; and feeding the powder into the chamber through said access port.

* * * * *